US007775519B2

(12) United States Patent
Takahashi et al.

(10) Patent No.: US 7,775,519 B2
(45) Date of Patent: Aug. 17, 2010

(54) LARGE CAPACITY SHEET FEEDING APPARATUS HAVING AN INTERMEDIATE CONVEYING DEVICE

(75) Inventors: Mituru Takahashi, Miyagi (JP); Tomotaka Osada, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 984 days.

(21) Appl. No.: 10/895,065

(22) Filed: Jul. 21, 2004

(65) Prior Publication Data

US 2005/0017430 A1 Jan. 27, 2005

(30) Foreign Application Priority Data

Jul. 25, 2003 (JP) ..... 2003-201811

(51) Int. Cl.
*B65H 7/02* (2006.01)

(52) U.S. Cl. ..... 271/258.01; 271/265.02; 271/10.03

(58) Field of Classification Search ..... 271/10.01, 271/10.03, 259, 258.01, 265.02, 265.01, 271/110, 111

See application file for complete search history.

(56) References Cited

U.S. PATENT DOCUMENTS 5,380,109 A * 1/1995 Eckert et al. ..... 400/708
5,441,247 A 8/1995 Quilliam (Continued)

FOREIGN PATENT DOCUMENTS

JP 59-124633 7/1984

(Continued)

OTHER PUBLICATIONS

U.S. Appl. No. 10/796,194, filed Mar. 10, 2004, Satoh et al.

*Primary Examiner*—Patrick Mackey
*Assistant Examiner*—Thomas A Morrison
(74) *Attorney, Agent, or Firm*—Oblon, Spivak, McClelland, Maier & Neustadt, L.L.P.

(57) ABSTRACT

A sheet feeding apparatus includes a sheet stacking section configured to stack a number of sheets, a sheet feeding mechanism configured to feed the sheet stacked on the sheet stacking section one by one, and an intermediate conveying device configured to convey the sheet fed from the sheet feeding mechanism to an image forming apparatus. The intermediate conveying device includes a plurality of sheet conveying devices arranged in an intermediate sheet conveying path at certain intervals to convey the sheet fed from the sheet feeding mechanism, at least one driving device configured to drive each of the plurality of sheet conveying devices, and a plurality of sheet detecting devices arranged in the intermediate sheet conveying path at certain intervals to detect a sheet length by detecting at least one of a leading edge and a trailing edge of the conveyed sheet. The sheet feeding apparatus further includes a control device configured to judge the length of a first sheet according to signals sent from the plurality of sheet detecting devices at an initialization time at which the conveying operation for the first sheet is completed, in which when the sheet feeding apparatus and the image forming apparatus are mechanically connected and are allowed to communicate with each other, the control device stops a sheet conveying operation of the image forming apparatus if the length of a sheet is judged to be different from the length of the first sheet after the initialization time.

6 Claims, 38 Drawing Sheets

U.S. PATENT DOCUMENTS

| | | | | |
|---|---|---|---|---|
| 6,006,210 | A * | 12/1999 | Freeman et al. | 705/402 |
| 6,237,485 | B1 * | 5/2001 | Fukai | 101/118 |
| 6,834,853 | B2 * | 12/2004 | Trovinger et al. | 271/227 |

FOREIGN PATENT DOCUMENTS

| | | |
|---|---|---|
| JP | 5-18342 | 5/1993 |
| JP | 8-259008 | 10/1996 |
| JP | 8-259009 | 10/1996 |
| JP | 10-45268 | 2/1998 |
| JP | 2002-226122 | 8/2002 |
| JP | 2002-326732 | 11/2002 |

* cited by examiner

FIG. 16

| PRINTING SPEED | SHEET LENGTH (FIRST TO EIGHTH SENSORS) | SHEET SIZE | POSITION WHERE THE TRAILING EDGE OF FIRST SHEET EXISTS (BETWEEN SENSORS) | SECOND SHEET LOADING SENSOR (CONVEYANCE TYPE) |
|---|---|---|---|---|
| 16 RPM<br>30 RPM TO 120 RPM | LONG SIZED SHEET | DOUBLE LETTER Y, A3 Y | 0-1 | 1ST SENSOR |
| | | B4 Y, LEGAL Y | 1-2 | 2ND SENSOR |
| | SHORT SIZED SHEET | A4 Y, B5 Y, LETTER SIZE Y | 2-3 | 3RD SENSOR |
| | | A4 T, LETTER SIZE T | 3-4 | 4TH SENSOR |
| | | B5 T | 4-5 | 5TH SENSOR |

FIG. 32A
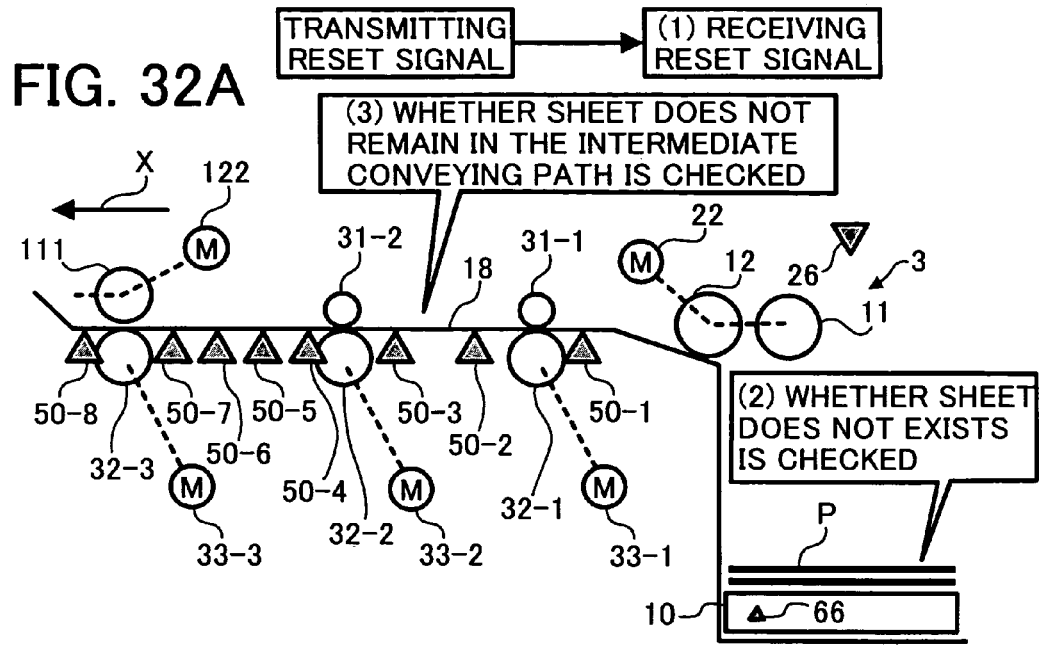
FIG. 32B
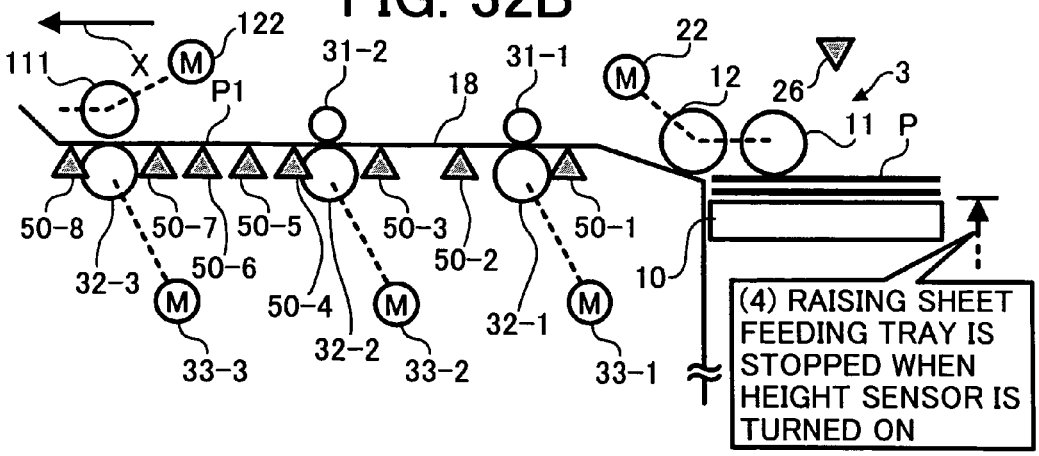
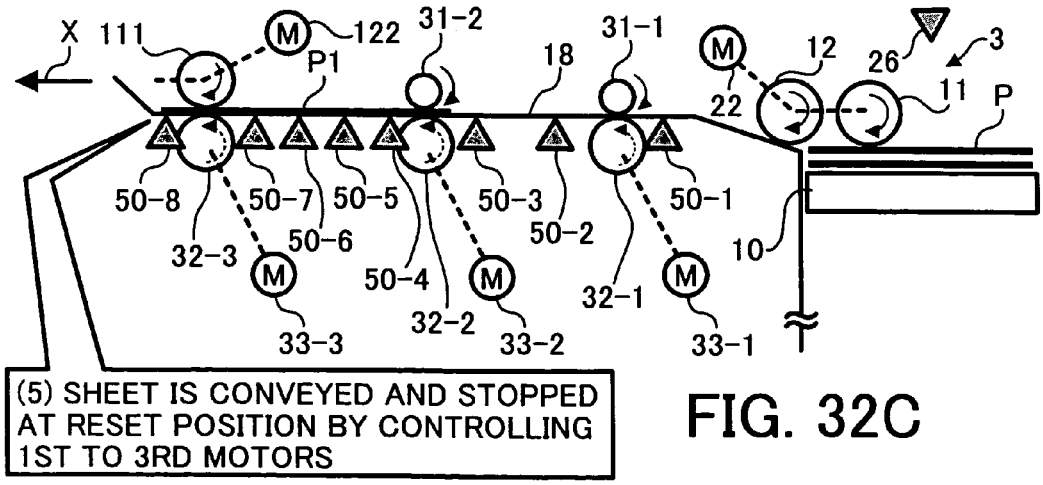
FIG. 32C

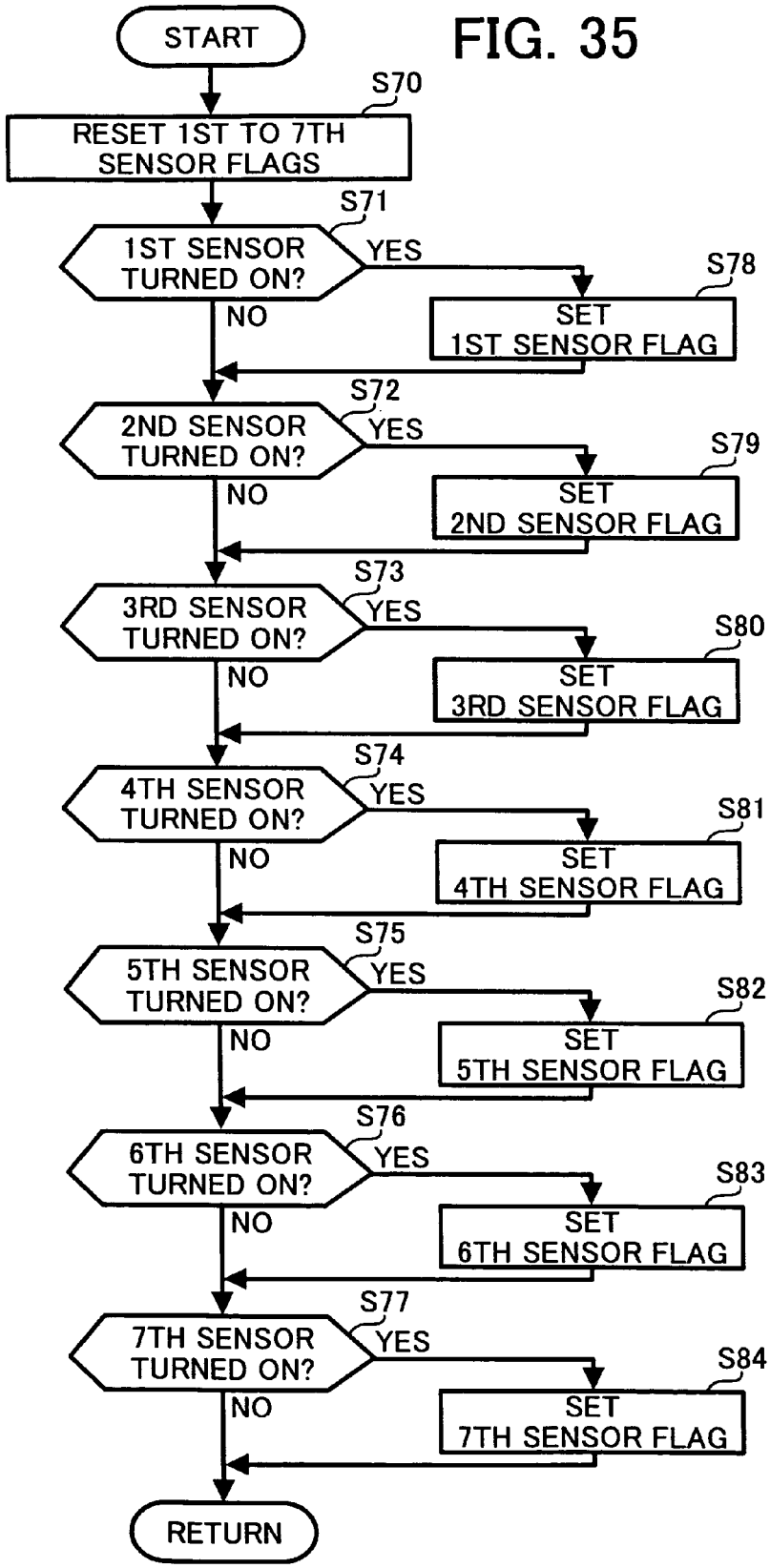
FIG. 35
START
S70
RESET 1ST TO 7TH SENSOR FLAGS
S71
1ST SENSOR TURNED ON?
YES
NO
S78
SET 1ST SENSOR FLAG
S72
2ND SENSOR TURNED ON?
YES
NO
S79
SET 2ND SENSOR FLAG
S73
3RD SENSOR TURNED ON?
YES
NO
S80
SET 3RD SENSOR FLAG
S74
4TH SENSOR TURNED ON?
YES
NO
S81
SET 4TH SENSOR FLAG
S75
5TH SENSOR TURNED ON?
YES
NO
S82
SET 5TH SENSOR FLAG
S76
6TH SENSOR TURNED ON?
YES
NO
S83
SET 6TH SENSOR FLAG
S77
7TH SENSOR TURNED ON?
YES
NO
S84
SET 7TH SENSOR FLAG
RETURN

LARGE CAPACITY SHEET FEEDING APPARATUS HAVING AN INTERMEDIATE CONVEYING DEVICE

The present application claims priority and contains subject matter related to Japanese Patent Applications NO. 2003-201811 filed in the Japanese Patent Office on Jul. 25, 2003, and the entire contents of which are hereby incorporated by reference.

BACKGROUND OF THE INVENTION

1. Field of the Invention

The present invention relates to a large capacity sheet feeding apparatus having an intermediate conveying device that feeds a sheet on which an image is to be formed to an image-forming apparatus, such as a copying machine, a printing press, a facsimile machine, a printer, a plotter, and the like.

2. Discussion of the Background

In any image forming apparatus, such as a copying machine, a facsimile machine, various kinds of printers, such as a printing press, a mimeographic printer, an ink-jet printer, or the like, and a plotter, the printer, more particularly a mimeographic printer or an offset printer, is often called upon to produce a large amount of prints. This is because, unlike the case of a copying machine, a master, i.e., a plate that is made with an image of an original document is used and the master allows producing a great number of prints. There are many cases in which even several thousands of prints from the original document are produced if required.

It is assumed that a large capacity sheet feeding apparatus with an intermediate conveying device capable of feeding a large number of sheets on which an image will be formed must be mechanically connected to such an image forming apparatus as a printer or the like (See U.S. Pat. No. 5,441,247, for example).

The large capacity sheet feeding apparatus having an intermediate conveying device recited in the U.S. Pat. No. 5,441,247 is provided with a sheet stacking section having a large capacity sheet feeding tray capable of rising and lowering with at least several thousands of sheets stacked thereupon, a sheet feeding mechanism section that feeds the sheet while picking up the same in a sequential manner from the sheet stacking section, and an intermediate conveying device that conveys the sheet fed from the sheet feeding mechanism section to a main body sheet feeding tray of a sheet feeding section on a side of a main body of an image forming apparatus, or in the vicinity of a sheet feeding inlet where a main body sheet feeding device of the sheet feeding section faces.

The invention recited in the aforementioned U.S. Pat. No. 5,441,247 relates to an apparatus and method for feeding a paper sheet (a so-called cut sheet, and is hereinafter referred to as a sheet) that is stacked in, and picked up from a storage and fed to a high speed printing machine during its operation. According to the above-mentioned invention, the large capacity sheet feeding apparatus having the intermediate conveying device of the above-mentioned invention is responsive to a recent trend of increasing speed of printing machines and copying machines. In addition, the apparatus and method recited in the aforementioned invention are movable and applicable for various kinds of image forming apparatus, such as a printer or the like. Therefore, a large capacity sheet storage apparatus can be provided for a low price.

On the other hand, in the aforementioned various kinds of image forming apparatus, to which a large capacity sheet feeding apparatus having an intermediate conveying device is connected, specifically, in a mimeographic printing apparatus, the sheets of various kinds of sizes are used. Generally, in the sheet sizes for use in the mimeographic printing apparatus, ten kinds of sheet sizes are commonly used even the size of a postcard is taken off as described later.

In the mimeographic printing apparatus, a reproduced heat-sensitive mimeographic master is entrained about a circumferential face of a printing drum, or master drum, and the sheet which is fed from the sheet feeding section is pressed toward the circumferential face of the printing drum by a pressing device such as a pressing roller or a pressing drum. Ink is thereby exuded from an opening portion of the printing drum and perforations of a heat-sensitive mimeographic master. The ink is transferred to a sheet and printed image is thereby obtained.

However, in the technique disclosed in the aforementioned U.S. Pat. No. 5,441,247, even when the mimeographic printing apparatus and the large capacity sheet feeding apparatus having the intermediate conveying device are not electrically connected or not connected in a state capable of communicating with each other, namely, in a usually called "off line" mode, the printer can execute a printing operation with a sheet fed from the large capacity sheet feeding apparatus having an intermediate conveying device.

However, when a sheet smaller than the selected printed matter is mixed in with sheets of appropriate size on the large capacity sheet feeding tray a problem occurs when the mimeographic printing apparatus does not detect that the sheet is too small, and the image overhangs the size of the sheets. Further, when the ink is transferred to the pressing drum the overhanging image, larger than the aberrant sheet, results in ink applied to the drum and a press roller. The accumulated ink causes both sheet jamming and inappropriate printing on the rear surface of a sheet, which is fed after a preceding sheet stained with ink.

Furthermore, the ink put on the circumferential surface of the press roller and the printing drum accumulates and scatters or falls down. An inner part of the machine is thereby stained. Those are the problems of the aforementioned U.S. Pat. No. 5,441,247.

When a sheet of the size smaller than the reproducing and printing size is mixed in the sheets stacked on a sheet feeding tray on a side of the main body of the mimeographic printing apparatus, the problem similar to the above mentioned problem also exists. From other point of view, in a case that the mimeographic printing apparatus is not, even mechanically, connected to the large capacity sheet feeding apparatus having the intermediate conveying device, the problem similar to the above mentioned problem also occurs.

Accordingly, the inventors of the present invention noted that in a condition that the mimeographic printing apparatus and the large capacity sheet feeding apparatus having the intermediate conveying device are mechanically connected under a condition of communicating with each other, the intermediate conveying device is provided with a relatively long intermediate sheet conveying path for conveying sheets fed from a sheet feeding section one after another. The inventors proposed a sheet size detecting mechanism that detects the sheet size of the sheets fed from the sheet feeding mechanism, utilizing the long intermediate sheet conveying path, and the inventors thereby completed an invention which prevents a delivery of a sheet having a size different from the reproducing and printing size to the mimeographic printing apparatus, even when a sheet having the size different from reproducing and printing size is mixed to the sheets on the large capacity sheet feeding tray.

Therefore, the present invention is made in light of the above described problem and a main object of the present invention is to solve the above problem and to provide a novel large capacity sheet feeding apparatus having an intermediate conveying device being effectual as described later.

SUMMARY OF THE INVENTION

The present invention has been made in view of the above-discussed and other problems and addresses the above-discussed and other problems.

Preferred embodiments of the present invention provide a novel sheet feeding apparatus having an intermediate conveying device capable of consecutively conveying a sheet to an image forming apparatus securing certain intervals between the conveyed sheets.

According to a preferred embodiment of the present invention, a sheet feeding apparatus includes a sheet stacking section configured to stack a number of sheets, a sheet feeding mechanism configured to feed the sheet stacked on the sheet stacking section one by one, and an intermediate conveying device configured to convey the sheet fed from the sheet feeding mechanism to an image forming apparatus. The intermediate conveying device includes a plurality of sheet conveying devices arranged in an intermediate sheet conveying path at certain intervals to convey the sheet fed from the sheet feeding mechanism, at least one driving device configured to drive each of the plurality of sheet conveying devices, and a plurality of sheet detecting devices arranged in the intermediate sheet conveying path at certain intervals to detect a sheet length by detecting at least one of a leading edge and a trailing edge of the conveyed sheet. The sheet feeding apparatus further includes a control device configured to judge the length of a first sheet according to signals sent from the plurality of sheet detecting devices at an initialization time at which the conveying operation for the first sheet is completed, in which when the sheet feeding apparatus and the image forming apparatus are mechanically connected and are allowed to communicate with each other, the control device stops a sheet conveying operation of the image forming apparatus if the length of a sheet is judged to be different from the length of the first sheet after the initialization time.

According to another preferred embodiment of the present invention, a sheet feeding apparatus includes a sheet stacking section configured to stack a number of sheets, a sheet feeding mechanism configured to feed the sheet stacked on the sheet stacking section one by one, and an intermediate conveying device configured to convey the sheet fed from the sheet feeding mechanism to an image forming apparatus. The sheet stacking section includes a sheet feeding tray capable of stacking a number of sheets and a plurality of sheet length detecting devices arranged from an upstream to a downstream of the sheet feeding tray at certain intervals to detect a sheet length of the sheets on the sheet feeding tray. The intermediate conveying device includes a plurality of sheet conveying devices arranged in an intermediate sheet conveying path at certain intervals to convey the sheet fed from the sheet feeding mechanism, at least one driving device configured to drive each of the plurality of sheet conveying devices, and a plurality of sheet detecting devices arranged in the intermediate sheet conveying path from the upstream to the downstream at certain intervals to detect a sheet length by detecting at least one of a leading edge and a trailing edge of the conveyed sheet. The sheet feeding apparatus further includes a control device configured to judge the length of a first sheet according to signals sent from the plurality of sheet detecting devices at an initialization time and after the initialization time at which the conveying operation for the first sheet is completed, in which when the sheet feeding apparatus and the image forming apparatus are mechanically connected and are allowed to communicate with each other, the control device stops a sheet conveying operation of the image forming apparatus if the length of a sheet is judged to be different from the length of the first sheet at the initialization time and after the initialization time.

According to another preferred embodiment of the present invention, a sheet feeding apparatus includes a sheet stacking section configured to stack a number of sheets and the sheet stacking section includes a sheet feeding tray capable of stacking a number of sheets, a plurality of sheet length detecting devices arranged from an upstream to a downstream of the sheet feeding tray at certain intervals to detect a sheet length of the sheets on the sheet feeding tray, and a plurality of sheet width detecting devices arranged at certain intervals in a sheet width direction of the sheet feeding tray to detect a sheet width of the sheet stacked on the sheet feeding tray. The sheet feeding apparatus further includes a sheet feeding mechanism configured to feed the sheet stacked on the sheet stacking section one by one, and an intermediate conveying device configured to convey the sheet fed from the sheet feeding mechanism to an image forming apparatus. The intermediate conveying device includes a plurality of sheet conveying devices arranged in an intermediate sheet conveying path at certain intervals to convey the sheet fed from the sheet feeding mechanism, at least one driving device configured to drive each of the plurality of sheet conveying devices, a plurality of sheet detecting devices arranged in the intermediate sheet conveying path at certain intervals to detect a sheet length by detecting at least one of a leading edge and a trailing edge of the conveyed sheet, and a plurality of sheet width detecting devices arranged at certain intervals in a sheet width direction perpendicular to the intermediate sheet conveying path to detect a sheet width of the sheet being conveyed. The sheet feeding apparatus further includes a control device configured to judge at least one of the sheet length of a first sheet according to signals sent from the plurality of sheet detecting devices and the sheet width of the first sheet according to signals sent from the sheet width detecting device for sheet feeding tray at an initialization time and after the initialization time at which the conveying operation for the first sheet is completed, in which when the sheet feeding apparatus and the image forming apparatus are mechanically connected and are allowed to communicate with each other, the control device stops a sheet conveying operation of the image forming apparatus if at least one of the sheet length according to signals sent from the plurality of sheet detecting devices and the sheet width according to signals sent from the sheet width detecting device for sheet feeding tray is judged to be different from the length of the first sheet at the initialization time and after the initialization time.

According to still another embodiment of the present invention, an image forming system includes an image forming apparatus and a sheet feeding apparatus configured to feed a sheet to the image forming apparatus. The sheet feeding apparatus includes a sheet stacking section configured to stack a number of sheets, a sheet feeding mechanism configured to feed the sheet stacked on the sheet stacking section one by one, and an intermediate conveying device configured to convey the sheet fed from the sheet feeding mechanism to a sheet feeding section of the image forming apparatus. The intermediate conveying device includes a plurality of sheet conveying devices arranged in an intermediate sheet conveying path at certain intervals to convey the sheet fed from the sheet feeding mechanism, at least one driving device configured to drive each of the plurality of sheet conveying devices, and a plurality of sheet detecting devices arranged in the intermediate sheet conveying path at certain intervals to detect a sheet length by detecting at least one of a leading edge and a trailing edge of the conveyed sheet. The sheet feeding apparatus further includes a control device configured to judge the length of a first sheet according to signals sent from the plurality of sheet detecting devices at an initialization time at which the conveying operation for the first sheet is completed, in which when the sheet feeding apparatus and the image forming apparatus are mechanically connected and are allowed to communicate with each other, the control device stops a sheet conveying operation of the image forming apparatus if the length of a sheet is judged to be different from the length of the first sheet after the initialization time, in which the image forming apparatus is a mimeographic printing apparatus comprising a printing drum about which a reproduced heat-sensitive mimeographic master is entrained, in which the image is formed on the sheet fed from the sheet conveying device by supplying an ink from inside of the printing drum while pressing the printing drum to the sheet.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompany drawings, wherein:

FIG. 16 is a table including data for use in a sheet conveyance control pattern of the aforementioned embodiment of the present invention;

FIG. 32A to FIG. 32C are elevations explaining the transition of the reset operation;

FIG. 35 is a flowchart relevant to sheet length detection;

DETAILED DESCRIPTION OF THE PREFERRED EMBODIMENTS

Figure 1:
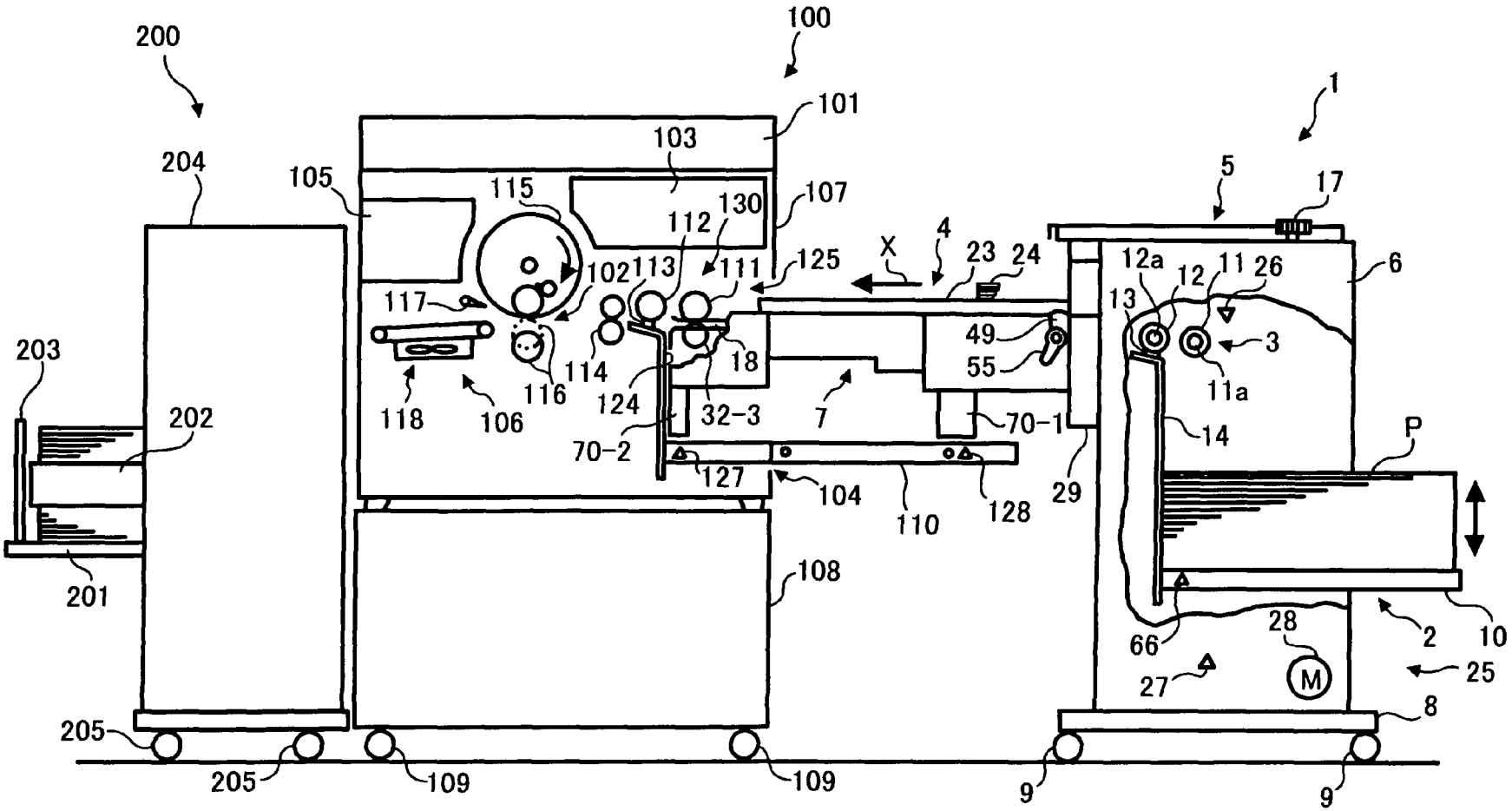
FIG. 1 is an elevation partly in section illustrating an entire structure of a first embodiment of the present invention in which a large capacity sheet feeding/conveying unit, a mimeographic printing apparatus, and a large capacity sheet discharging/storing unit are connected with each other.

Referring now to the drawings, wherein like reference numerals designate identical or corresponding parts throughout the several views, preferred embodiments of the present invention are described. Further, when an element of a Laid-Open Patent Publication or the like is referred to an explanation, a numeral or a mark that denotes the element is indicated with parentheses and thereby distinguished from the element in the embodiment of the present invention.

First Embodiment

A first embodiment of the present invention is explained referring to FIGS. 1 through 36.

Figure 2:
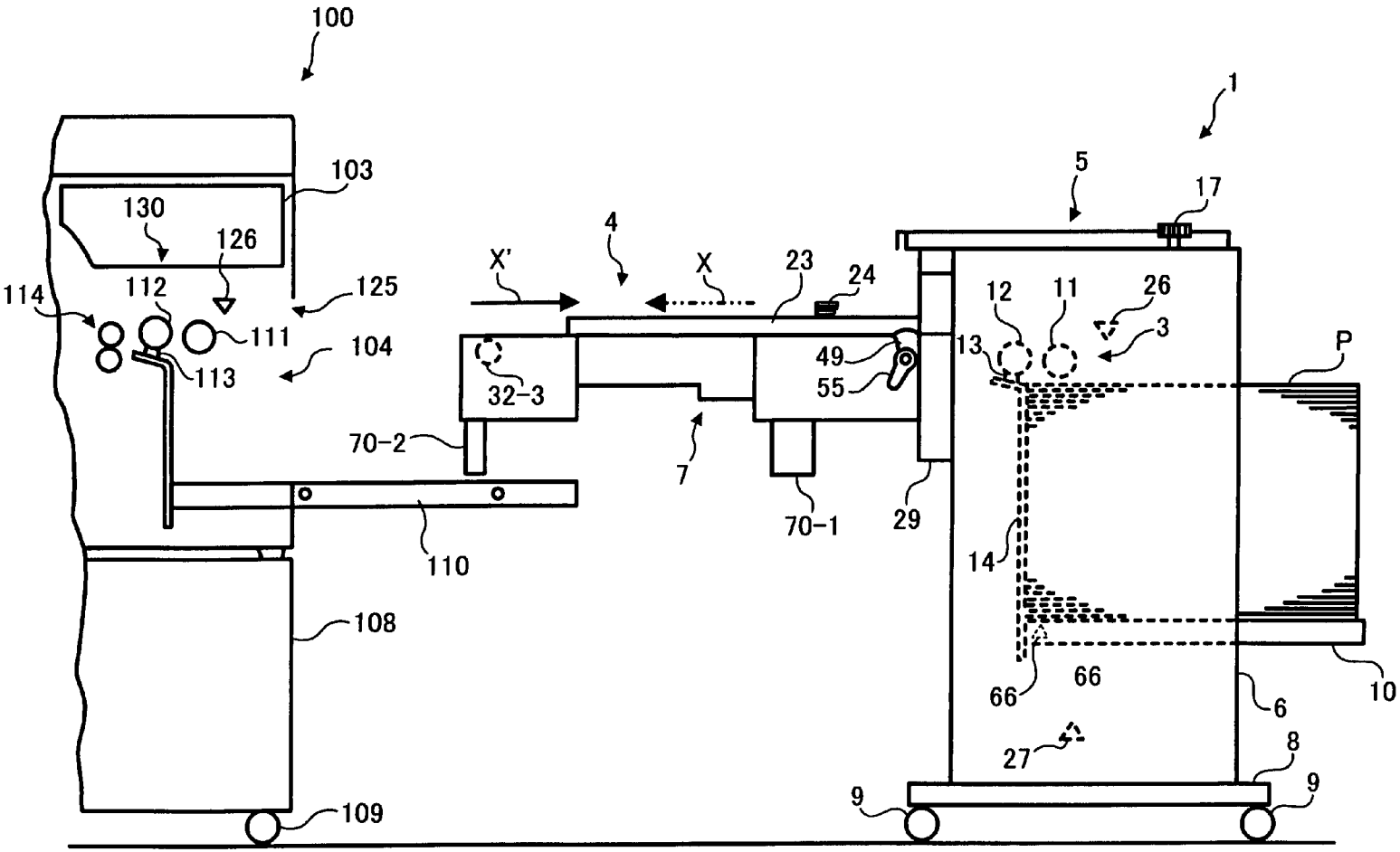
FIG. 2 is an elevation illustrating a large capacity sheet feeding/conveying unit located at a disconnected position.

First, an entire construction including a large capacity sheet feeding apparatus which has an intermediate conveying device relevant to the present invention is explained referring to FIGS. 1 and 2. In FIGS. 1 and 2, numeral 1 denotes a large capacity sheet feeding/conveying unit that serves as the large capacity sheet feeding apparatus which has the intermediate conveying device. Numeral 100 denotes a mimeographic printing apparatus as an example of an image forming apparatus, and numeral 200 denotes a large capacity sheet discharging/storing unit that serves as a large capacity sheet discharging/storing apparatus, respectively.

The aforementioned entire apparatus including the large capacity sheet feeding/conveying unit 1 and the mimeographic printing apparatus 100 is sometimes referred to as an image forming system in the present invention.

The large capacity sheet feeding/conveying unit 1 and the large capacity sheet discharging/storing unit 200 are electrically connected using a power cable (not illustrated) The large capacity sheet feeding/conveying unit 1 and the mimeographic printing apparatus 100 are not connected in a state capable of communicating with each other, namely, in a state of a so-called "off-line mode" in which a transmission and a reception cannot be executed to each other. Further, the large capacity sheet feeding/conveying unit 1 can be mechanically connected to or attached/detached to the mimeographic printing apparatus 100.

Furthermore, the large capacity sheet discharging/storing unit 200 can be mechanically connected to or attached/detached to the mimeographic printing apparatus 100. FIG. 1 illustrates a state in which three of the large capacity sheet feeding/conveying unit 1, the mimeographic printing apparatus 100, and the large capacity sheet discharging/storing unit 200 are mechanically connected to each other.

The large capacity sheet feeding/conveying unit 1 takes either one of two positions as described below.

(1) Connected Position: After approaching the mimeographic printing apparatus 100 in a direction indicated by an arrow X, a third conveying roller 32-3 of the intermediate conveying device (hereinafter referred to as an intermediate conveying unit 4) reaches a position beneath a main body sheet feeding roller 111 on a side of the mimeographic printing apparatus 100 and the third conveying roller 32-3 contacts the main body sheet feeding roller 111 with pressure. The connected position thereby allows a sheet P that is fed from the large capacity sheet feeding/conveying unit 1 to be securely received and delivered to the mimeographic printing unit 100, as illustrated in FIG. 1.

(2) Disconnected Position: After leaving from the mimeographic printing apparatus 100, in a direction indicated by an arrow X' i.e., opposing the direction indicated by the arrow X, the state of pressure contact between the third conveying roller 32-3 of the intermediate conveying unit 4 and the main body sheet feeding roller 111 is released, as illustrated in FIG. 2.

Thus, the large capacity sheet feeding/conveying unit 1 is configured to move between a connected position and a disconnected position. When the large capacity sheet feeding/conveying unit 1 is located at the connected position, the relationship between the third conveying roller 32-3 and the main body sheet feeding roller 111 is configured such that the third conveying roller 32-3 receives a pressure contact from the main body sheet feeding roller 111 corresponding to a proper sheet feeding pressure.

In other words, as illustrated in FIGS. 1 and 2, the large capacity sheet feeding/conveying unit 1 is configured to be movable between the connected position (in FIG. 1) and the disconnected position (in FIG. 2) along the sheet conveying direction indicated by arrows X and X'. Further, the intermediate conveying unit 4 that serves as one of components of the large capacity sheet feeding/conveying unit 1 is remaining at a predetermined height above a main body sheet feeding tray 110. (In the first embodiment of the present invention, the main body sheet feeding tray 110 remains at a lower limit position which is detected by a lower limit sensor (not illustrated) disposed at a sheet feeding side plate.) The lower limit position is the lowermost position to which the main body sheet feeding tray 110 lowers down.

Consequently, in the connected position of the large capacity sheet feeding/conveying unit 1, the sheet P conveyed by the intermediate conveying unit 4 is received and fed by the main body sheet feeding roller 111 while the main body sheet feeding tray 110 remains at the lower limit position without rising.

The connected position is not limited to the condition in which the main body sheet feeding tray 110 remains at the lower limit position, but the main body sheet feeding tray 110 may slightly be raised from the lower limit position such that the sheet feeding operation of the main body sheet feeding roller 111 can be executed.

That is, the condition allows the main body sheet feeding tray 110 to remain at a predetermined height, above which the intermediate conveying unit 4 is located, and in which the sheet P can be received from the intermediate conveying unit 4 and delivered by the main body sheet feeding roller 111.

In FIGS. 1 and 2, numeral 6 denotes a main body housing that represents a frame as a main body of the large capacity sheet feeding/conveying apparatus that includes a stacking section 2 and a sheet feeding mechanism 3 described later. Numeral 7 denotes a housing that represents a main body of the intermediate conveying unit 4, described later, of a main body of an image forming apparatus. Numeral 107 denotes a main body housing that represents a frame of a main body side of the mimeographic printing apparatus 100 as a main body of an image forming apparatus. Numeral 204 denotes a sheet discharging unit housing that represents a frame on a side of a main body of the large capacity sheet discharging/storing unit 200 as a main body of a sheet discharging/storing apparatus, respectively.

For convenience of explanation, the description will now be given in the order of the mimeographic printing apparatus 100, the large capacity sheet discharging/storing unit 200, and the large capacity sheet feeding/conveying unit 1.

The mimeographic printing apparatus 100 is configured to be, for example, substantially the same to the mimeographic printing apparatus illustrated in FIG. 1 of Japanese Patent Laid-Open Publication No. Hei8-67061, which is proposed by the present applicant. That is, the mimeographic printing apparatus 100 includes an image reading section 101 that reads an image of the original document placed on the main body housing 107. Also, the mimeographic printing apparatus 100 includes a reproducing and master feeding section 103 that reproduces a heat-sensitive mimeographic master (not illustrated), which is rolled into a cylinder, on the basis of image information. This image is input by the image reading section 101 or, alternatively, by image information input by outside devices to be connected, such as a personal computer, etc. (not illustrated).

The mimeographic printing apparatus 100 also includes a main body sheet feeding section 104 that represents a sheet feeding section on a side of a main body of an image forming apparatus that separates and feeds the printing sheet (hereinafter simply referred to as "sheet") P, that is fed from a side of the large capacity sheet feeding/conveying unit 1 toward a printing section 102 (described later), and a printing drum 115 provided with a master drum on the circumferential surface thereof around which the heat-sensitive mimeographic master reproduced by the reproducing and master feeding section 103 (not illustrated) is entrained.

Furthermore, the mimeographic printing apparatus 100 includes the printing section 102 that serves as an image forming section that forms printing image on the sheet P, and a sheet discharging section 106 that discharges the printed sheet with image thereupon out of the main body housing 107. The mimeographic printing apparatus 100 is mounted on a special table 108 having a plurality of casters (four casters in general) 109 via the main body housing 107.

The main body sheet feeding section 104 includes the main body sheet feeding tray 110 arranged at the right side of the main body housing 107 capable of rising and lowering with stacked sheets P, and the main body sheet feeding roller 111 that feeds a topmost sheet (not illustrated) on the main body sheet feeding tray 110 or the sheet P that is fed from the large capacity sheet feeding/conveying unit 1. In addition, the main body sheet feeding section 104 includes a main body separation roller 112 that separates the sheet P one by one and delivers the sheet P toward a registration rollers pair 114, a main body separation pad 113 as a friction member so as to separate the sheets P by cooperative operation with the main body separation roller 112, and the registration rollers pair 114 that delivers the sheet P separated and fed one by one toward the printing section 102 that serves as the image forming section at a predetermined timing.

The main body sheet feeding tray 110 is configured to be foldable so as to take either one of a position at which a sheet feeding inlet 125 of the main body housing 107 is obstructed, and a position illustrated in FIG. 1. Further, a sheet existence sensor 127 as an existence detecting device for detecting the existence of the sheet on the main body sheet feeding tray 110 and a sheet length sensor 128 as a sheet length detecting device for detecting the length of the sheet on the main body sheet feeding tray 110 are arranged inside of the main body sheet feeding tray 110.

Figure 6:
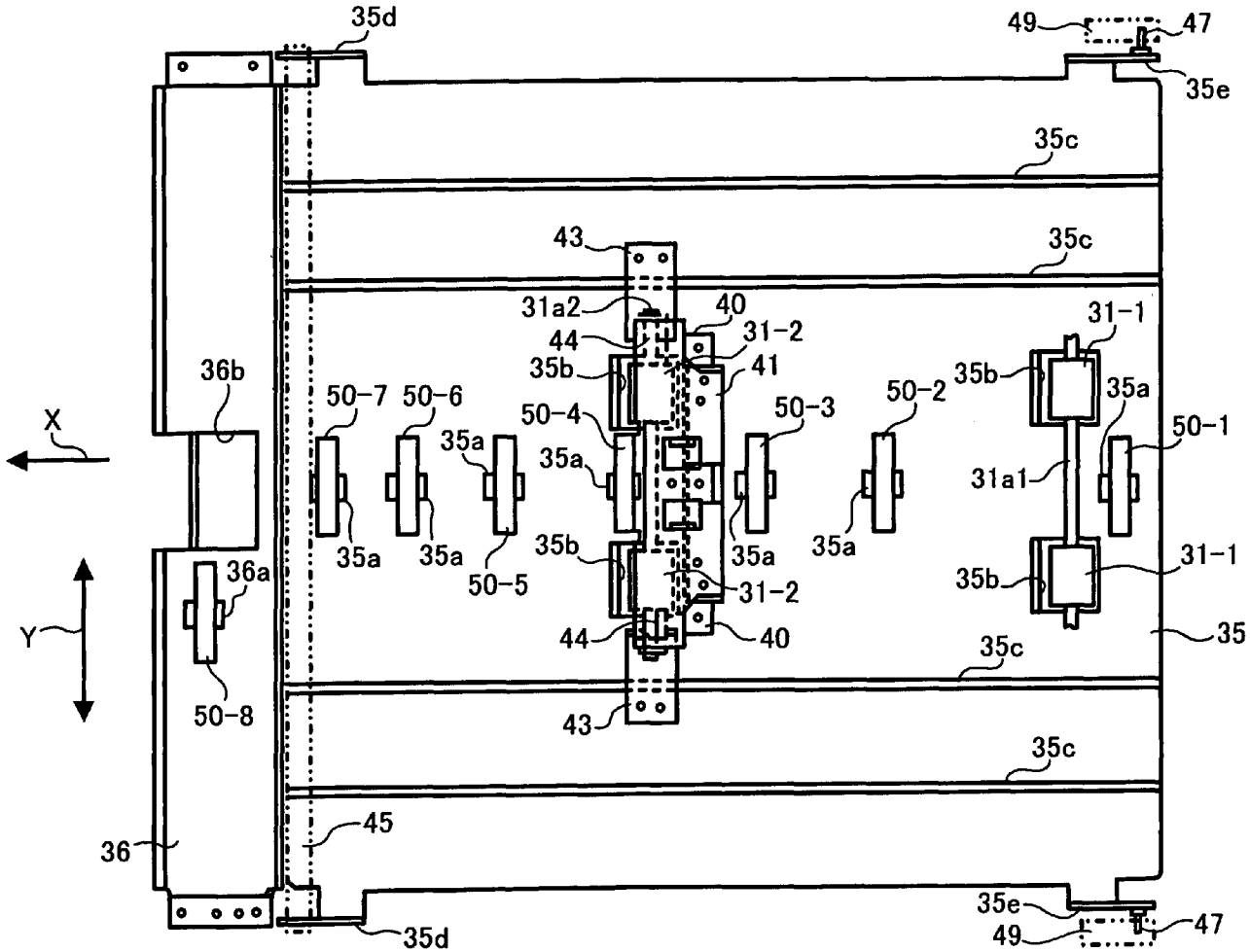
FIG. 6 is a top plan view illustrating a main structure and vicinity of the upper guide plate at a state in which an upper cover is removed.

The sheet length sensor 128 serves as a sheet size detecting device that detects both of the sheet length and the sheet width in response to a movement of a pair of left and right side fences (not illustrated), which is movable on the main body sheet feeding tray 110 in a widthwise direction Y of the sheet, for jogging side positions of the sheets, as illustrated in FIG. 6. Both of the sheet existence sensor 127 and the sheet length sensor 128 are reflection type photo-sensors provided with a light emitting element and a light accepting element (hereinafter simply referred to as a reflection type photo-sensor).

Figure 3:
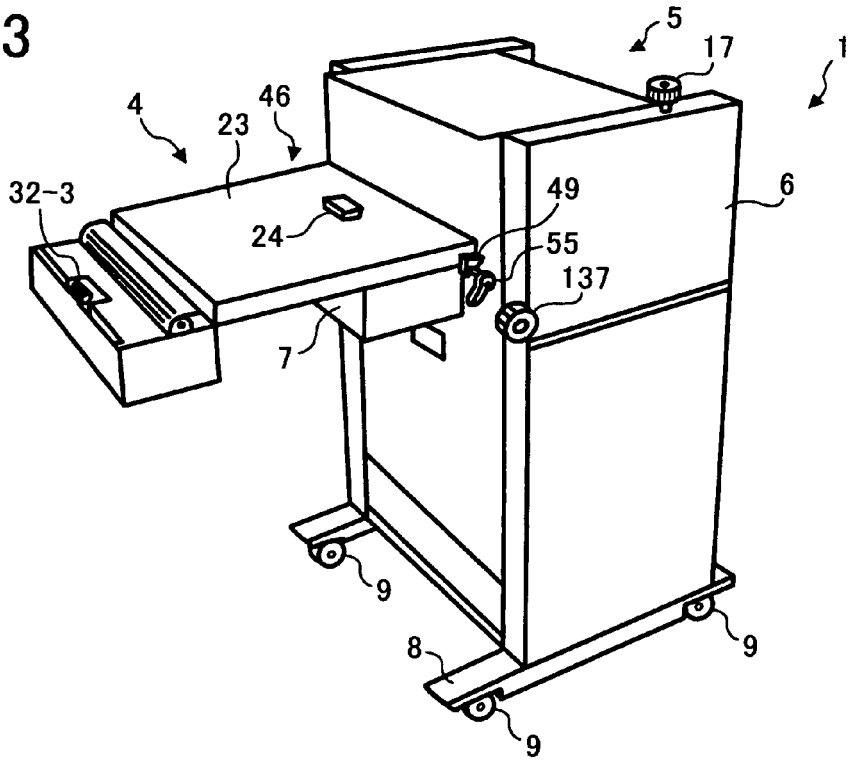
FIG. 3 is a perspective view seeing from the front illustrating a large capacity sheet feeding/conveying unit.
Figure 8:
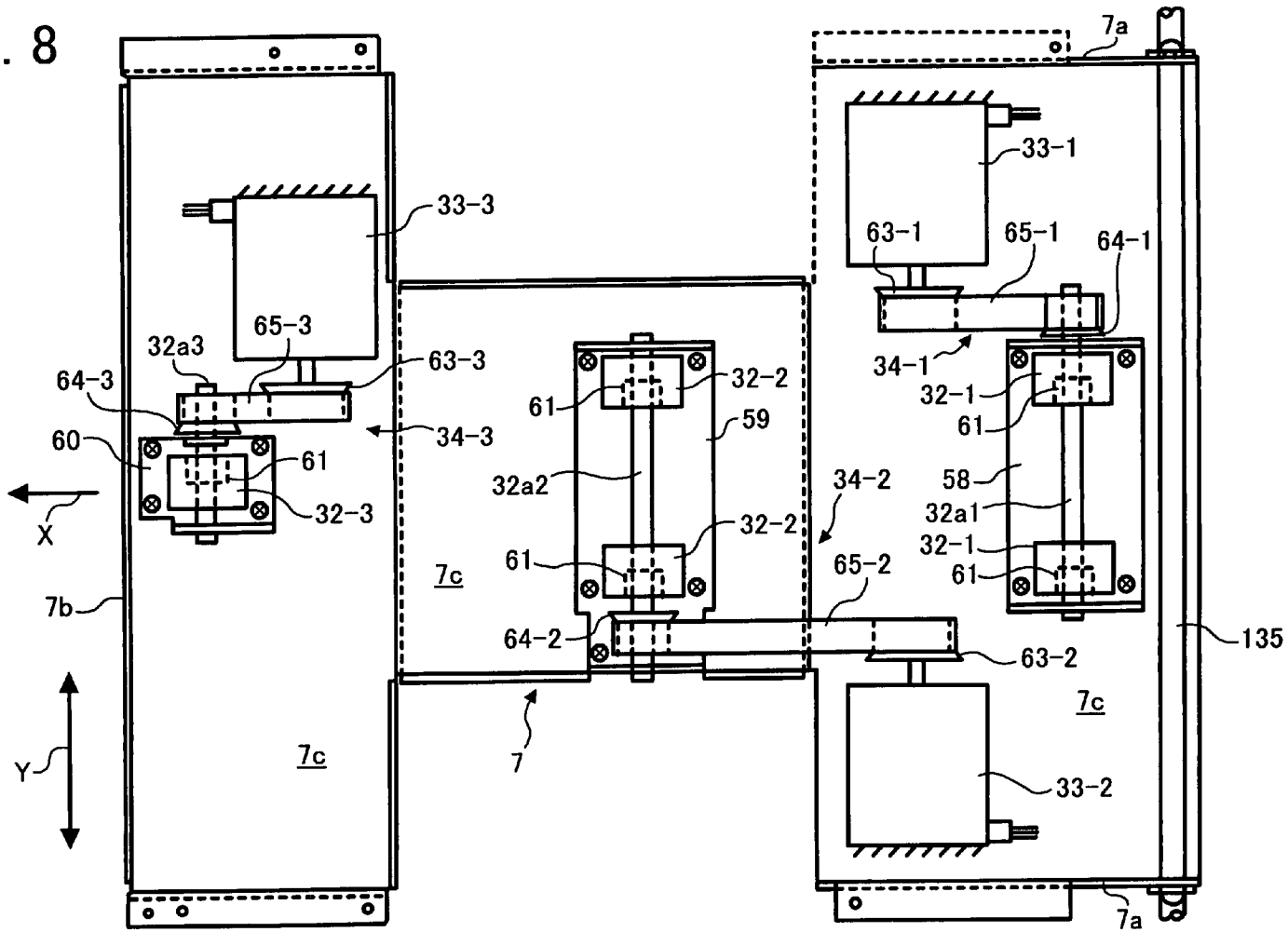
FIG. 8 is a top plan view illustrating a main structure and vicinity of a housing at a state in which the upper cover, the upper guide plate, and the lower guide plate are removed.

The main body sheet feeding tray 110 is provided with an elevator mechanism that is a similar configuration to an automatic intermittent elevator mechanism as described in, for example, FIGS. 3 and 8 in Japanese Utility Model Laid-Open Publication No. Hei5-18342. The elevator mechanism is configured to be raised and lowered with stacked plurality of sheets P. The height of the main body sheet feeding tray 110 is controlled to have a sheet feeding position where the top most sheet of the stacked sheets P always contacts the main body sheet feeding roller 111 at a predetermined sheet feeding pressure (a pressure capable of feeding the sheet) by the above-mentioned elevator mechanism.

The elevator mechanism of the main body sheet feeding tray 110 is not limited to the above-mentioned configuration but, for example, the elevator mechanism, such as using a wire or the like as illustrated in FIG. 1 in Japanese Patent Laid-Open No. S59-124633 is also employed.

The main body sheet feeding roller 111 serves as a sheet feeding device of a main body sheet feeding section 104. The main body separation roller 112 and the main body separation pad 113 serve as a separation/sheet feeding device on a side of the main body housing 107. In addition, the sheet feeding device is not limited to the above-described configuration but a combination of the sheet feeding roller and the separation pad or the sheet feeding device composed of a pair of separation rollers is also included. In the friction-separation type sheet feeding device, such as the above-mentioned separation/sheet feeding device, namely, in a friction-pad type separation method, it is advantage that the sheet feeding device can be manufactured with simple configuration at low cost.

Figure 9A:
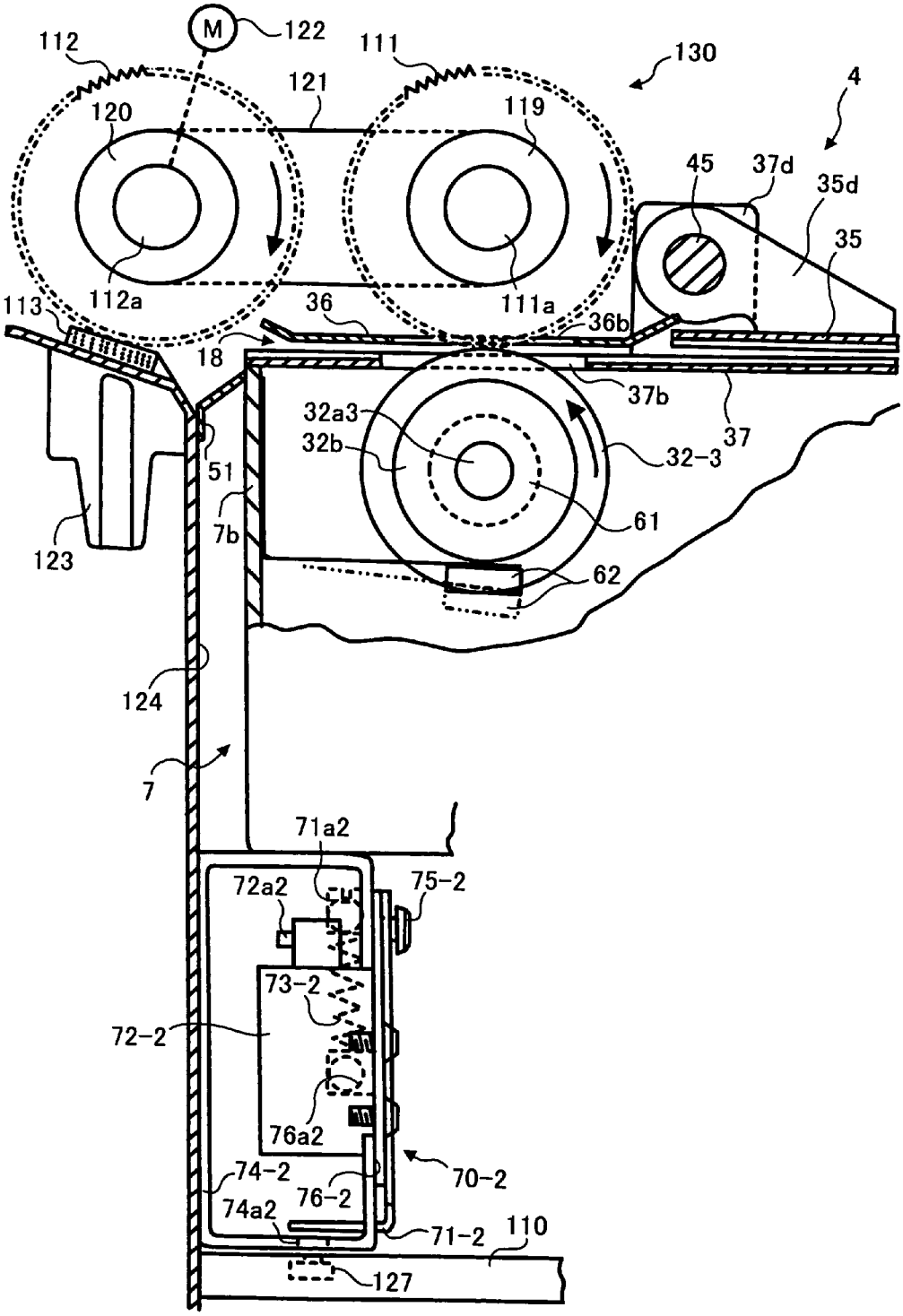
FIG. 9A and FIG. 9B are enlarged cross sections illustrating a main structure of a part of the intermediate conveying device at a state in which the mimeographic printing apparatus and a large capacity sheet feeding/conveying unit are connected.

The main body sheet feeding roller 111 is swingable and rotatable and is supported through a shaft 111*a* provided on a free end portion of a sheet feeding arm (not illustrated) which swings about a shaft 112*a* of the main body separation roller 112 at a sheet feeding side plate (not illustrated) on a side of the main body housing 107 of the sheet feeding inlet 125 of the main body sheet feeding section 104 (in FIG. 1), as illustrated in detail, in FIG. 9A. The sheet feeding arm has a U-shaped cross-section having a downward-faced opening. The main body sheet feeding roller 111 and the main body separation roller 112 are rotatably driven by a main body sheet feeding mechanism 130 illustrated in FIG. 9A, which is similar to, for example, the sheet feeding drive device (30), illustrated in FIGS. 1 through 3 in Japanese Patent Laid-Open Publication No. 2002-326732.

That is, as briefly illustrated in FIG. 9A, a one-way clutch (not illustrated) is embedded into the main body sheet feeding roller 111 and the shaft 111*a* thereof, and the main body separation roller 112 and the shaft 112*a* thereof, respectively. A timing pulley 119 is attached to the shaft 111*a* of the main body sheet feeding roller 111, and a timing pulley 120 is attached to the shaft 112*a* of the main body separation roller 112, respectively. A timing belt 121 is entrained about the timing pulley 119 and the timing pulley 120 and the main body separation roller 112 is in a driving engagement with the main body sheet feeding roller 111 through the timing belt 121 and each of the one-way clutches (not illustrated).

A rotation drive power is transmitted from the shaft 111*a* to the main body sheet feeding roller 111 and from the shaft 112*a* to the main body separation roller 112, respectively, via each of the one-way clutches in a case when both of the main body separation roller 112 and the main body sheet feeding roller 111 are rotated in clockwise direction as indicated by curved arrows in FIG. 9A, so that the sheet P is fed and separated. Thus, both of the main body separation roller 112 and the main body sheet feeding roller 111 are set to be rotatably driven in only the clockwise direction. The main body separation roller 112 is rotatably driven by a sheet feeding motor 122 as a main body sheet feeding driving device.

The shaft 112*a* of the main body separation roller 112 is in a driving engagement with an output shaft (not illustrated) of the sheet feeding motor 122 through each of the timing pulleys (not illustrated) and the timing belts (not illustrated) entrained around each of the timing pulleys. The sheet feeding motor 122 is a stepping motor. Accordingly, when the sheet is fed, both of the main body separation roller 112 and the main body sheet feeding roller 111 are rotated in the clockwise direction by the sheet feeding motor 122 rotating in a forward direction, for example. The top most sheet (not illustrated) stacked on the main body sheet feeding tray 110 or the sheet P that is fed from the large capacity sheet feeding/conveying unit 1 is delivered toward the registration rollers pair 114, illustrated in FIG. 1.

On the other hand, a sheet feeding feeler (a so-called light interrupting plate, not illustrated) is mounted on the aforementioned sheet feeding arm. A height sensor 126 (illustrated in FIG. 2) formed of a transmission photo sensor (hereinafter referred to as a transmission type sensor, simply) which is provided with a light emitting element and a light accepting element for detecting a proper sheet feeding position, and which is configured to selectively put the free end portion of the sheet feeding feeler between the light emitting element and the light accepting element is mounted on a secured member (not illustrated) disposed at a position of the main body housing 107 side, and adjacent to the aforementioned sheet feeding feeler.

In FIG. 9A, numeral 123 denotes a separation pad holder that accommodates a pressure spring as an energizing member for energizing the main body separation pad 113 toward a circumferential surface of the main body separation roller 112 and is movably configured, and numeral 124 denotes a front face plate for aligning the tip end of the sheets (not illustrated) to be stacked on the main body sheet feeding tray 110, respectively.

The printing section 102 is arranged approximately the center of the main body housing 107, and includes an ink feeding device therein, the printing drum 115 around which a reproduced heat-sensitive mimeographic master will be entrained, and a pressure roller 116, as a pressing device that presses the sheet P that is fed from the main body sheet feeding section 104 or from the large capacity sheet feeding/conveying unit 1, on the circumferential surface of the printing drum 115, or the like.

As for the pressing device, for example, as described in FIG. 1 in Japanese Patent Laid-Open Publication No. 2000-141856, a pressure drum having a circumferential surface whose outer diameter is approximately the same as that of the printing drum 115 and rotates in synchronism with the printing drum 115, and is provided with a clamper (sheet holding device) at a circumferential portion of the printing drum to hold a tip end of a sheet is used.

As for the printing drum 115, for example, as described in the aforementioned Japanese Patent Laid-Open Publication No. 2000-141856, the printing speed of the mimeographic printing apparatus 100 is configured to be from a master-mounting speed (for example, 16 sheets/min: 16 rpm) to a plurality of printing speeds of a regular printing operation, namely, five steps of printing speeds, for example, 60, 75, 90, 105, and 120 sheets/min: 60, 75, 90, 105, and 120 rpm, in the first embodiment of the present invention. In this example, 210 sheets/min: 120 rpm is the top printing speed of the mimeographic printing apparatus 100.

The printing drum 115 is rotatably driven by a known printing drum driving mechanism, that serves as a driving device provided with a main motor formed of a DC motor (both of which are not illustrated) that is, for example, similar to the printing drum driving mechanism as is described in FIG. 3 in Japanese Patent Laid-Open Publication No. 2002-36511 proposed by the present applicant.

On the other hand, an operation panel (not illustrated) is provided at an upper part of the image reading section 101 illustrated in FIG. 1. The operation panel is configured to operate the mimeographic printing apparatus 100 to execute desired operation by giving instructions to the aforementioned each of the devices and sections, or to confirm and recognize a condition of the aforementioned each of the devices and sections. There are several keys arranged in the aforementioned operation panel. That is, a plate making start key that generates a start signal to start each of the operations in a procedure from image reading operation for the original document to the plate feeding operation a ten-key to set/input a number of printing sheets. In addition to the above, below-mentioned keys and displays are arranged in the operation panel.

That is, a print start key to generate a print start signal to cause the mimeographic printing apparatus 100 to execute the printing operation for the number of printing sheets that is set or input by the ten-key, a printing speed setting key including a slowdown key and a speedup key, which serves as a printing speed setting device to rotate the printing drum 115 by setting a printing speed selecting among the five steps of the printing speeds (a first speed to a fifth speed), a speed indicator composed of a group of LED (Light Emitting Diode) lamps to indicate the printing speed that is set with the slowdown key or the speedup key, and an LCD (Liquid Crystal Display) to indicate (at any time) setting/detecting information in each of operation in the procedure from an image reading operation to the printing operation. Illustrations of each of the keys and displays are omitted, however the configuration of the operation panel is approximately the same as the operation panel (90) described in the aforementioned Japanese Patent Laid-Open Publication No. 2000-141856.

The sheet discharging section 106 is arranged at the left side of the main body housing 107, as illustrated in FIG. 1, and several exfoliation picks 117 to exfoliate the printed sheet from a circumferential surface of the printing drum 115, and a suction conveyer unit 118 to discharge the exfoliated sheet with suction through a sheet discharging opening (not illustrated) of the main body housing 107 to the large capacity sheet discharging/storing unit 200 located outside of the mimeographic printing apparatus 100.

The large capacity discharging/storing unit 200 has substantially the same configuration as the sheet discharging/storing apparatus (1) illustrated in FIGS. 1 through 9, in Japanese Patent Laid-Open Publication No. 2002-226122, which is proposed by the inventor(s) of the present application, and the operation thereof is also substantially the same to the sheet discharging/storing apparatus (1).

In comparison with the sheet discharging/storing apparatus (1), the large capacity sheet discharging/storing unit 200 has no practical difference other than that the large capacity sheet discharging/storing unit 200 has a single large capacity sheet discharging tray 201 while the sheet discharging/storing apparatus (1) has a first sheet discharging tray (23) and a second sheet discharging tray (24), instead. Therefore, the explanation for the details of the configuration and operation of the large capacity sheet discharging/storing unit 200 will be omitted.

In FIG. 1, numeral 202 denotes a pair of side fences that are disposed at right and left sides along a sheet discharging direction for aligning a position in a widthwise direction (both side end faces of the sheet that has been discharged), of the sheets that has been discharged and numeral 203 denotes an end fence for aligning the tip end of the sheets that has been discharged by knocking the tip end of the sheet, respectively.

The large capacity sheet discharging tray 201 is a known sheet discharging tray having a similar configuration to the first sheet discharging tray (23) and a second sheet discharging tray (24) disclosed in the above-mentioned Japanese Patent Laid-Open Publication No. 2002-226122 in which the large capacity sheet discharging tray 201 is movably (capable of rising up or lowering down) supported by the sheet discharging unit housing 204 via a moving member (not illustrated). Further, of course the large capacity sheet discharging/storing unit 200 is not limited to have the thus explained configuration but may have the configuration identical to the sheet discharging/storing apparatus (1) illustrated in FIGS. 1 through 9, in Japanese Patent Laid-Open Publication No. 2002-226122.

The large capacity sheet discharging/storing unit 200 is configured to be movable between a discharging/connecting position at which the sheet discharging/storing unit 200 is connected to a sheet discharging opening (not illustrated) of the sheet discharging section 106 of the mimeographic printing apparatus 100 and a non-discharging/connecting position via a plurality of casters 205.

The large capacity sheet feeding/conveying unit 1 includes the intermediate conveying unit 4 that serves as the intermediate conveying device and a large capacity sheet feeding unit 5 that serves as a large capacity sheet feeding apparatus. The large capacity sheet feeding unit 5 further includes the sheet stacking section 2 capable of stacking a large number of sheets P, the sheet feeding mechanism 3 to pick up and feed the sheet P one by one, which is stacked in the sheet stacking section 2, and aforementioned main body housing 6.

The intermediate conveying unit 4 is provided with a function and a structure to convey a sheet that is fed from the sheet feeding section 3 to a position in the vicinity of the sheet feeding inlet 125 where the main body sheet feeding roller 111 of the main body sheet feeding section 104 faces. The large capacity sheet feeding unit 5 is mounted on a basement 8 having several casters 9, and the basement 8 is fixed to a lower part of the main body housing 6.

Hereinafter, the stacking section 2, the sheet feeding mechanism 3, and the intermediate conveying unit 4 will now be described in detail. To simplify an explanation for a disposition of the elements for each of the aforementioned configuration, the front side of the sheet surface seeing along the direction X sometimes called "left" or "operating side" and the rear side of the sheet surface sometimes called "right" or "non-operating side". In addition, in a same meaning, a downstream side of the sheet conveying direction X sometimes called "front", and an upstream side of the sheet conveying direction X sometimes called "rear". A pair of supplemental side plates 29 is mounted on both of left side and right side of the main body housing 6 illustrated in FIG. 1.

The stacking section 2 is provided with a large capacity sheet feeding tray 10 capable of rising and lowering with the large number of stacked sheets P, and a pair of right and left side fences 15 and 16 that jog both side ends of the sheet P, as sheet width alignment member (in FIG. 4), a sheet feeding tray raising/lowering mechanism 25 that serves as a sheet feeding tray raising/lowering device to raise and lower the large capacity sheet feeding tray 10, a height sensor 26 as an upper limit detecting device that serves as a sheet feeding position detecting device detecting that the large capacity sheet feeding tray 10 reaches an upper limit position or that a sheet feeding roller 11 reaches a sheet feeding position, and a lower limit sensor 27 that serves as an upper limit detecting device for detecting a lower limit of the large capacity sheet feeding tray 10.

The height sensor 26 and the lower limit sensor 27 are both transmission type sensors. The height sensor 26 and the lower limit sensor 27 are disposed at a predetermined position in the main body housing 6, respectively.

The large capacity sheet feeding tray 10 has a structure capable of rising and lowering with the stacked sheets, for example, at least 3000 sheets of plain paper of A3 size, and four rectangular openings 10*a* to allow each of the side fences, 15 and 16 to move in a direction Y as illustrated in FIG. 6. Inside of the large capacity sheet feeding tray 10, a sheet existence sensor 66 (in FIG. 13) that serves as a sheet existence detecting device for detecting whether the sheet P exists on the large capacity sheet feeding tray 10 is provided. Further, the sheet existence sensor 66 is a reflection type sensor.

Figure 4:
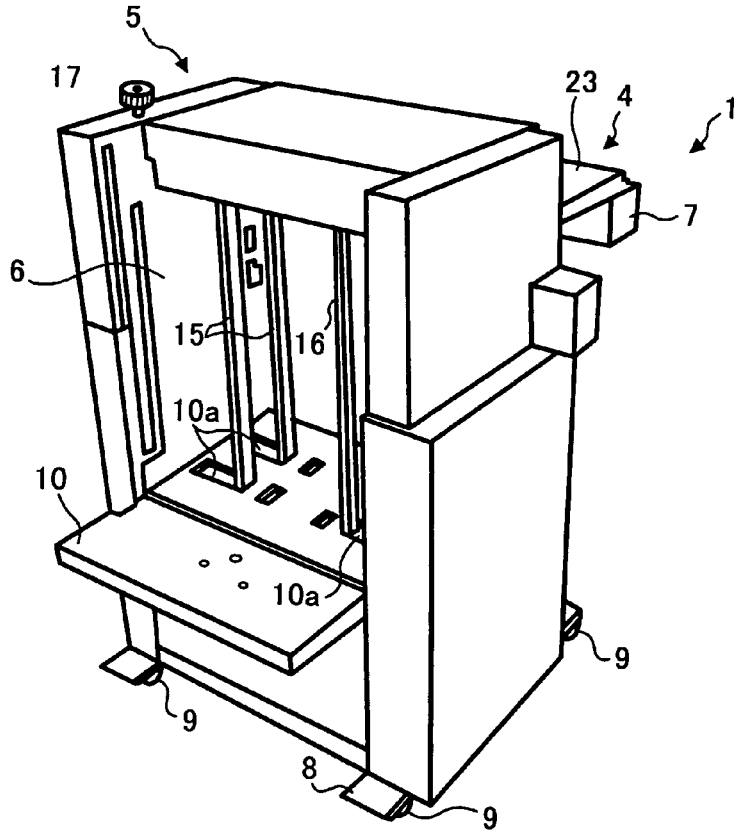
FIG. 4 is a perspective view seeing from the rear illustrating a large capacity sheet feeding/conveying unit of FIG. 3.

Each of the side fences, 15 and 16 has a hollow rectangular column shape and provided at front and rear positions in the sheet conveying direction X and right and left positions in the sheet width direction Y. The two of the side fences, 15 and 16 are provided at each of the front and rear positions, as illustrated in FIG. 4. Each of centers of the side fences, 15 and 16 can be aligned by moving the each of the side fences, 15 and 16 in the sheet width direction Y by rotatably operating a side fence operation handle 17, through a side fence center alignment mechanism (not illustrated), two pairs of which are disposed at upper and lower part of the main body housing 6.

Figure 7:
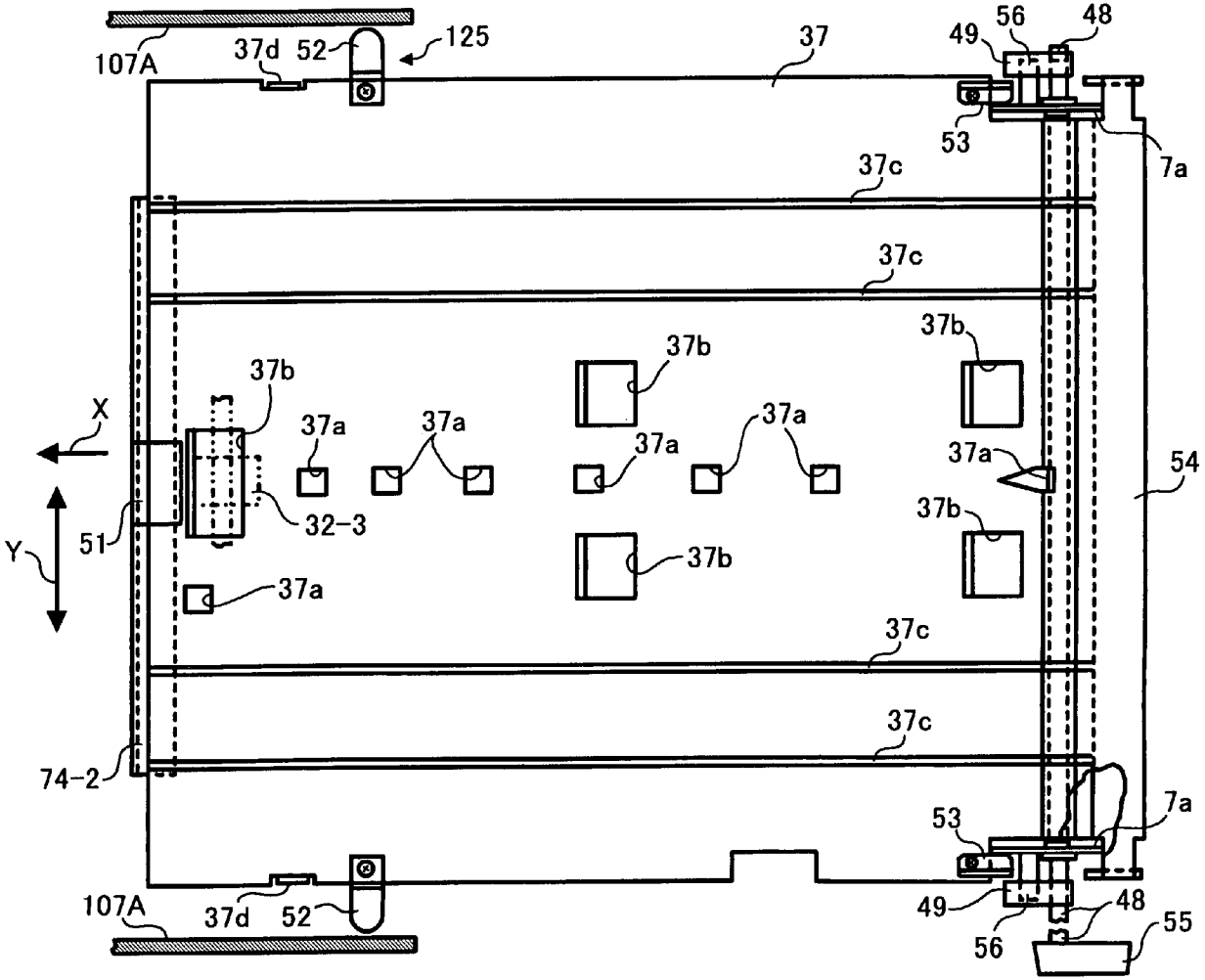
FIG. 7 is a top plan view illustrating a main structure and vicinity of a lower guide plate at a state in which the upper cover, the upper guide plate, and each of conveying rollers are removed.

The sheet feeding tray raising/lowering mechanism 25 has a basic structure that is substantially the same as a tray raising/lowering mechanism (25) and a moving member (57) in a sheet discharging/storing apparatus (1) that are illustrated in FIGS. 7 and 8 and are described in paragraph Nos. [0024] to [0026] in the aforementioned Japanese Patent Laid-Open Publication No. 2002-226122. In addition, the large capacity sheet feeding tray 10 is configured to be raised and lowered keeping the posture thereof level. The sheet feeding tray raising/lowering mechanism 25 has a known structure as mentioned above and is not a main theme of the present invention.

Accordingly, to avoid a repetition of explanation, detailed explanation for the sheet feeding tray raising/lowering mechanism 25 will be omitted, and only a raising/lowering motor 28, briefly illustrated in FIG. 1, which is a reversible motor, as a driving device for driving the large capacity sheet feeding tray 10 in the raising and lowering direction is given in the first embodiment of the present invention. The large capacity sheet feeding tray 10 is configured to reach a sheet feeding position where the topmost sheet stacked on the large capacity sheet feeding tray 10 always contacts the sheet feeding roller 11 at a predetermined pressure (a pressure by which a sheet can be fed and conveyed) via the sheet feeding tray raising/lowering mechanism 25 by a controlling device that is described later.

The sheet feeding mechanism 3 is disposed around the pair of supplemental side plates 29, which is located at a position higher than the stacking section 2. Further, the sheet feeding mechanism 3 has the similar function and configuration of the main body sheet feeding mechanism 130 that is provided with the sheet feeding device, the separation/sheet feeding device, and the sheet feeding driving device of the main body sheet feeding section 104, as described above.

Accordingly, the explanation for the main body sheet feeding mechanism 130 can be substituted for the explanation for each of the element of the sheet feeding mechanism 3 by subtracting 100 from the reference numerals of the elements of the main body sheet feeding mechanism 130 to avoid repetition of the same explanation. A separation roller 12 and a sheet feeding roller 11 are rotated by a sheet feeding motor 22 composed of a stepping motor that serves as a driving device for sheet feeding operation. The sheet feeding motor 22, a transmission device for drive force, and the like are located at an outer wall surface of the supplemental side plates 29 of the rear side of a paper surface of this specification.

Figure 5:
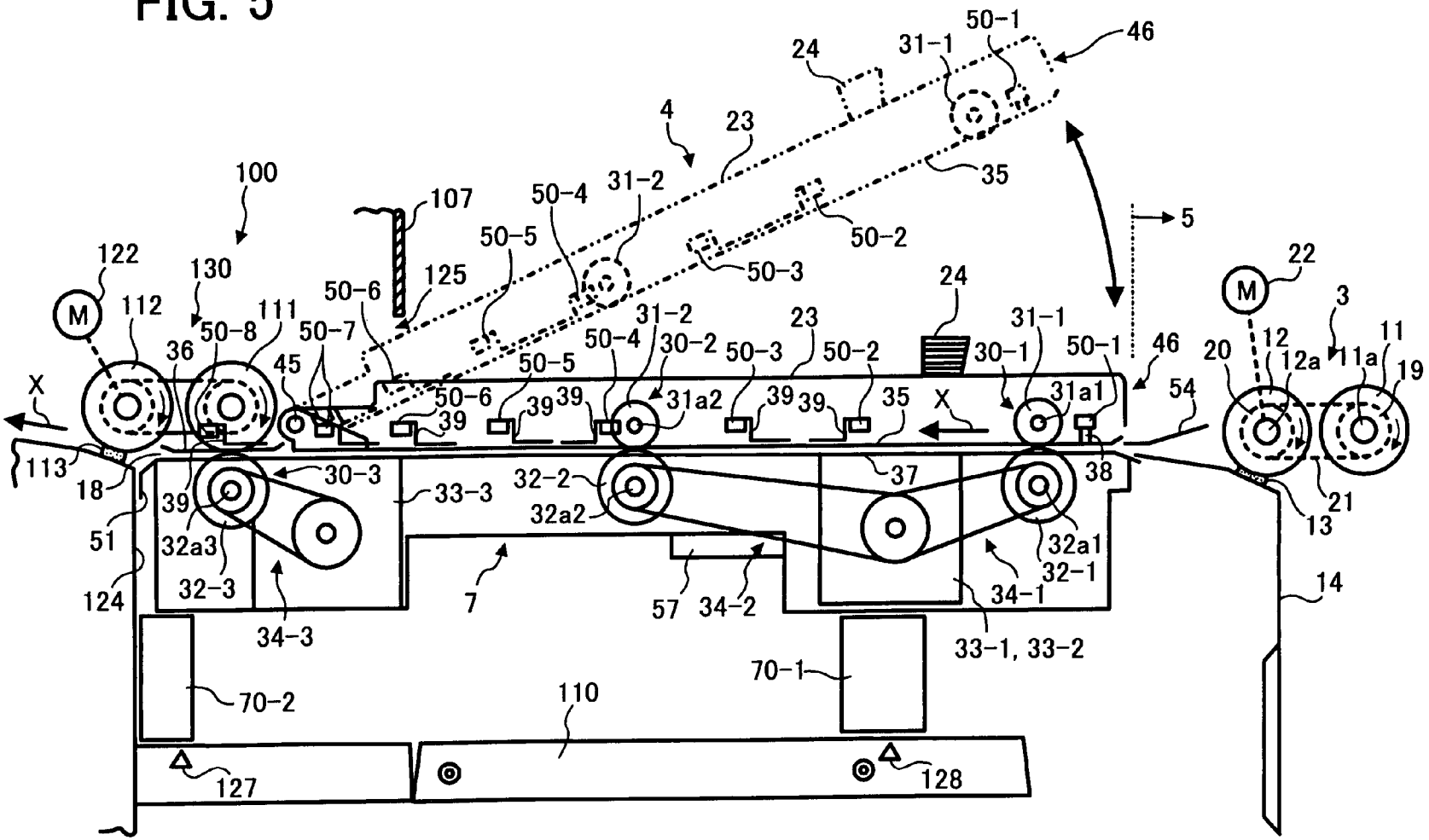
FIG. 5 is an elevation illustrating a main structure and vicinity of an intermediate conveying device at a connected position of the mimeographic printing apparatus and the large capacity sheet discharging/storing unit, and an open/close state of an upper guide unit including an upper guide plate.

A sheet feeding feeler (not illustrated) is attached to a sheet feeding arm (not illustrated) that is rotatably supporting the sheet feeding roller 11 and the separation roller 12. The height sensor 26 is configured to The height sensor 26 is fixed to a secured member (not illustrated) arranged on a side of the main body housing 6, and located adjacent to the aforementioned sheet feeding feeler, such that the free end portion of the sheet feeding feeler is selectively positioned in between the height sensor 26. In FIGS. 1, 2, and 5, a numeral 14 denotes a face plate to knock and align a tip end of the sheet P that is stacked on the large capacity sheet feeding tray 10. The face plate 14 is fixed to the supplemental side plate 29 with a screw or the like.

The large capacity sheet feeding apparatus may be applied to, for example, a sheet feeding apparatus (100) as a large capacity sheet feeding unit proposed by the applicant of the present invention, disclosed in Japanese Patent Laid-Open Publication No. Hei8-259008 or Hei8-259009. That is, the large capacity sheet feeding apparatus may also be a large capacity sheet-feeding unit having a structure capable of raising or lowering with an LCT (Large Capacity Table) mounted, or capable of feeding the sheet by providing a sheet feeding device or a sheet separating/feeding device.

Next, an intermediate conveying unit 4 having a characteristic of the present invention will now be described.

In FIGS. 1, 5, 9A, and 10, numeral 18 denotes an intermediate sheet conveying path for conveying the sheet P that is fed from the sheet feeding mechanism 3 toward the sheet feeding inlet of the mimeographic printing apparatus 100. The intermediate conveying unit 4 is detachably attached to the supplemental side plate 29 of the main body housing 6.

The intermediate conveying unit 4 is provided with a plurality of sheet conveying devices (three devices in the first embodiment of the present invention), i.e., a first sheet conveying device 30-1, a second sheet conveying device 30-2, and a third sheet conveying device 30-3 for conveying the sheet P that is fed from the sheet feeding mechanism 3, as illustrated in FIG. 5, etc. Further, the intermediate conveying unit 4 is provided with a plurality of sheet conveying motors (three motors in the first embodiment of the present invention), i.e., a first motor 33-1, a second motor 33-2, and a third motor 33-3, each of which are independently configured to drive a first sheet conveying device 30-1 to a third sheet conveying device 30-3, respectively. Furthermore, the intermediate conveying unit 4 is provided with a first drive force transmitting device 34-1, a second drive force transmitting device 34-2, and a third drive force transmitting device 34-3 for transmitting a rotation drive force from each of first to third motors, 33-1 to 33-3, respectively.

Further, the intermediate conveying unit 4 is provided with an upper guide member and a lower guide member (described later) that serve as a pair of guiding devices to guide the sheet P to a position in the vicinity of the sheet feeding inlet 125 on a side of the mimeographic printing apparatus 100 by the first to the third-sheet conveying devices, 30-1 to 30-3, respectively.

Furthermore, the intermediate conveying unit 4 is also provided with a housing 7 that accommodates the first to the third sheet conveying devices, 30-1 to 30-3, and the pair of aforementioned guiding devices, eight sensors of a first sensor 50-1 to an eighth sensor 50-8 as a sheet detecting device that detects at least one of a leading edge and a trailing edge of a sheet P (in the first embodiment, not at least one of, but both of the leading edge and the trailing edge of the sheet P), a plurality of which are arranged on the upper guide member at predetermined intervals from an upstream to a downstream of an intermediate sheet conveying path 18.

Figure 12:
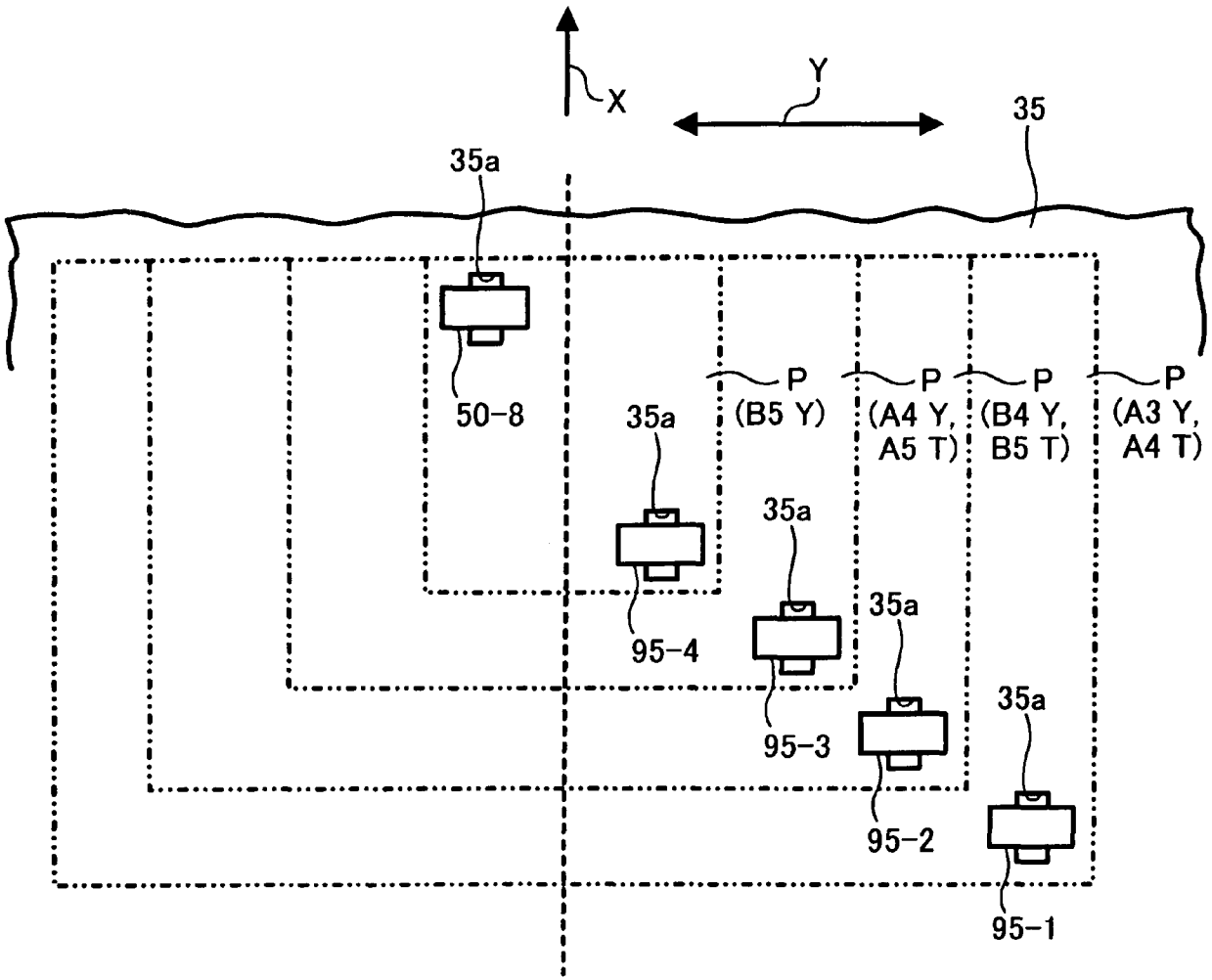
FIG. 12 is a top plan view explaining a sheet width detection device and each of sheet widths at the intermediate conveying device.

Further, the intermediate conveying unit 4 is provided with four sensors, including a first to a fourth sheet width sensors, 95-1 to 95-4, as a sheet width detecting sensor that detects a size of the sheet width of the conveyed sheet P that are illustrated in a two-dot-and-a-dash line, a plurality of which are arranged at predetermined intervals along the sheet width direction Y orthogonal to the intermediate sheet conveying path 18, as illustrated in FIG. 12.

The first sheet conveying device 30-1 is composed of a first conveying roller 32-1 and a first pressure roller 31-1 contacting each other with pressure. The second conveying device 30-2 is composed of a second conveying roller 32-2 and a second pressure roller 31-2 contacting each other with pressure. Likewise, the third sheet conveying device 30-3 is composed of a third conveying roller 32-3. The first to the third sheet conveying devices, 30-1 to 30-3 are arranged along the intermediate sheet conveying path 18 from the upstream to the downstream thereof in this order at a predetermined interval.

At least a circumferential surface of a circumferential portion of the first pressure roller 31-1 is made of resin. Further, at least a circumferential surface of a circumferential portion of the first conveying roller 32-1 is made of rubber or the like proper material having a high coefficient of friction against the sheet P for use in the large capacity sheet feeding/conveying unit 1. In a manner as described above, other rollers, such as the second pressure roller 31-2, the second conveying roller 32-2, and the third conveying roller 32-3 have the same configuration.

The first sheet conveying device 30-1 and the second sheet conveying device 30-2 are composed of almost the same elements and are standardized. Both of the first sheet conveying device 30-1 and the second sheet conveying device 30-2 are arranged at positions different to each other, however, the elements thereof are almost the same and standardized. Accordingly, other than the explanation for the arrangement of the first and second conveying devices, 30-1 and 30-2, a detailed description of one-part may also be applied to another part. When the aforementioned structure, etc., is explained, the numeral that comes after a hyphen indicates an order from the upstream to the downstream of the intermediate sheet conveying path 18 in which elements are arranged, and further, the ordinal numerals, first to third may be omitted.

In a manner as described above, the first to the third motors, 33-1 to 33-3 are arranged at positions different to each other, however, the elements thereof are almost the same and standardized. Accordingly, other than the explanation for the arrangement of the first to the third motors, 33-1 to 33-3, a detailed description of one part may also be applied to another part. As for the first sensor 50-1 to the eighth sensor 50-8, and the first sheet width sensor 95-1 to the fourth sheet width sensor 95-4, the same manner is applied for the description.

First, the housing 7 will be explained. As illustrated in FIGS. 1, 2, 3 and 8, the housing 7 serves as a frame of the intermediate conveying unit 4 and has an H shape seeing from a top, and is formed of approximately a box shape having an opening at an upper side. The housing 7 is formed in a body with a sheet metal whose surface is properly processed. In FIG. 8, numeral 7*a* denotes a rear side wall of the housing 7, numeral 7*b* denotes a front face wall of the housing 7, and numeral 7*c* denotes a bottom wall of the housing 7, respectively. The bottom wall 7*c* is formed of a stepwise shape, seeing from a front side, as illustrated in FIGS. 5 and 8. In FIG. 5, numeral 57 denotes a belt cover. The belt cover 57 protects exposed timing belt of the second drive force transmitting device 34-2. A structure around the aforementioned a pair of guide member will be described referring to FIGS. 5, 6, 9A, and 10.

As illustrated in FIG. 5, the pair of guide members is formed of an upper guide plate 35 as an upper guide member that serves as an upper guiding member and a supplemental upper guide plate 36 and a lower guide plate 37 that serves as a lower guide member facing both of the upper guide plate 35 and the supplemental upper guide plate 36. The upper guide plate 35, the supplemental upper guide plate 36, and the lower guide plate 37 are formed in a body with a sheet metal whose surface is properly processed. Further, a space surrounded by the upper guide plate 35 forms the intermediate sheet conveying path 18.

As illustrated in FIGS. 5, 6, and 9A, a pivoting portion 35*d* that is cut and bent upward is formed in a body at both ends of a front end portion of the upper guide plate 35. The pivoting portions 35*d* are penetrated by a shaft 45 illustrated with a two-dot-and-a-dash line in FIG. 6 together with a bearing portion 37*d* formed in a body at both ends of the front end portion of the lower guide plate 37 illustrated in FIG. 7 and are stopped with stopping rings. Therefore, a base end portion of the upper guide plate 35 is supported in a manner as being rotatable at an angle of predetermined degrees around the shaft 45, namely, a free end portion of the shaft 45 is swingable relative to the lower guide plate 37, and free to open and close.

On the other hand, as illustrated in FIG. 6, at both ends of a rear end portion of the upper guide plate 35, cut-and-bent portions 35*e* that are cut and bent upward are formed in a body. At each of the cut-and-bent portions 35*e*, a fixing shaft 47 protruding outward is fixed respectively. Each of the fixing shafts 47 is selectively engaged and fixed and locked by a swinging motion of a open/close cam 49 (illustrated in FIG. 6 with a two-dot-and-a-dash line) that is fixed on a penetrating shaft 48 for fixing the upper guide plate that are rotatably provided at an angle of predetermined degree to both of right and left ends of the rear side wall 7*a* of the housing 7, as illustrated in FIGS. 7 and 8. In FIG. 7, numeral 51 denotes a slanting member formed of sheet metal, for example, that is fixed on a front end portion of the lower guide plate 37.

Figure 10:
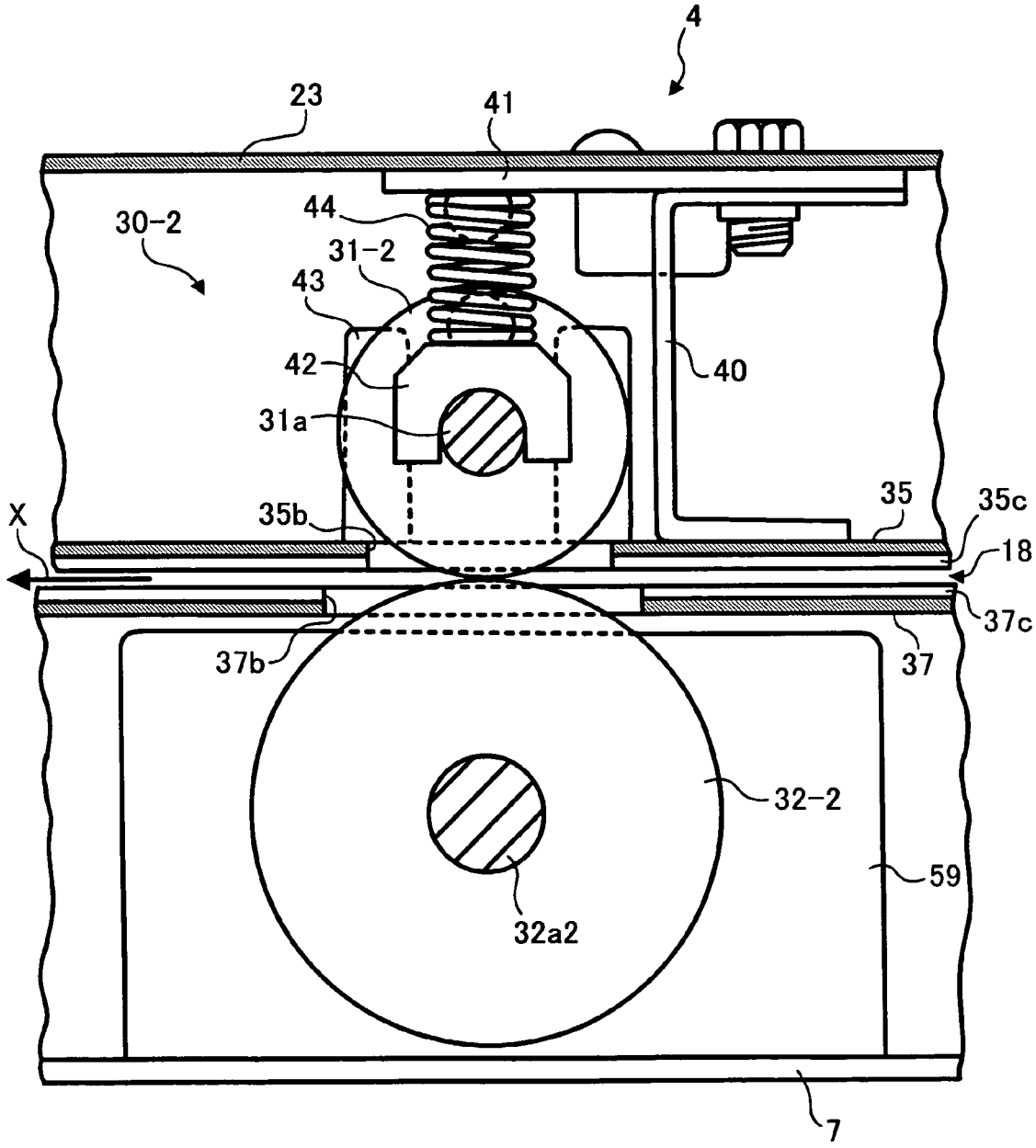
FIG. 10 is an enlarged cross section illustrating a pressing state of a second pressure roller and a second conveying roller in the intermediate conveying device.

In FIGS. 6, 9A, and 10, numeral 35*c* denotes a reinforcement rib having a down facing convex shape. A proper number of the reinforcement ribs 35*c* are formed around the center part of the upper guide plate 35, other than that illustrated in FIGS. 6, 9A, and 10.

As illustrated in FIGS. 5 and 6, on the upper guide plate 35, the first sensor 50-1 is fixed via the sensor attaching member 38, and a second sensor 50-2 to a seventh sensor 50-7 are fixed with a screw or the like (not illustrated) fixing device, via the sensor attaching member 39. In FIGS. 5 and 6, illustrations of the first sheet width sensor 95-1 to the fourth sheet width sensor are omitted and the first sheet width sensor 95-1 to the fourth sheet width sensor 95-4 are illustrated together with the first sensor 50-8, as illustrated in FIG. 12. In addition, in FIG. 6, illustration for each of the sensor attaching member 38 and 39 are omitted.

The first sensor 50-1 to the eighth sensor 50-8 is formed of the reflection type sensor. In order to transmit projection light and reflection light from each of the first sensor 50-1 to the seventh sensor 50-7, seven openings 35*a* are formed in the upper guide plate 35, corresponding to the first sensor 50-1 to the seventh sensor 50-7, respectively.

Each of the first to the fourth sheet width sensors, 95-1 to 95-4 are also formed of the reflection type sensor. In order to transmit projection light and reflection light from each of the first to the fourth sheet width sensors, 95-1 to 95-4, four openings 35*a* are formed in the upper guide plate 35, corresponding to the first sheet width sensor 95-1 to the fourth sheet width sensor 95-4, respectively.

In order to protrude a part of each of the circumferential portion of the first pressure roller 31-1 and the second pressure roller 31-2, an opening 35*b* is formed at each of front and rear, and right and left on the upper guide plate 35, as illustrated in FIGS. 6 and 10.

The eighth sensor 50-8 is fixed to the supplemental upper guide plate 36 with a tightening device, such as a screw or the like (not illustrated) via the sensor attaching member 38. Also, an opening (not illustrated) similar to the above-mentioned opening 35*a* is formed on the supplemental upper guide plate 36 such that projection light and reflection light from the eighth sensor 50-8 is transmitted. Both ends of front and rear part of the supplemental upper guide plate 36 are slantingly bent upward, as illustrated in FIGS. 5, 6, and 9A.

As illustrated in FIG. 9A, an opening 36*b* is formed at a center part of an end of downstream of the intermediate sheet conveying path 18 of the supplemental upper guide plate 36 such that a part of the circumferential portion of the main body sheet feeding roller 111 protrudes therethrough, when the large capacity sheet feeding/conveying unit 1 is positioned at the connected position of FIG. 1. Adjacent to the space beneath the opening 36*b*, a part of circumferential portion of the third conveying roller 32-3 is exposed, as illustrated in FIG. 5.

The upper guide plate 35 is attached to an upper cover 23 that is disposed above the upper guide plate 35 substantially in a body via a supporting member 40 illustrated in FIG. 10. Hereinafter, an assembly of the upper cover 23 and the upper guide plate 35 is sometimes called an upper guide unit 46. Only one of the supporting members 40 is illustrated in FIG. 10, however, another supporting member 40 is disposed in the vicinity of a first pressure roller 31-1, and assembles the upper guide plate 35 and the upper covey 23. The upper cover 23 is formed in a body with, for example, a sheet metal whose surface is properly processed.

As the configuration described above, a free end of the upper guide unit 46 that is closer to the large capacity sheet feeding unit 5 is configured to be swingable about the shaft 45, relative to the lower guide plate 37. That is, the upper guide unit 46 including the upper guide plate 35 is configured to be capable of opening and closing between a closed position indicated by a solid line in FIG. 5 and an open position indicated by a two-dot-and-a-dash line in FIG. 5.

At an upper face of the upper cover 23 that is close to the large capacity sheet feeding unit 5 (sheet feeding mechanism 3), a handle 24 for opening and closing the upper guide unit 46 relative to the lower guide plate 37 is attached. The handle 24 enables an operator to easily remove a jammed sheet when a sheet jamming occurred in the intermediate sheet conveying unit 4, because the upper guide unit 46 including the upper cover 23 with assembled upper guide plate 35, can be opened by using the handle 24. In addition, because the upper cover 23 together with the upper guide plate 35 can be opened to clean each of the pressure rollers 31-1 and 31-2, and each of the first conveying roller 32-1 to the third conveying roller 32-3, a capability of maintenance is preferable. Further, a paper powder and stain stuck to a sensor surface of each of the sensors, 50-1 to 50-7 formed of a reflection type photo sensor are thereby easily removed.

Furthermore, by locating a shaft 45, as a swinging fulcrum, on a side of the mimeographic printing apparatus 100, removing operation for the jammed sheet can safely be executed with enough space to insert a hand. On the contrary, when the shaft 45 is located on a side of the large capacity sheet feeding unit 5, the main body housing 107 may disturb to insert the hand from the side of the mimeographic printing apparatus 100 for removing the jammed sheet.

A pair of the first pressure roller 31-1 is formed with a shaft 31*a*1 thereof in a body, and are disposed at a symmetric positional relationship on both end portions, right and left as illustrated in FIG. 6. The same is true to the second pressure roller 31-2. Both of the first pressure roller 31-1 and the second pressure roller 31-2 have a supporting structure illustrated in FIGS. 6 and 10 (The structure is similar, though the illustration of the first pressure roller 31-1 is omitted.), and is rotatably supported between the upper cover 23 and the upper guide plate 35. Further, both of the first pressure roller 31-1 and the second pressure roller 31-2 are disposed at a place where a part of the circumferential portion thereof faces the sheet conveying path 18 by protruding from the opening 35*b* of the upper guide plate 35.

The aforementioned supporting structure is mainly composed of a pair of right and left spring guides 42 that rotatably supports the shaft 31*a*2 of a pair of the second pressure rollers 31-2, a pair of right and left upper and lower guiding member 43 that movably guide each of the spring guides 42, and which is fixed to the upper guide plate 35 by welding, a spring fixing member 41 fixed to the supporting member 40 by a screw, in a state of covering a pair of the spring guides 42, a pair of pressure springs 44 attached between a convex portion formed upward in a body on each of the spring guides 42 and a convex portion formed downward in a body on each of the spring fixing members 41.

As for the spring guide 42, material with less sliding resistance and with good abrasion resistance is properly selected such that the shaft 31*a*2 is rotatably supported. The pressure spring 44 has a function as being an energizing member to energize a circumferential surface of the second pressure roller 31-2 in a direction for pressing/contacting toward a circumferential surface of the second conveying roller 32-2 that protrudes from the lower guide plate 37. The same is true to a pair of the first pressure rollers 31-1.

Without being limited to the first embodiment of the present invention, for example, below described upside down manner may be employed. That is, each of the pressure rollers may be located on a side of the lower guide member, each of the conveying rollers may be located on a side of the aforementioned upper guide member, respectively, and the energizing member (for example, aforementioned pressure spring) to energize each of the pressure rollers in a direction for pressing/contacting each of the conveying rollers may be arranged on a side of the lower guide member.

Next, a configuration around the lower guide plate 37 and the housing 7 is explained referring to FIGS. 5, 7, 9A, and 10.

The lower guide plate 37 is fixed at an upper part of the box shaped housing 7 having an opening at the top with a tightening device such as a screw or the like (not illustrated) On the lower guide plate 37, eight openings 37*a* are formed at lower portions corresponding to seven openings 35*a* formed in the upper guide plate 35. These eight openings 37*a* are configured to transmit each of projection lights corresponding to each of the first sensor 50-1 to the eight sensor 50-8 mounted on the upper guide plate 35.

Further, the same openings as the opening 37*a* for transmitting each of the projection lights corresponding to four of the first sheet width sensor 95-1 to the fourth sheet width sensor 95-4 mounted on the upper guide plate 35 are formed in the lower guide plate 37, however, the aforementioned openings are not illustrated.

As illustrated in FIGS. 7, 9A, and 10, in the lower guide plate 37, openings 37*b* for protruding a part of each of the circumferential portions of the first conveying roller 32-1 and the second conveying roller 32-2 are formed at positions, front and rear, and right and left of a rear end side thereof. Further, at a center part of a front end portion of the lower guide plate 37, the opening 37*b* is formed to protrude a part of a circumferential portion of the third conveying roller 32-3.

As illustrated in FIG. 7, at a front end part of the lower guide plate 37, the slanting member 51 whose front end side portion is slanting downward is fixed. The slanting member 51 is configured to swing the sheet feeding feeler (not illustrated) in a direction for engaging with the height sensor 126 through a swinging operation of the aforementioned sheet feeding arm (not illustrated), by smoothly contacting the main body sheet feeding roller 111 and a roller on a bottom end of the aforementioned sheet feeding feeler, when the large capacity sheet feeding/conveying unit 1 moves in the sheet conveying direction X to reach the connected position illustrated in FIG. 1.

At each of right and left end portion close to a front end of the lower guide plate 37, both of positioning members 52 are fixed with screws, respectively. Each of the positioning members 52 are configured to position the large capacity sheet feeding/conveying unit 1 along the sheet width direction Y relative to a pair of right and left sheet feeding side plates 107A that are fixed to the main body housing 107.

At both of right and left ends near a rear end portion of the lower guide plate 37, both of contacting members 53 having a predetermined thickness are fixed with screws, respectively. The contacting member 53 is configured to form the stable intermediate sheet conveying path 18 by keeping a constant clearance between a lower face of the upper guide plate 35 and an upper face of the lower guide plate 37 (for example, for securing a sheet height of 1.2 mm), when the upper guide unit 46 including the upper cover 23 and the upper guide plate 35 has a closed position.

As illustrated in FIG. 7, at a rear side (right in FIG. 7) of the lower guide plate 37, each of a part of rear side walls 7*a* of the housing 7 is illustrated. At an upper part of both of right and left of the rear side walls 7*a*, a penetrating shaft 48, a part of which is explained above, is rotatably supported via a bearing member. At both of right and left ends, the open and close cams 49 having the same phase are respectively fixed. In addition, at a left side of the penetrating shaft 48, an open and close handle 55, as a fixing device is fixed.

On the open and close cams 49, a groove for sliding along the fixing shaft 47 illustrated in FIG. 6 and a fitting portion (not illustrated) for locking and fixing the cam 49 is formed. The open and close cam 49 and the open and close handle 55 illustrated in FIGS. 1 to 3 illustrate a state of the upper guide unit 46 including the upper guide plate 35, in the closed position.

That is, when the open and close handle 55 is rotated clockwise (in FIG. 7), while the upper guide unit 46 is in the closed position, two of the open and close cams 49 rotate via the penetrating shaft 48 and thereby the fitting portion of each of the open and close cams 49 fits, with the same phase, into each of the fixing shafts 47 illustrated in FIG. 6. That results in securely fixing the upper guide unit 46 in the vicinity of the closed position. An open and close sensor 67 (illustrated in FIGS. 13 and 14) as a fixing state detecting device that detects the state in which the upper guide unit 46 including the upper guide plate 35 has been fixed to the lower guide plate 37 as a result of fitting the aforementioned fitting portion of the open and close cams 49 into the fixing shafts 47 of the upper guide unit 46 is attached to the supplemental side plate 29 located at a right side in FIG. 7. The open and close sensor 67 is a transmission type sensor.

In FIGS. 7, 9A, and 10, numeral 37*c* denotes a reinforcement rib having an upward convex-shaped rib. A proper number of ribs are formed on a center part of the lower guide plate 37 other than that illustrated in FIG. 7 or the like. In FIGS. 5 and 7, numeral 54 denotes an upper sheet feeding plate fixed to a side of the main body housing 6. In FIG. 7, numeral 56 denotes a stopper, which is fixed to a rear side wall 7*a* in the vicinity of each of the open and close cams 49. The stopper 56 is configured to limit an open side position of the upper guide unit 46.

As described above, according to the first embodiment of the present invention, both of the upper guide plate 35 and the supplemental upper guide plate 36 that serves as an upper guide member, and the lower guide plate 37 that serves as a lower guide member facing thereto are extending to a place in the vicinity of the sheet feeding inlet 125. Accordingly, when the sheet P that is thin and is of a large unevenness of rigidity, namely, the sheet P having uneven quality, such as, for example, a rough paper is used, the sheet P can securely be conveyed and delivered from the sheet feeding mechanism of the large capacity sheet feeding unit 5 to the main body sheet feeding roller 111 on a side of the mimeographic printing apparatus 100 via the intermediate conveying unit 4.

Consequently, there are advantages such that a tip end portion of the sheet P is prevented from being caught on a projection of the main body sheet feeding roller 111 (a jagged portion formed on a circumferential portion of the main body sheet feeding roller 111), or that a break of the tip end of the sheet P, damage of the sheet P, or sheet jamming is prevented from occurrence.

Alternatively, another configuration in which at least one of the upper guide member and the lower guide member extends to a place in the vicinity of the main body sheet feeding tray 110 or the sheet feeding inlet 125 may be employed. Hereinafter, a meaning of the expression, "extends to a place in the vicinity of the main body sheet feeding tray 110 or the sheet feeding opening 125" includes the case in which the supplemental upper guide plate 36 is separate from and independent on the lower guide plate 37 as easily understood by seeing FIG. 5 illustrating the aforementioned first embodiment of the present invention.

Next, the place around the housing 7 is explained referring to the FIGS. 5, and 8 to 10.

The first to the third motors, 33-1 to 33-3 are stepping motors driven by inputting pulses respectively. Each of the first to the third motors, 33-1 to 33-3 are attached and fixed to a predetermined bottom wall 7*c* of the housing 7 with screws or the like tightening device allowing a slight movement of each of the motors via a motor bracket (not illustrated), so that a tension adjustment of each of the timing belts that composes the first drive force transmitting device 34-1 to the third drive force transmitting device 34-3 is available.

Alternatively, without being limited to the aforementioned first embodiment of the present invention, for example, a configuration in which at least one of the driving device (for example, a stepping motor) that rotatably drives each of the first conveying roller 32-1 to the third conveying roller 32-3 may be employed. In this case, when magnet clutches are attached to at least two of each of the conveying rollers 32-1, 32-2 and 32-3, the drive force of the driving device (for example, a stepping motor) can be controlled by connecting/disconnecting the drive force by switching the magnet clutches from turning on to turning off at a proper timing.

A pair of the first conveying rollers 32-1 is, as illustrated in FIG. 8, mounted on each of the right and left end portion of the shaft 32*a*1. The first conveying rollers 32-1 are rotatably supported by the first bracket 58 attached to and fixed to the bottom wall 7*c* with screws via a shaft 32*a*1 and a bearing (not illustrated) The one-way clutch 61 that serves as a one way rotation drive force transmitting device is embedded into both of the first conveying roller 32-1 and the shaft 32*a*1, therefore, the conveying roller 32-1 rotates only in a clockwise direction, namely, only in a direction to convey the sheet P that is fed from the sheet feeding mechanism 3 in the sheet conveying direction X. The same is true for the second conveying roller 32-2 and is rotatably supported by the second bracket 59, via the shaft 32*a*2 and a bearing (not illustrated), which is fixed to a bottom wall 7*c*.

As illustrated in FIG. 10, a part of the circumferential portion of the second conveying roller 32-2 protrudes upward from the opening 37*b* of the lower guide plate 37 and faces the intermediate sheet conveying path 18.

The third conveying roller 32-3 is arranged at the most downstream side of the intermediate sheet conveying path 18 among three of the first conveying roller 32-1, the second conveying roller 32-2, and the third conveying roller 32-3, and is a single roller. The third conveying roller 32-3 is rotatably supported via a shaft 32*a*3 and bearings (not illustrated) on a third bracket 60, which is fixed on the bottom wall 7*c* with screws. The one-way clutch 61 is embedded into the third conveying roller 32-3 and the shaft 32*a*3 and the third conveying roller 32-3 is therefore able to rotate in a counterclockwise direction in FIG. 5, namely, the third conveying roller 32-3 can only be rotated in the direction, such that the sheet P that is fed from the sheet feeding mechanism 3 is conveyed in the sheet conveying direction X.

As illustrated in FIG. 9A, a part of the circumferential portion of the third conveying roller 32-3 is also arranged to face the sheet conveying path 18 by protruding upward from the opening 37*b* of the lower guide plate 37. The third conveying roller 32-3 is arranged to a position facing the main body sheet feeding roller 111 on the side of the mimeographic printing apparatus 100, and is also arranged to a predetermined position, illustrated in each of the drawings, of the housing 7 of the intermediate conveying unit 4 to slip into a position beneath a circumferential surface of the main body sheet feeding roller 111 so as to contact the same when the large capacity sheet feeding/conveying unit 1 has the connected position illustrated in FIG. 1.

As illustrated in FIG. 9A, a sheet spring 62 that serves as a breaking force applying device to apply breaking force to the third conveying roller 32-3 is fixed to inside of the front face wall 7*b* of the housing 7 with a screw or the like tightening device. The breaking force of the sheet spring 62 is applied to a core portion 32*b* that serves as a shaft portion of the third conveying roller 32-3, to which the rotation drive force is transmitted via the one-way clutch 61 from the third drive force transmitting device 34-3, as indicated by a solid line in FIG. 9A.

Without being limited to the above-described configuration, the breaking force caused by the sheet spring 62 may be applied to the third conveying roller 32-3 itself, which is a side to which the rotation drive force transmitted from the third drive force conveying device 34-3 is transmitted via a one-way clutch as indicated by a two-dot-and-a-dash line in FIG. 9A. In this case, it is obvious the breaking force must be applied within a condition that endurance of the third conveying roller 32-3 is considered and excessive load to the third motor 33-3 that serves as a driving device for the third conveying roller 32-3 is avoided.

Influence of inertia of a sheet conveying operation executed by the third conveying roller 32-3 is suppressed, and a stable sheet stop position can be secured by applying the proper breaking force as described above, and thereby, the sheet can accurately be conveyed.

In addition, the breaking force caused by the sheet spring 62 that serves as a breaking force applying device may be properly applied to both of the second conveying roller 32-2 and the first conveying roller 32-1 arranged in the intermediate sheet conveying path 18. In this case, the breaking force caused by the sheet spring 62 may be set in a state that the closer to the main body sheet feeding roller 111 of the mimeographic printing apparatus 100, the stronger the breaking force caused by the sheet spring 62.

Next, referring now to FIG. 8, a drive force transmitting mechanism will be described.

The first drive force transmitting device 34-1 is mainly composed of a timing pulley 63-1 that is fixed to an output shaft (rotation shaft) of the first motor 33-1, timing pulley 64-1 that is fixed to an end portion of the shaft 32*a*1 of the first conveying roller 32-1, a timing belt 65-1, which is entrained about the timing pulley 63-1 and the timing pulley 64-1.

The second drive force transmitting device 34-2 is mainly composed of a timing pulley 63-2 that is fixed to an output shaft (rotation shaft), of the second motor 33-2, a timing pulley 64-2 that is fixed to that is fixed to an end portion of the shaft 32*a*2 of the second conveying roller 32-2, and a timing belt 65-2, which is entrained about the timing pulley 63-2 and the timing pulley 64-2.

In the same manner as described above, the third drive force transmitting device 34-3 is mainly composed of a timing pulley 63-3 that is fixed to an output shaft (rotation shaft) of the third motor 33-3, a timing pulley 64-3 fixed to an end portion of a shaft 32*a*3 of the third conveying roller 32-3, and a timing belt 65-3, which is entrained about the timing pulley 63-3 and the timing pulley 64-3.

As illustrated in FIGS. 1, 5, and 9A, both of a shutter mechanism 70-1 for the sheet length sensor facing the sheet length sensor 128 (not illustrated in FIG. 9A) and selectively interrupting the same, and a shutter mechanism 70-2 for the sheet existence sensor facing the sheet existence sensor 127 and selectively interrupting the same are arranged inside the main body sheet feeding tray 110, when the large capacity sheet feeding/conveying unit 1 is positioned at the connected position illustrated in FIG. 1, at a lower part of the housing 7.

Both of the shutter mechanism 70-1 for the sheet length sensor and the shutter mechanism 70-2 for the sheet existence sensor are configured to be substantially the same, and therefore the detailed explanation for the shutter mechanism 70-2 for the sheet existence sensor may also be applied to the shutter mechanism 70-1 for the sheet length sensor, and an explanation for the shutter mechanism 70-1 is omitted.

Figure 9B:
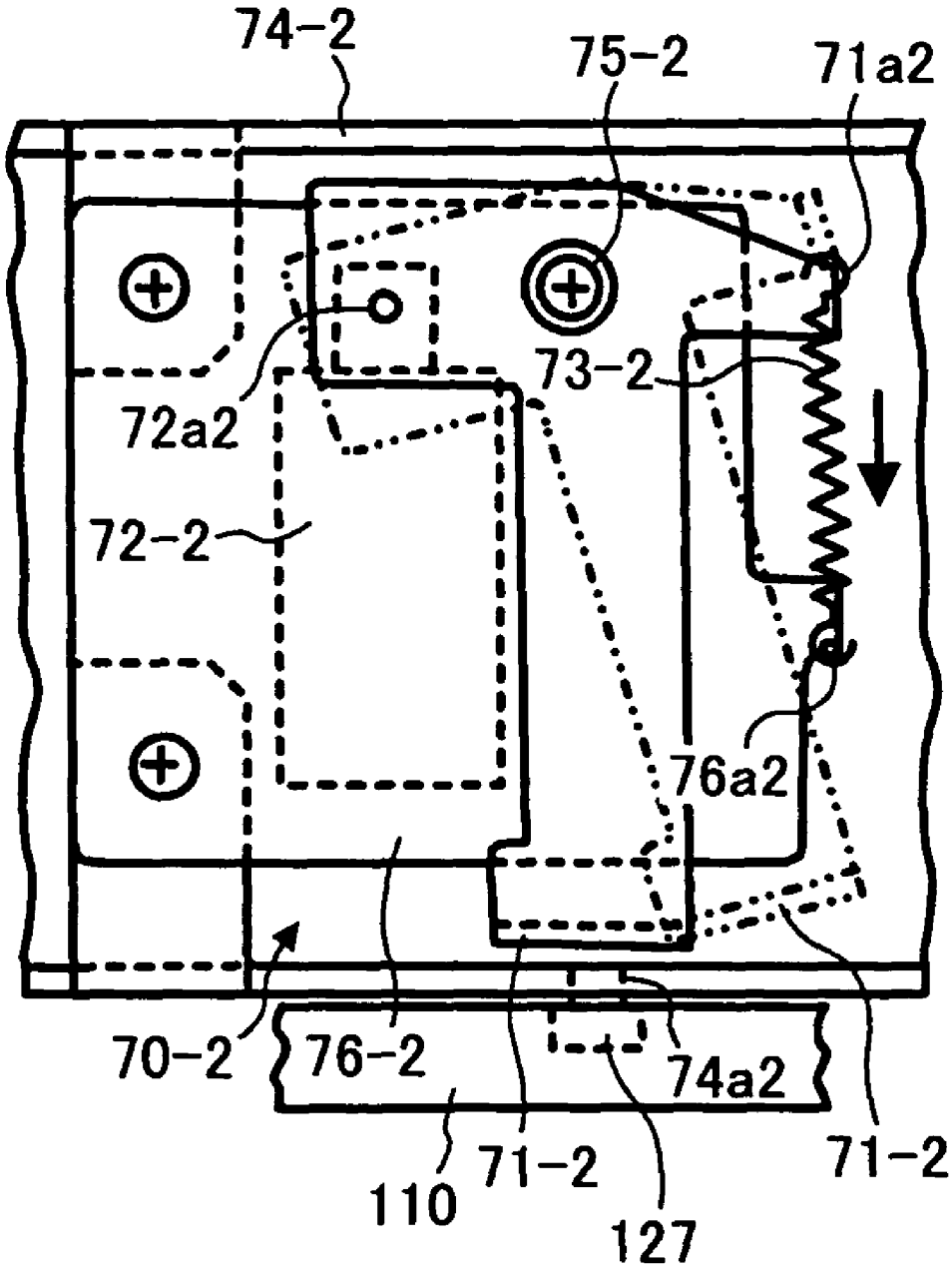

The shutter mechanism for the sheet existence sensor 70-2 is mainly provided with, as illustrated in FIGS. 9A and 9B in detail, a shutter 71-2 that serves as an interruption member, a pull-type solenoid 72-2 that serves as an interruption driving device, a tension spring 73-2 that serves as an energizing device, a shutter mechanism protection member 74-2, a fulcrum shaft 75-2, and a holder 76-2.

The shutter mechanism protection member 74-2 is an immovable member and is made of, for example, a sheet metal, which is formed into nearly U-shaped configuration by a bending process. Further, the shutter mechanism protection member 74-2 is fixed to a bottom face of the bottom wall 7*c* of the housing 7 with a screw or the like tightening device. An opening 74*a*2 to transmit the projection light and the reflection light from the sheet existence sensor 127 is formed on the bottom wall of the shutter mechanism protection member 74-2.

A holder 76-2 for the solenoid 72-2 to be fixed thereupon with screw, and for the fulcrum shaft 75-2 to be secured thereupon is fixed on a right side face of the shutter mechanism protection member 74-2 illustrated in FIG. 9A. As a result, the holder 76-2 as well as the shutter mechanism protection member 74-2 becomes an immovable member. Further, a hooking portion 76*a*2 to hook an end of the tension spring 73-2 is formed at a right end of a center of the holder 76-2 illustrated in FIG. 9B by a bending process. The shutter 71-2 is made of, for example, a sheet metal.

A free end of the shutter 71-2 is configured to be swingable about the fulcrum shaft 75-2 between a position that represents a state in which a sheet exists, by interrupting and reflecting the projection light of the sheet existence sensor 127 that reaches via the opening 74*a*2 as indicated by a solid line in FIG. 9B and a position that represents another state in which a sheet is absent, by transmitting the projection light of the sheet existence sensor 127 as indicated by a two-dot-and-a-dash line in FIG. 9B.

At a right end of the upper part of the shutter 71-2, a hooking portion 71*a*2 to hook another end of the tension spring 73-2 is formed by a bending process. A fitting hole to loosely fit a pin 72*a*2 that is inserted with pressure into a tip end portion of a plunger of the solenoid 72-2. The pin 72*a*2 of the solenoid 72-2 is connected to the shutter 71-2 penetrating through a pin penetrating long hole (not illustrated) made on the holder 76-2 and the aforementioned fitting hole of the shutter 71-2.

A bottom portion of the shutter 71-2 is bent into an L-shape and a proper treatment is executed on the surface of the bottom face thereof so that the bottom face reflects the projection light from the sheet existence sensor 127 as well as the surface of a sheet reflects the projection light.

The tension spring 73-2 is tightly stretched from the hooking portion 76*a*2 of the holder 76-2 to the hooking portion 71*a*2 of the shutter 71-2, and a free end of the shutter 71-2 (bottom face in FIG. 9B) is always energized to swing clockwise in FIG. 9B, which is the direction for the shutter 71-2 to stay at the position that represents a state in which the sheet exists. In addition, an energizing force of the tension spring 73-2 helps a returning operation of the plunger and the pin 72*a*2 of the solenoid 72-2.

An operation of the shutter mechanism 70-2 for the sheet existence sensor is explained now in advance. When a power is supplied to the solenoid 72-2 for sheet existence sensor and the solenoid 72-2 is turned on, the plunger and the pin 72*a*2 is pulled down against the energizing force of the tension spring 73-2 as illustrated in FIGS. 9A and 9B. Thereby, a free end of the shutter 71-2 swings in a counterclockwise direction about the fulcrum shaft 75-2 and reaches the position indicated by a two-dot-and-a-dash line in FIG. 9B, representing the state in which the sheet is absent.

On the contrary, when the power to the solenoid 72-2 for sheet existence sensor is cut and the solenoid 72-2 is turned off, the plunger and the pin 72*a*2 move upward by the energizing force of the tension spring 73-2. Thereby, the free end of the shutter 71-2 swings clockwise about the fulcrum shaft 75-2 and reaches a position indicated by a solid line in FIG. 9B, representing the state in which the sheet exists.

When the large capacity sheet feeding/conveying unit 1 is at the connected position illustrated in FIGS. 1 and 9A, the solenoid 72-2 is staying in a state of being turned off by a command generated and transmitted by a controller described later. As a result, the free end of the shutter 71-2 is in the position that represents the state in which the sheet exists, and that the projection light from the sheet existence sensor 127 is interrupted and reflected. Further, when a sheet is absent on both of the stacking section 2 and the intermediate conveying unit 4, the solenoid 72-2 turns on by a command from the aforementioned controller.

Then, the free end of the shutter 71-2 swings in a counterclockwise direction about the fulcrum shaft 75-2 against the energizing force of the tension spring 73-2, and reaches the position that represents the state in which the sheet is absent, as indicated by the two-dot-and-a-dash line, illustrated in FIG. 9B. Consequently, a controller (not illustrated) provided in the mimeographic printing apparatus 100 recognizes that the sheet is absent.

On the other hand, when a sheet exists in the intermediate conveying unit 4, the solenoid 72-2 is turned off by a command from the aforementioned controller, the free end of the shutter 71-2 is at the position for representing the state in which the sheet exists as mentioned above. As a result, the aforementioned controller on a side of the mimeographic printing apparatus 100 recognizes that the sheet exists, and a conveying operation for the sheet from the intermediate conveying unit 4 to the side of the mimeographic printing apparatus 100 becomes to a state in which the sheet can be conveyed.

In comparison with the shutter mechanism 70-1 for the sheet length sensor, the shutter mechanism 70-2 for the sheet existence sensor has a function in which the shutter mechanism protection member 74-2 contacts the front face plate 124 of the main body sheet feeding section 104 and determines the connected position together with the slanting member 51, when the large capacity sheet feeding/conveying unit 1 is positioned at the connected position illustrated in FIG. 9A, and that is the main difference between the shutter mechanism 70-2 for the sheet existence sensor and the shutter mechanism 70-1 for the sheet length sensor.

Therefore, even though a shape of the shutter mechanism 70-1 is partially different from another, both of the shutter mechanism 70-1 for the sheet length sensor and the shutter mechanism 70-2 for the sheet existence sensor have substantially the same component, and explanation thereof is omitted by adding a numeral 1 that follows a character of each of the components.

In FIG. 8, numeral 135 denotes a rotation shaft for aligning a center of a printing image (for aligning a position in the width direction of the sheet P). A male screw (not illustrated) is formed on an end portion of the rotation shaft 135. The alignment of the sheet P along the sheet width direction is performed by utilizing a movement of the pair of right and left supplemental side plates 29 of the main body housing 6 by the screw mechanism in which the male screw formed on the end portion of the rotation shaft 135 is screwed into a screwing member (not illustrated), i.e., the pair of right and left supplemental side plates 29, on an upper part of which a female screw is formed.

Figure 11:
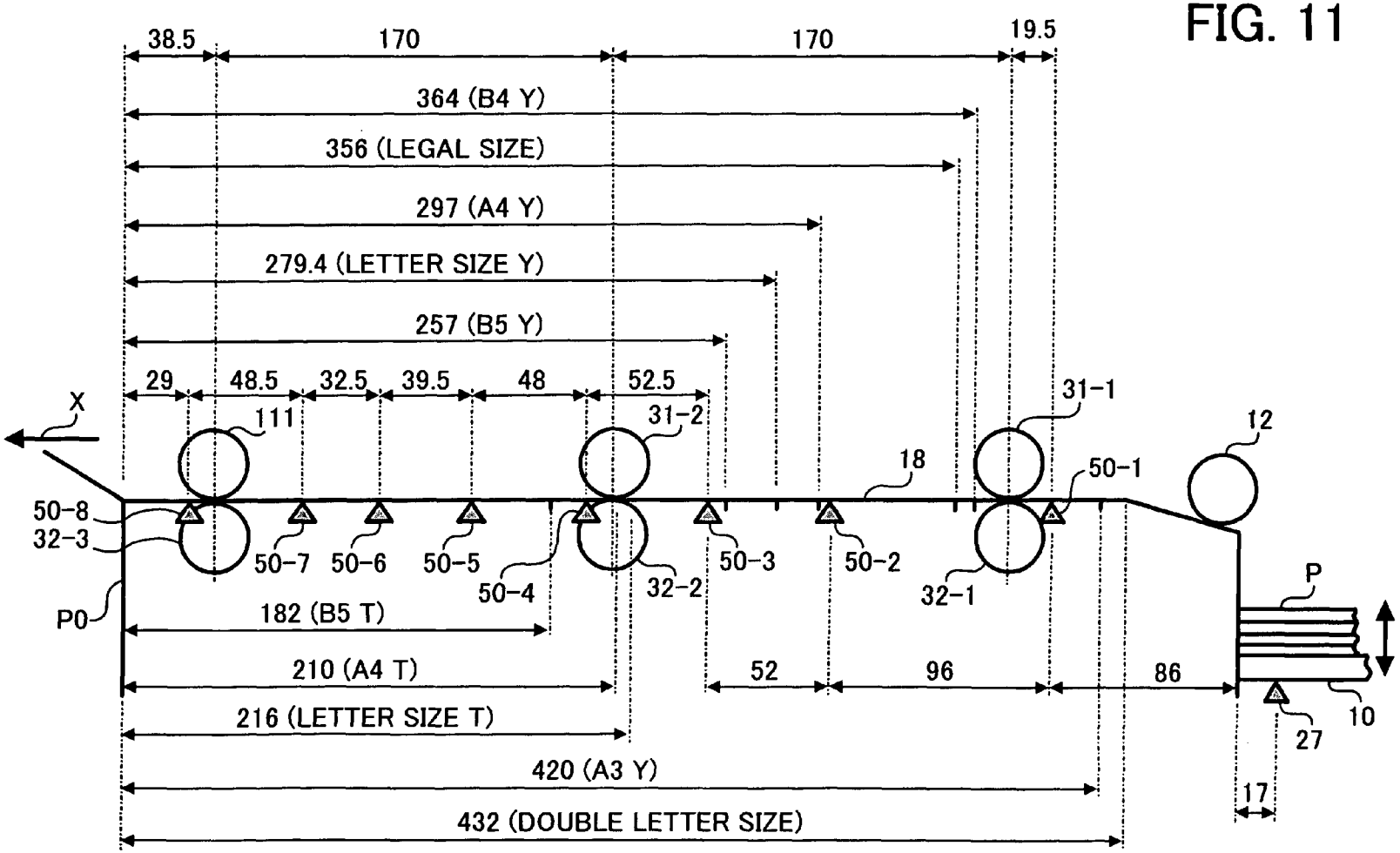
FIG. 11 is a frame format explaining arrangement of sheet detection devices, sheet conveying devices, dimensions, and each of sheet lengths at the intermediate conveying device.
Figure 13:
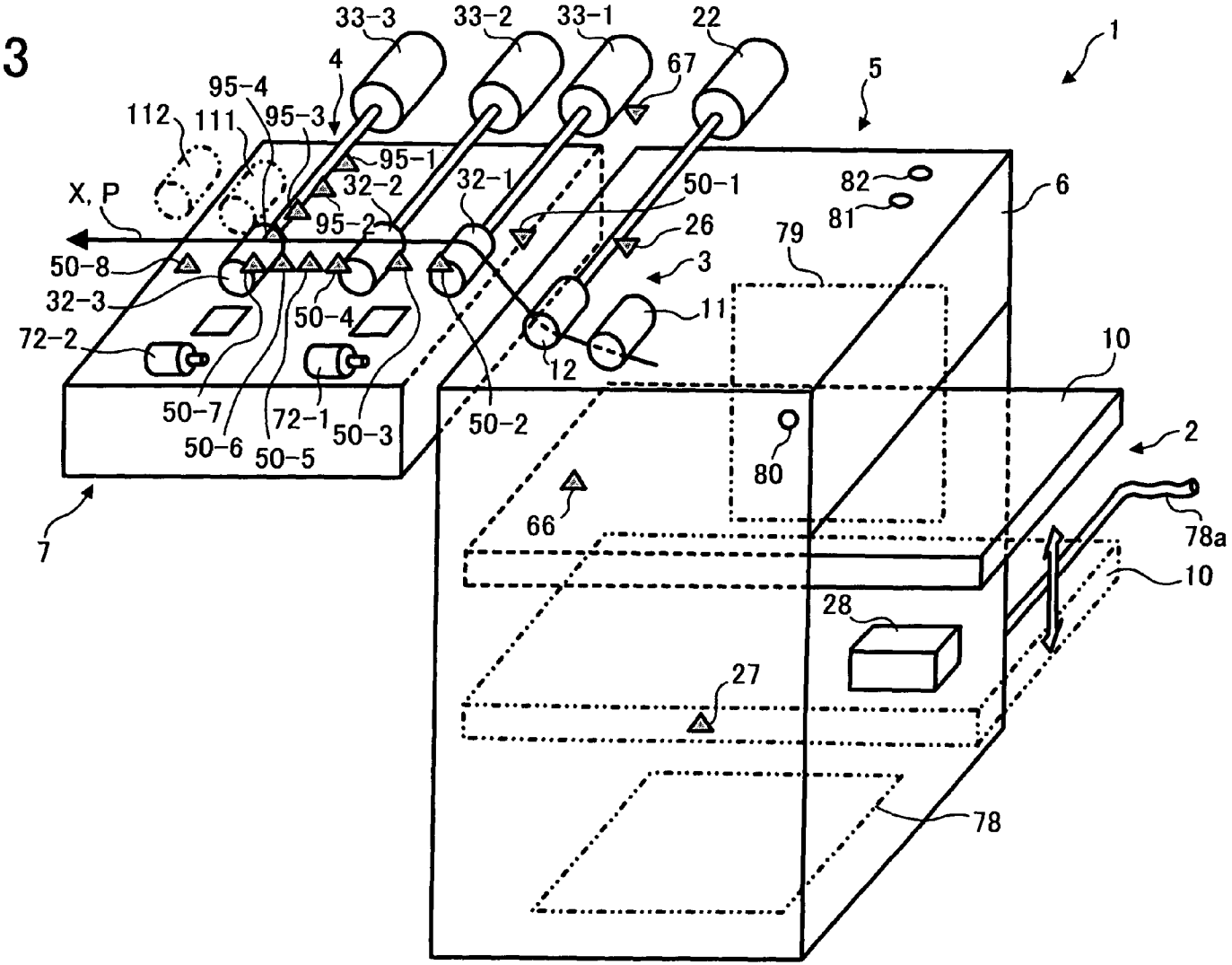
FIG. 13 is a perspective view briefly illustrating arrangement of a main control system component on a side of the large capacity sheet feeding/conveying unit.

Referring now to FIGS. 11 through 13, a configuration of electrical control for controlling an operation (described later) of the aforementioned large capacity sheet feeding/conveying unit 1 will be explained. Further, to simplify the drawings, each of the sensors 26, 27, 66, and 67 (in FIG. 13), a first to an eighth sensors, 50-1 to 50-8 (in FIG. 11), the first to the fourth sheet width sensors, 95-1 to 95-4 or the like (in FIG. 12) are illustrated with triangle marks, and each of the motors 22, 28, 33-13 to 3-3, and each of the solenoids 72-1 for sheet length sensor and 72-2 for sheet existence sensor (in FIG. 13) are also illustrated as a pattern format. In FIGS. 11 through 13, the first to the eighth sensors, 50-1 to 50-8, and the first to the fourth sheet width sensors, 95-1 to 95-4 are illustrated as if being arranged on the side of lower guide plate 37, however, this is to simplify the controlling components and the explanation for the operations and the first to the eighth sensors, 50-1 to 50-8, and the first to the fourth sheet width sensors, 95-1 to 95-4 are arranged on a side of the upper guide plate 35 as mentioned above.

First, an arrangement of the first to the eighth sensors, 50-1 to 50-8 is supplemented on the basis of FIG. 11.

The first to the eighth sensors, 50-1 to 50-8 arranged and fixed in the upper guide plate 35 having intervals illustrated in FIG. 11. This is because as illustrated in FIG. 11 with parentheses and in FIG. 15, a length of the sheet P along the direction X is set corresponding to ten kinds of the sheet sizes. In FIGS. 11 and 16, for example, a size of A3Y (landscape) is the length of 420 mm in the sheet conveying direction X, an A4T has the length of 210 mm in the sheet conveying direction X, and a DLY (double letter size) has the length of 432 mm, i.e., the longest in the first embodiment of the present invention, respectively.

Further, a sheet conveying length of the intermediate sheet conveying path 18 is set to 480 mm corresponding to the length of DLY (double letter size). Furthermore, a distance from a center of a nipping portion formed between the first pressure roller 31-1 and the first conveying roller 32-1 to a center of a nipping portion formed between the second pressure roller 31-2 and the second conveying roller 32-2 is 170 mm, and a center of a nipping portion formed between the second pressure roller 31-2 and the second conveying roller 32-2 and a distance of a center of a nipping portion formed between the main body sheet feeding roller 111 on a side of the main body sheet feeding section 104 and the third conveying roller 32-3 is also 170 mm, and the like are exemplary illustrated in FIG. 11.

Next, an arrangement of the first to the fourth sheet width sensors, 95-1 to 95-4 is supplemented on the basis of FIGS. 12 and 13.

Specifically, the first to the fourth sheet width sensors, 95-1 to 95-4 are arranged and fixed in the upper guide plate 35 with predetermined intervals along the sheet width direction Y.

This is because, as illustrated in FIG. 12 with parentheses, a length of the sheet P along the sheet width direction Y is distributed at a center thereof and is set for, for example, each of the seven sheet sizes, respectively.

In FIG. 12, for example, an A3Y (landscape), or A4T (portrait) has the length of 297 mm along the sheet width direction Y, a B4Y (landscape), or B5T (portrait) has the length of 257 mm along the sheet width direction Y, an A4Y (landscape) or A5T (portrait) has the length of 210 mm along the sheet width direction, and a B5Y (landscape) has the length of 182 mm, respectively, which is the shortest in the first embodiment of the present invention.

The first to the fourth sheet width sensors, 95-1 to 95-4 are arranged with predetermined intervals along the sheet width direction Y, and are arranged in and fixed on the upper guide plate 35 being shifted a little from an upstream to a downstream along the sheet conveying direction X, as illustrated in FIG. 12. However, in light of considering a function for detecting the sheet size, the sheet width sensors may be arranged, without being limited to the aforementioned arrangement, in the same position along the sheet conveying direction X as simply illustrated in FIG. 13, for example.

At this moment, the first embodiment of the present invention will be supplemented with an explanation for a main positional relationship among the printing section 102 of the mimeographic printing apparatus 100, main body sheet feeding section 104, and the intermediate conveying unit 4, when the large capacity sheet feeding/conveying unit 1 is positioned at the connected position illustrated in FIG. 1.

A distance between a center of a nipping portion of the printing drum 115 and the pressure roller 116 in a state of pressing each other and a center of the nipping portion of the registration rollers pair 114 is 120 mm, and a distance between the center of the nipping portion of the registration rollers pair 114 and a center of the nipping portion formed by a pressure between the main body sheet feeding roller 111 and the third conveying roller 32-3 is also 120 mm. Further, a distance between a center of a nipping portion between the printing drum 115 and the pressure roller 116 and a center of the nipping portion formed with the main body sheet feeding roller 111 and the third conveying roller 32-3 is 240 mm.

Accordingly, when the B5T sheet having the shortest length of 182 mm is conveyed from the intermediate conveying unit 4 to the main body sheet feeding section 104, and when the leading edge of the B5T sheet reaches the nipping portion of the printing drum 115 and the pressure roller 116, the position, at which the trailing edge of the B5T sheet reaches is located on a place between the registration rollers pair 114 and the main body separation roller 112.

An upside roller of the registration rollers pair 114 is detachably contacts a downside roller thereof. That is, the registration rollers pair 114 is provided with an attaching/detaching mechanism having an energizing device including a cam that makes a timing (not illustrated), a tension spring, and the like, and the upside roller can be detached from the downside roller of the registration rollers pair 114. According to the aforementioned component, a load or stress on a sheet caused, when a tip end portion of the sheet is fully nipped between the nipping portion of the printing drum 115 and the pressure roller 116 at a certain length, by a pressure contact of the registration rollers pair 114 at the nipping portion thereof can be released by the detaching operation of the upside roller from the downside roller of the registration rollers pair 114. Thereby, the aforementioned load or stress is not applied to the sheet and the rotation of the printing drum 115.

In a same reason, the one-way clutch embedded into each of the shaft portions of the main body separation roller 112 and the main body sheet feeding roller 111 are configured to avoid a load or stress caused by a drive force transmitting device, which is connected to the main body separation roller 112 and the main body sheet feeding roller 111, and the sheet feeding motor 122 (a stepping motor), to be applied to a sheet being conveyed, a rotation of the printing drum 115, and the like, as little load as possible.

Further, the first to third motors, 33-1 to 33-3 are common stepping motors in the first embodiment of the present invention, and therefore, in a case when the sheet is conveyed through the intermediate sheet conveying path 18 and a sheet conveying path on the mimeographic printing apparatus 100, both of which have a predetermined distance as mentioned earlier, a distance for conveying the sheet (or an amount of sheet conveyance) can be controlled by a number of pulses supplied to each of the stepping motors.

As a result, the accurate sheet conveying operation can easily be executed. This is similar to the sheet feeding motor 22, the sheet feeding motor 122 on a side of the mimeographic printing apparatus 100, and a registration motor (not illustrated) formed of a stepping motor that rotates the registration rollers pair 114 of the main body sheet feeding section 104.

A component of a controller for use in the first embodiment of the present invention will now be described including supplemental explanation for the aforementioned component of the controller.

In FIG. 13, numeral 78 denotes a power source base plate, numeral 78*a* denotes a power cable for connecting to, for example, a commercial power source, numeral 79 showing an element illustrated by a two-dot-and-a-dash line denotes a control plate, on which a control device, etc., described later are mounted, numeral 80 denotes a power switch that turns on/off the power supplied via the power cable 78*a*, numeral 81 denotes a reset switch that serves as a reset device for giving instructions to reset the large capacity sheet feeding/conveying unit 1, and numeral 82 denotes a sheet feeding tray lowering switch that controls the raising/lowering motor 28 and sets a resultant final lowering position of the large capacity sheet feeding tray 10 by pressing the same for a predetermined time, respectively.

The power switch 80 is mounted on an operation side, reset switch 81 and sheet feeding tray lowering switch 82 are arranged to an upper part of the main body housing that is to be called as the operation panel of the large capacity sheet feeding/conveying unit 1, respectively. The sheet feeding tray lowering switch 82 is provided for lowering the large capacity sheet feeding tray 10 of the stacking section 2 for a stroke of lowering the same long enough to replenish the sheets onto the large capacity sheet feeding tray 10 when necessary, or when sheet jamming occurs in the sheet feeding mechanism 3 or the like, the jammed sheet can be removed by lowering the large capacity sheet feeding tray 10 a little.

Figure 14:
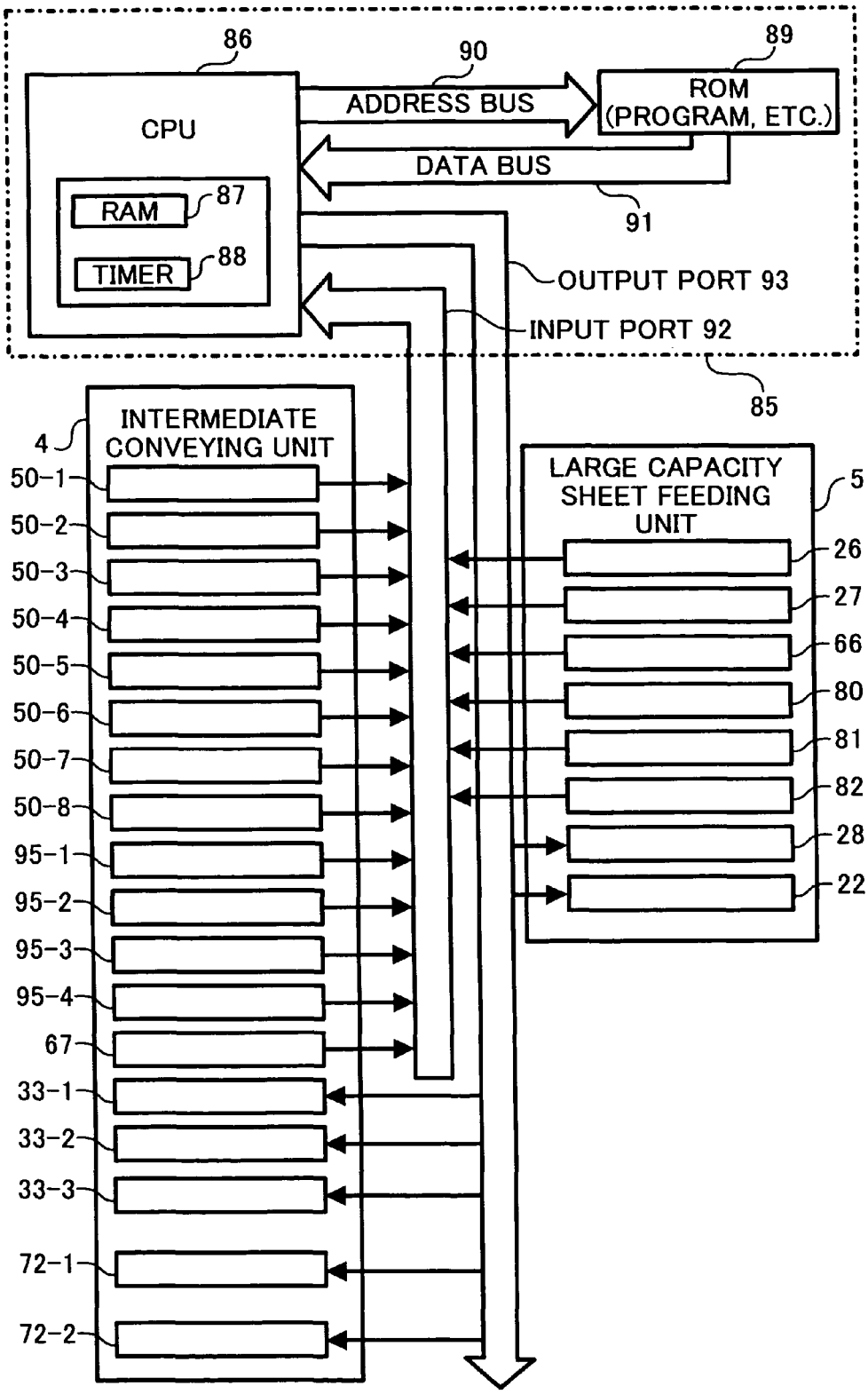
FIG. 14 is a block diagram illustrating a main electric control system component of the large capacity sheet feeding/conveying unit in an off-line mode.

Next, FIG. 14 illustrates a main control system of the large capacity sheet feeding/conveying unit 1, as a block diagram. In FIG. 14, a controller 85 includes a CPU (Central Processing Unit) 86, a RAM (Random Access Memory) 87, a timer that serves as a time keeping device 88, and a ROM (Read Only Memory) that serves as a memory device 89. The CPU 86 and the ROM 89 are connected with an address bus 90 and a data bus 91, and each of the CPU 86, the RAM 87, and the timer 88 is connected with a signal bus (not illustrated), respectively. That is a configuration of the microcomputer, which is mounted on the large capacity sheet feeding/conveying unit 1. The controller 85 is arranged in the control plate 79 illustrated in FIG. 13.

Further, when the large capacity sheet feeding/conveying unit 1 and the mimeographic printing apparatus 100 are used being connected in an off-line state, which is incapable of allowing communication (hereinafter sometimes referred to as off-line mode), the operation can be executed even though the first to the fourth sheet width sensors, 95-1 to 95-4 illustrated in FIGS. 12 to 14.

However, as described later, when the large capacity sheet feeding/conveying unit 1 and the mimeographic printing apparatus 100 are connected in an on-line state, which is capable of allowing communication (hereinafter sometimes referred to as an on-line mode), and a control that is specific to the first embodiment of the present invention can be executed, the control system of the large capacity sheet feeding/conveying unit 1 is necessary and for convenience of explanation, the main control system of the large capacity sheet feeding/conveying unit 1 is illustrated in FIG. 14.

The CPU 86 is electrically connected to each of height sensor 26, the lower limit sensor 27, the sheet existence sensor 66, the power switch 80, the reset switch 81, and the sheet feeding tray lowering switch 82, on a side of the large capacity sheet feeding unit 5 via each of the sensor input circuits (not illustrated), switch input circuit, and an input port 92.

Further, the CPU 86 is also electrically connected to the first to the eighth sensors, 50-1 to 50-8, the first to the fourth sheet width sensors, 95-1 to 95-4, the open and close sensor 67 mounted on a side of the intermediate conveying unit 4, via each of the sensor input circuit (not illustrated) and the input port 92, and the CPU receives each kind of signal from each of the sensors and each of the switches.

Furthermore, the CPU 86 is electrically connected to the sheet feeding motor 22 and the raising/lowering motor 28, both of which are mounted on a side of the large capacity sheet feeding unit 5, via a motor drive circuit (not illustrated) and an output port 93. In addition, the CPU 86 is electrically connected to the first to the third motors, 33-1 to 33-3 that are mounted on a side of the intermediate conveying unit 4 and the solenoid 72-1 for sheet length sensor and the solenoid 72-2 for sheet existence sensor via a motor drive circuit (not illustrated), solenoid drive circuit and the output port 93, transmits each of the command signals for controlling operation of the aforementioned motors and solenoids on the basis of each kind of signals from aforementioned each of the sensors and each of the switches, and a program and the like relevant to an operation called from the ROM 89.

The CPU 86 therefore controls entire operation including start, stop, time keeping, and the like for aforementioned each of the devices of the large capacity sheet feeding/conveying unit 1, to be controlled.

In the ROM 89, an entire operation of the large capacity sheet feeding/conveying unit 1, or a program described in a flowchart explained later that illustrates a sheet conveying operation flow, and each kind of relevant data for showing a controlling function of the CPU 86 are remembered and the operation program and relevant data are called by the CPU 86. RAM 87 has functions, such as, temporarily remembering a result of calculation executed by the CPU 86, and remembering respective kinds of signals including each of settings and input on/off signals from aforementioned each of the switches and sensors at any time.

The timer 88 has a function as a time keeping device that measures a time when the trailing edge of the sheet P (Hereinafter, when the sheet P is conveyed through the intermediate conveying unit 4, and when two of special sheets P that are consecutively conveyed are described, a preceding sheet is referred to as a first sheet P1 and a sheet that follows the first sheet P1 is referred to as a second sheet P2 that is mentioned later) moves through the first to the eighth sensors, 50-1 to 50-8, when the sheet P1 starts to be conveyed through each of the first to the eighth sensors, 50-1 to 50-8, corresponding to a start of feeding operation for the sheet P that is fed by the main body sheet feeding roller 111 caused by a start of the sheet feeding motor 122 on a side of the mimeographic printing apparatus 100.

The CPU 86 (hereinafter sometimes referred to as a controller 85 for convenience of explanation) has a function as a sheet conveying speed control device that controls each of the first to the third motors, 33-1 to 33-3, such that each of the first to the third conveying rollers, 32-1 to 32-3 conveys the sheet P that is fed from the sheet feeding mechanism 3 at a sheet conveying speed, regardless of a printing speed on a side of the mimeographic printing apparatus 100, corresponding to a top printing speed (120 sheets/minute at 120 rpm in the first embodiment of the present invention) on a side of the mimeograhic printing apparatus 100 in the off-line mode.

According to the controller 85 having a function as that of the aforementioned sheet conveying speed control device, below described problem of the related art may be solved. That is, when there is a speed difference of six steps on a side of a mimeographic printing apparatus, a sheet conveying speed of a conveying roller (sheet conveying device) that conveys the sheet, which is arranged in an intermediate conveying section is generally controlled to the aforementioned six steps of the sheet conveying speed including a plate setting speed, proportional to and corresponding to a printing speed of the mimeographic printing apparatus.

However, when a control method in which the sheet conveying speed of the conveying roller of the intermediate conveying section is set corresponding to the printing speed on a side of a mimeographic printing apparatus, because a sheet conveying condition at the low speed and the sheet conveying condition at the high speed does not become equal, a conveying speed control has had to be prepared for each of the sheet conveying speed. Thus, at the sheet conveying speed control method for the conventional large capacity sheet feeding apparatus having the intermediate conveying section, a printing speed, which is a circumferential speed of a conveying roller, is controlled on the basis of the printing speed information.

In other words, as for the on-line mode, the sheet conveying speed control method for the conveying roller on the basis of the printing speed information can be adopted, however, as for the off-line mode, the sheet conveying speed control method for the conveying roller on the basis of the printing speed information cannot easily be adopted. That has been a problem of the conventional large capacity sheet feeding apparatus having the intermediate conveying section.

The controller 85 (CPU 86) has a function in which a sheet size is judged on the basis of a signal from each of the sensor 50-1 to the sensor 50-8 at a reset time which is an initialization time when a conveying operation for one sheet P to each of the first to the eighth sensors, 50-1 to 50-8 is completed in which a sheet conveying operation control method switching device that switches a sheet conveyance control method for each of the first to the third conveying rollers, 32-1 to 32-3 at the off-line mode.

At the state of the reset time mentioned above, the sheet P1 is positioned at the third conveying roller 32-3 arranged on a most downstream side of the intermediate sheet conveying path 18 and the leading edge of the sheet P1 is positioned at a place in which the sheet P1 can be fed by the main body sheet feeding roller 111 indicated by a two-dot-and-a-dash line in FIG. 13, or a sheet stopping position P0 illustrated in FIG. 11, as previously determined.

The stopping position P0 is set to a position, about 38.5 mm ahead of the center of the nipping portion formed by a pressure contact between the main body sheet feeding roller 111 and the third conveying roller 32-3, in the sheet conveying direction X, as illustrated in FIG. 1.

The function of the controller 85 (CPU 86) as the aforementioned sheet conveying operation control method switching device is, when expressed in other words, to control each of the first to the third motors, 33-1 to 33-3, such that, at the initialization time, i.e., the time when the conveying operation for the one sheet P1 onto each of the first to the eighth sensors, 50-1 to 50-8 is completed, the size of the sheet is judged on the basis of the signal from each of the first to the eighth sensors 50-1 to 50-8, and the sheet conveying operation control method is switched.

In the first embodiment of the present invention, a sheet conveying speed of each of the first to the third conveying rollers, 32-1 to 32-3 is not necessary to be switched with the function of the controller 85 as the aforementioned sheet conveying operation control method switching device, however, in a case when, for purpose, the sheet conveying speed is switched, the sheet conveying speed (a circumferential speed or a rotation speed) of the first to the third conveying rollers, 32-1 to 32-3 can easily and accurately be changed by switching a frequency of the pulse (pps: pulse per second) to be supplied to the first to the third motors, 33-1 to 33-3 by the controller 85 (CPU 86).

That is, to switch an interval between the pulses (when the intervals between the pulses becomes shorter, the sheet conveying rollers are accelerated, when the intervals are constant, the sheet conveying rollers rotate at a constant speed, and when the intervals between the pulses becomes longer, the sheet conveying rollers are decelerated). This is because common stepping motors are used for the first to the third motors, 33-1 to 33-3.

Next, before explaining a specific control operation of the large capacity sheet feeding/conveying unit 1 in the off-line mode in detail, a fundamental control system of the sheet conveying operation of the intermediate conveying unit 4 will be explained referring now to FIG. 15. In the Figure, to simplify the explanation, the sheet conveying operation control method with respect to a position of each of the leading edge and the trailing edge of the first sheet P1 to be conveyed and a second sheet P2 to be conveyed is explained. In addition, for general purpose, the character P1 of the first sheet may be rewritten as Pn, and P2 as Pn+1 (n is a natural number).

Figure 15:
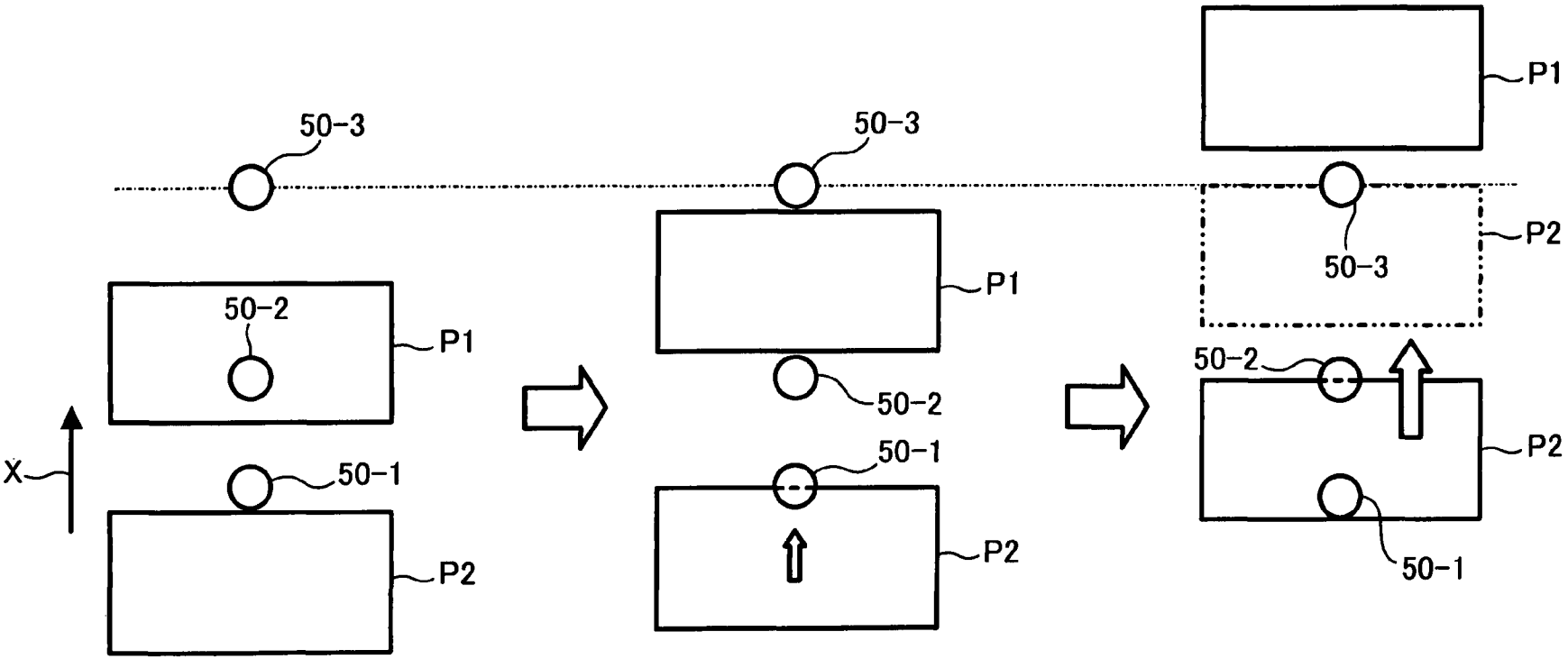
FIG. 15 is a top plan view illustrating a principle of a sheet conveyance control operation of the aforementioned embodiment of the present invention.

First, as illustrated in FIG. 15 (left), because the trailing edge of the first sheet P1 has not passed through the second sensor 50-2, the leading edge of the second sheet P2 is stopped at a position before being detected by the first sensor 50-1, which is an uppermost position of the upstream of the sheet conveying direction X.

However, exactly saying, even when the first sensor 50-1 detects the leading edge of the second sheet P2, the leading edge of the second sheet P2 will proceed by inertia of the conveying roller corresponding to the second sheet P2 for a slight distance to slow down and then stops. This is because the one-way clutch 61 is embedded into the first to the third conveying rollers, 32-1 to 32-3, which rotate by inertia.

Next, as illustrated in FIG. 15 (center), when the trailing edge of the first sheet P1 has passed through the second sensor 50-2 (a change of interruption/reflection of light to a transmission of light, at the reflection type sensor), a conveying operation for the second sheet P2 starts. The second sheet P2 proceeds until the leading edge thereof is detected by the second sensor 50-2. The second sheet P2 is conveyed and proceeds to a downstream side of the sheet conveying direction X or stops otherwise, depending on relationship between the trailing edge of the first sheet P1 and the third sensor 50-3, and the sheet size of the first sheet P1 along the sheet conveying direction X (hereinafter sometimes referred to as "sheet length").

As is illustrated in FIG. 15 (right), when the trailing edge of the first sheet P1 has passed-through the third sensor 50-3, the second sheet P2 passes through the second sensor 50-2 without decreasing the running speed (sheet conveying speed) thereof, as illustrated by a tow-dot-and-a-dash line in FIG. 15 (right), and the leading edge of the second sheet P2 is able to reach the third sensor 50-3. However, when the trailing edge of the first sheet P1 has not passed through the third sensor 50-3, the second sheet P2 stops at a position of the second sensor 50-2, as illustrated by a solid line in FIG. 15.

Thus, in the first embodiment of the present invention, the sheet conveying operation control method is switched such that the first sheet P1 and the second sheet P2 can sequentially be conveyed without contacting the trailing edge of the first sheet P1 with the leading edge of the second sheet P2, always detecting the positions of each leading edge and trailing edge of both of the first sheet P1 and the second sheet P2 with each of the sensor 50-1 to sensor 50-8. In other words, a specific control in which a preset sheet conveying operation control pattern is selected from the ROM 89, is executed.

According to the first embodiment of the present invention, because ten kinds of sheet sizes illustrated in FIGS. 11 and 16 are detected by a least number of sensors, namely eight sensors of the first to the eighth sensors, 50-1 to 50-8, the configuration for detecting the sheet length is made simple and a manufacturing cost may be decreased.

Therefore, in the present invention, for example, without being limited to the aforementioned first embodiment in which eight sensors, namely the first to the eighth sensors, 50-1 to 50-8 are arranged in the intermediate sheet conveying path 18, the numeral of the sensors may be replaced by the first to the Nth sensors, 50-1 to 50-N in which N is a natural number. (the number of the sensors may exceed 8). Further, also in a case when the length of the intermediate sheet conveying path 18 is extended more than the length mentioned earlier, a timing for starting and stopping each of the first to the third conveying rollers, 32-1 to 32-3, for example, can be changed such that the first sheet P1 (Pn) and the second sheet P2 (Pn+1) can sequentially be conveyed in which the trailing edge of the first sheet P1 (Pn) and the leading edge of the second sheet P2 (Pn+1) does not contact.

Furthermore, in a case when more than two sheets P are mounted on the first to the Nth sensors, 50-1 to 50-N, the sheet conveying operation can be controlled by increasing the number of the conveying rollers corresponding to the length of the conveying sheet.

Consequently, without being limited to the aforementioned first embodiment of the present invention, the intermediate conveying unit that serves as the intermediate conveying section may be composed of a sheet conveying device a plurality of which are arranged with intervals extending from upstream to downstream of the intermediate sheet conveying path that conveys a sheet that is fed from a sheet feeding mechanism, and the first to Nth sensor, namely, 50-1 to 50-N, a plurality of which are arranged with intervals extending from upstream to downstream of the intermediate sheet conveying path, which serves as a sheet detecting device that detects at least one of a leading edge and a trailing edge of the conveyed sheet.

Referring now to FIGS. 11, 16, 19A and 19B, a specific sheet conveying operation of the controller 85 for the large capacity sheet feeding/conveying unit 1, more particularly for the intermediate conveying unit 4 will be described.

As specifically illustrated in FIG. 11, in the first embodiment of the present invention, a length of the sheet P is judged by the controller 85 through a reset operation that is illustrated in FIGS. 32A to 32C and is described later, on the basis of the signals from each of the first to the eighth sensors, 50-1 to 50-8 when the conveying operation for the sheet P onto each of the first to the eighth sensors, 50-1 to 50-8 is completed and the sheet P has stopped, namely, the leading edge of the first sheet P1 has reached at the stopping position P0 where the first sheet P1 is nipped at a nipping position between the main body sheet feeding roller 111 and the third conveying roller 32-3 and has stopped at the stopping position P0.

For example, in a case of judging a size of the sheet P of the DLY (double letter size) and the A3Y (A3 landscape), which are the longest sheet sizes in a sheet conveying direction X, all of the eighth sensor 50-8 to the first sensor 50-1 are turned on because two of the aforementioned sheets P are long enough to be extended from the eighth sensor 50-8 to the first sensor 50-1, at the reset time. Thereby, the controller judges that the sheets P have the largest sheet length. Similar to the above, in a case of judging the size of the sheet P of the B5T (B5 portrait), the four sensors, i.e., eighth to fifth sensors 50-8 to 50-5 are turned on because the sheet P extends from the eighth sensor 50-8 to the fifth sensor 50-5 and positioned under the four sensors mentioned above. Thereby, the controller judges that the sheet P has the smallest sheet length.

In a table in FIG. 16, the numerals described in the second row to the bottom row of the second column from the right represents the number of the sensors by which the trailing edge of the first sheet P1 is detected. For example, when the B4Y or legal size Y sheet is conveyed through the intermediate sheet conveying path 18, the first 50-1 and the second sensor 50-2 are turned on by detecting the trailing edge of the B4Y sheet or legal size Y sheet at the reset time. In the manner as described above, the numerals represents the number of the sensors in which "1" represents the sensor "50-1", and "2" represents the sensor "50-2", and the like.

Further, in the table, the numeral "0" represents the position where the separation roller 12 is arranged. Furthermore, a second sheet loading sensor represents the number of the sensor in which when the first sheet P1 is loaded on and conveyed to a side of the memeographic printing apparatus 100, the sensor that detects the trailing edge of the first sheet P1 is turned off. The number of the second sheet loading sensor represents a conveyance type, from a conveyance type 1 to a conveyance type 5 described later, as illustrated with parentheses in FIG. 16.

Resulting from the above, the sheet conveying operation control pattern relevant to the sheet conveying operation control method for conveying the sheet P separated into the one sheet and fed from the large capacity sheet feeding unit 5 can be classified into following 5 conveyance types. Namely, when the leading edge of the first sheet P1 in the intermediate conveying unit 4 is brought away by a rotation of the sheet feeding roller 111 on a side of the mimeographic printing apparatus 100, a control operation for determining the start timing of a conveying operation for the second sheet P2 is executed. In the first embodiment of the present invention, only one sheet P is sequentially conveyed because the intermediate sheet conveying path 18 is relatively short. However, there is no need to say, when an intermediate sheet conveying path of the intermediate conveying section is long, a conveying operation can be executed for the number of the sheets depending on the length of the intermediate sheet conveying path on which the sheet P is mounted. The relationship between the conveyance type and the state of the sensors is as follows.

Conveyance Type 1: Eighth to First Sensors 50-8 to 50-1: ON

Conveyance Type 2: Eighth to Second Sensors 50-8 to 50-2: ON

Conveyance Type 3: Eighth to Third Sensors 50-8 to 50-3: ON

Conveyance Type 4: Eighth to Fourth Sensors 50-8 to 50-4: ON

Conveyance Type 5: Eighth to Fifth Sensors 50-8 to 50-5: ON

Figure 17:
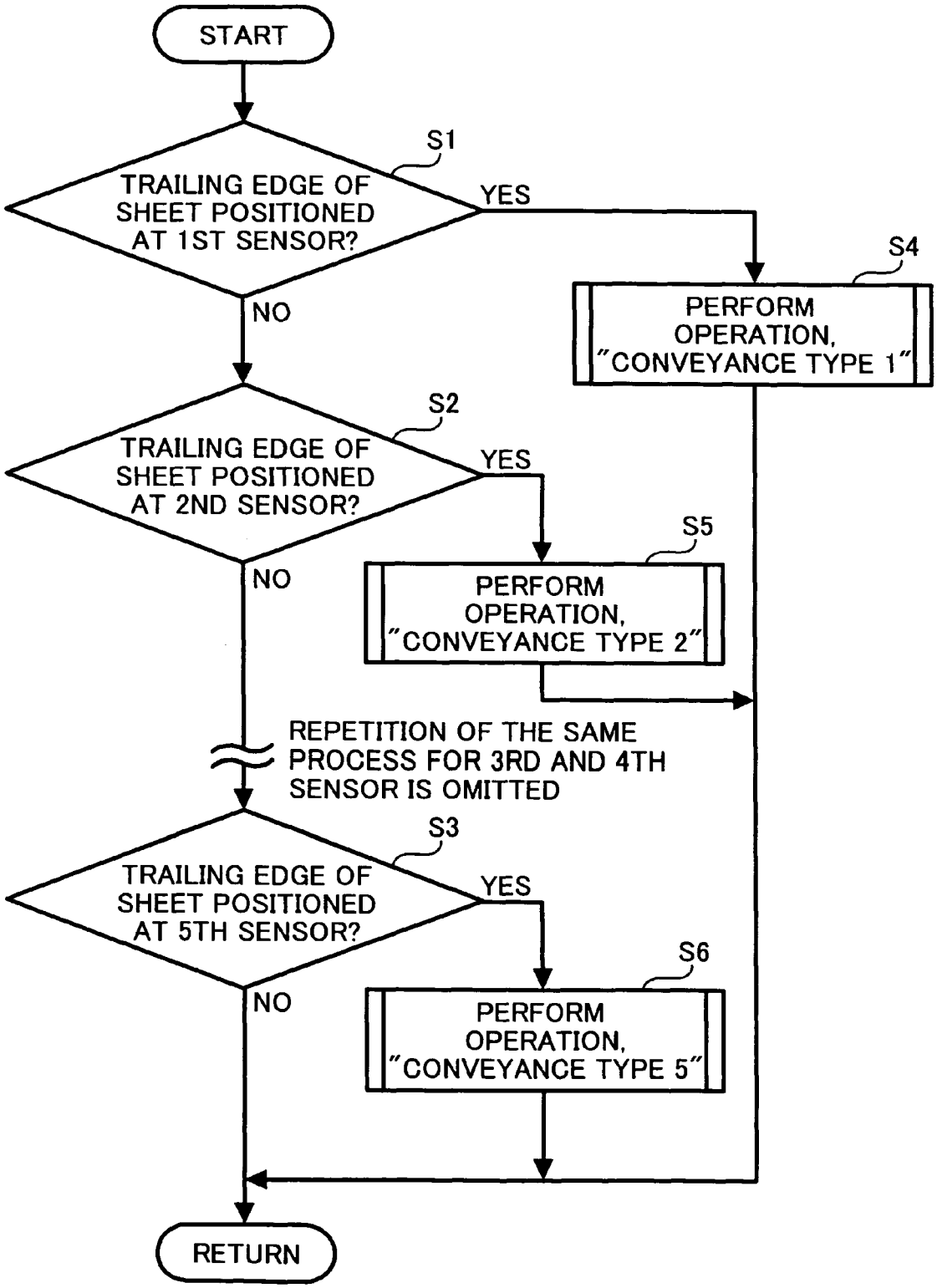
FIG. 17 is a flowchart relevant to a switching operation for the conveyance control of the aforementioned embodiment of the present invention, which is called out after a reset operation is completed.

A flowchart in FIG. 17 illustrates a conveyance operation control process relevant to the conveyance type 1 to the conveyance type 5 that is called from the ROM 89 by the controller 85 (CPU 86) after completing the reset operation.

First, the controller judges whether the trailing edge of one sheet P is positioned at the first sensor 50-1 at a reset time in Step S1. If the trailing edge of the sheet P is positioned at the first sensor 50-1 (Yes in Step S1, and the first sensor 50-1 is turned on), the program proceeds to Step S4 and a sub-routine program of the sheet conveying operation control relevant to the conveyance type 1 is executed in Step S4. If the trailing edge of the sheet P is not positioned at the first sensor 50-1 (No, in Step S1, and the first sensor 50-1 is turned off), then the program proceeds to Step S2 and the controller judges whether the trailing edge of the sheet P is positioned at the second sensor 50-2 in Step S2.

If the trailing edge of the sheet P is positioned at the second sensor 50-2 (Yes, in Step S2), the program proceeds to Step S5, and the sub-routine program for the sheet conveying operation control relevant to the conveyance type 2 is executed in Step S5. If the trailing edge of the sheet P is not positioned at the second sensor 50-2 (No, in Step S2), then the controller judges whether the trailing edge of the sheet P is positioned at the third sensor 50-3. Hereinafter, a similar explanation will be repeated, and to avoid redundancy and repetition of the words, the explanation for the rest of the conveyance type will be omitted.

Next, referring now to the table in FIG. 16, sheet conveyance states in FIGS. 18, 19A and 19B, flowcharts in FIGS. 20 to 23, and the timing chart in FIG. 24, an example of the sheet conveying operation control executed under the control of the controller 85 will be described in detail. The sheet conveying operation control is, for example, the conveyance type 3 and the printing speed is any one of 16, or 30 to 120 rpm and the sheet size is short, i.e., A4Y, B5Y, or Letter Y illustrated in FIG. 16.

Figure 22:
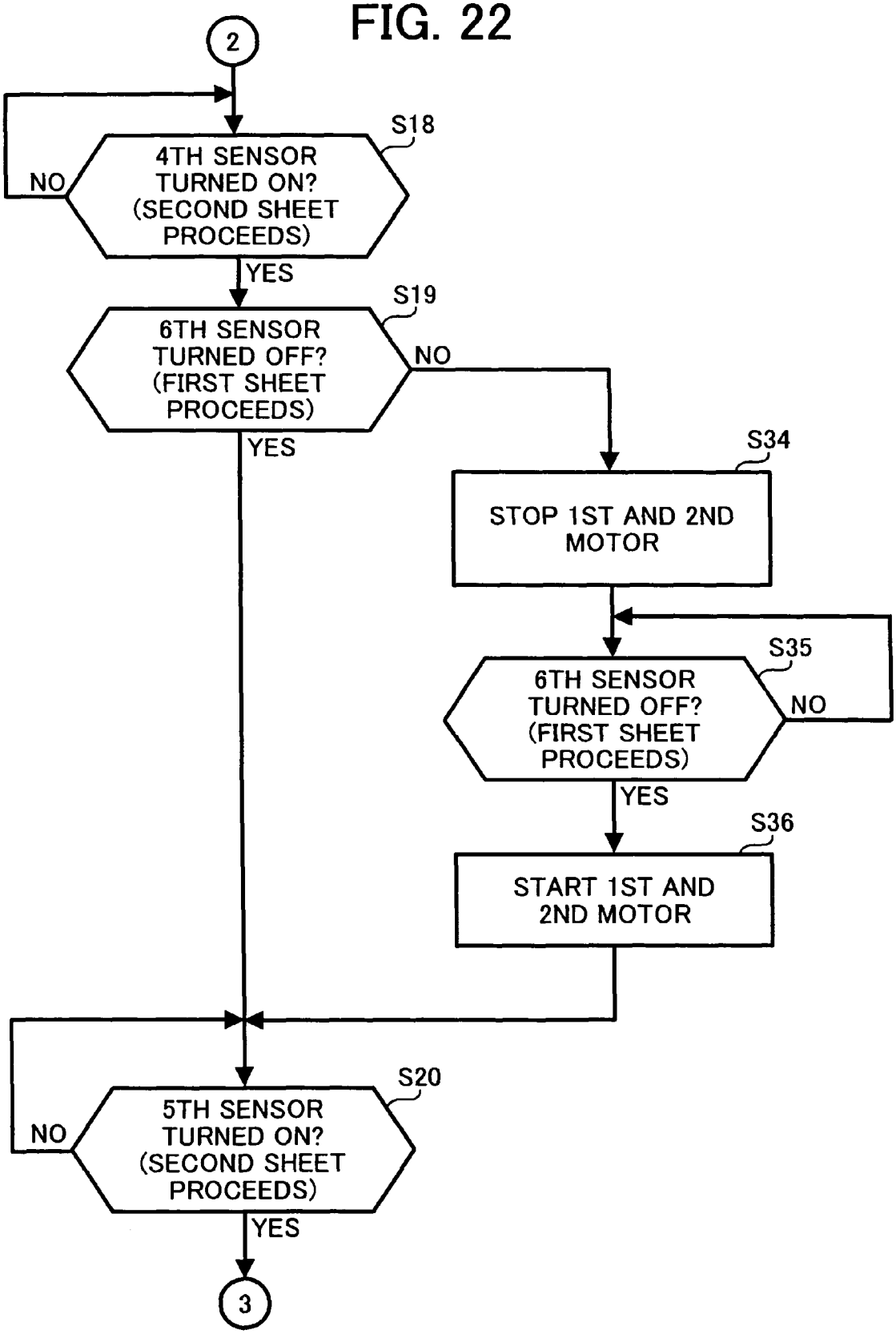
FIG. 22 is a flowchart to be connected to the flowchart in FIG. 21.
Figure 23:
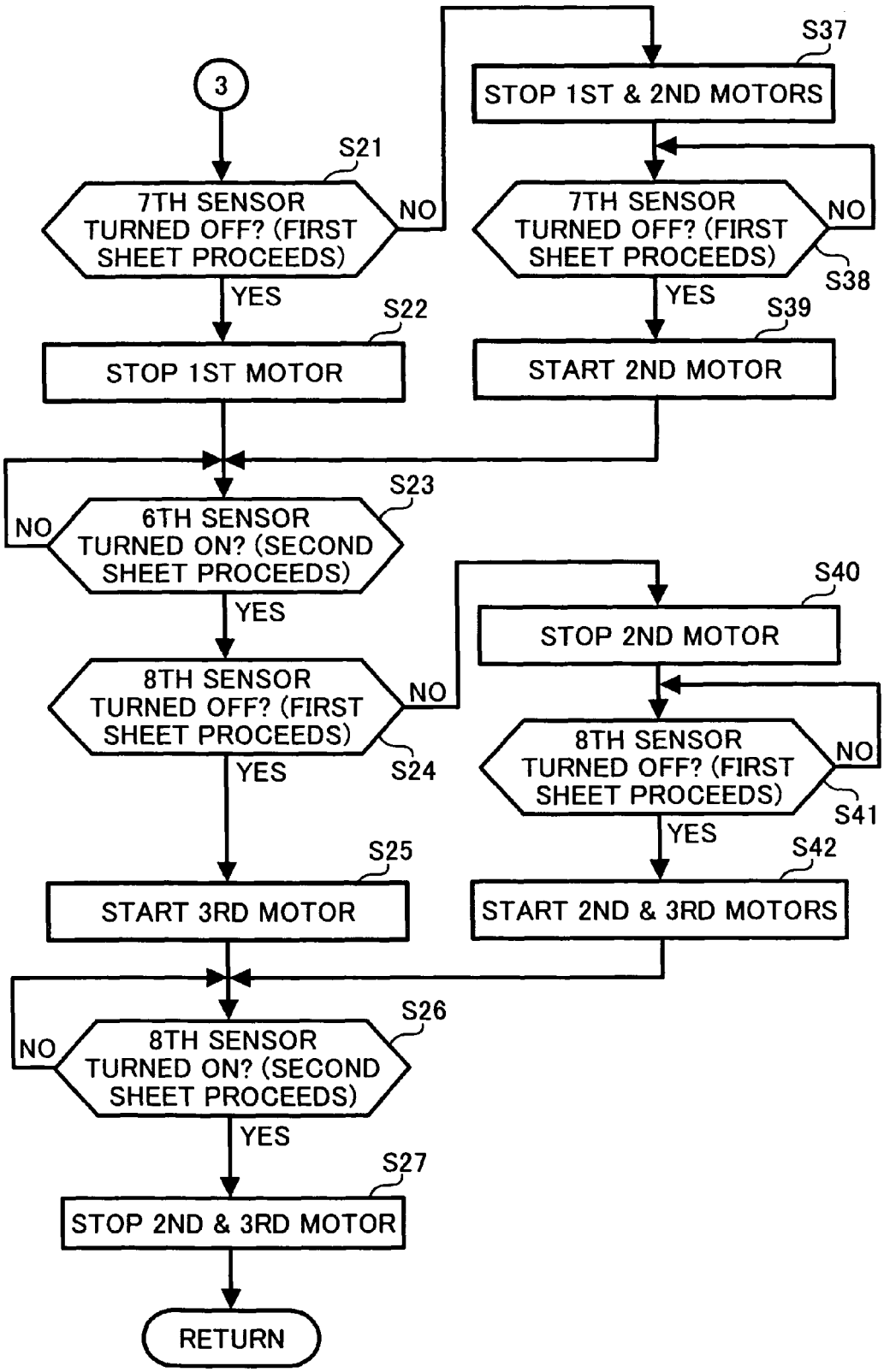
FIG. 23 is a flowchart to be connected to the flowchart in FIG. 22.
Figure 24:
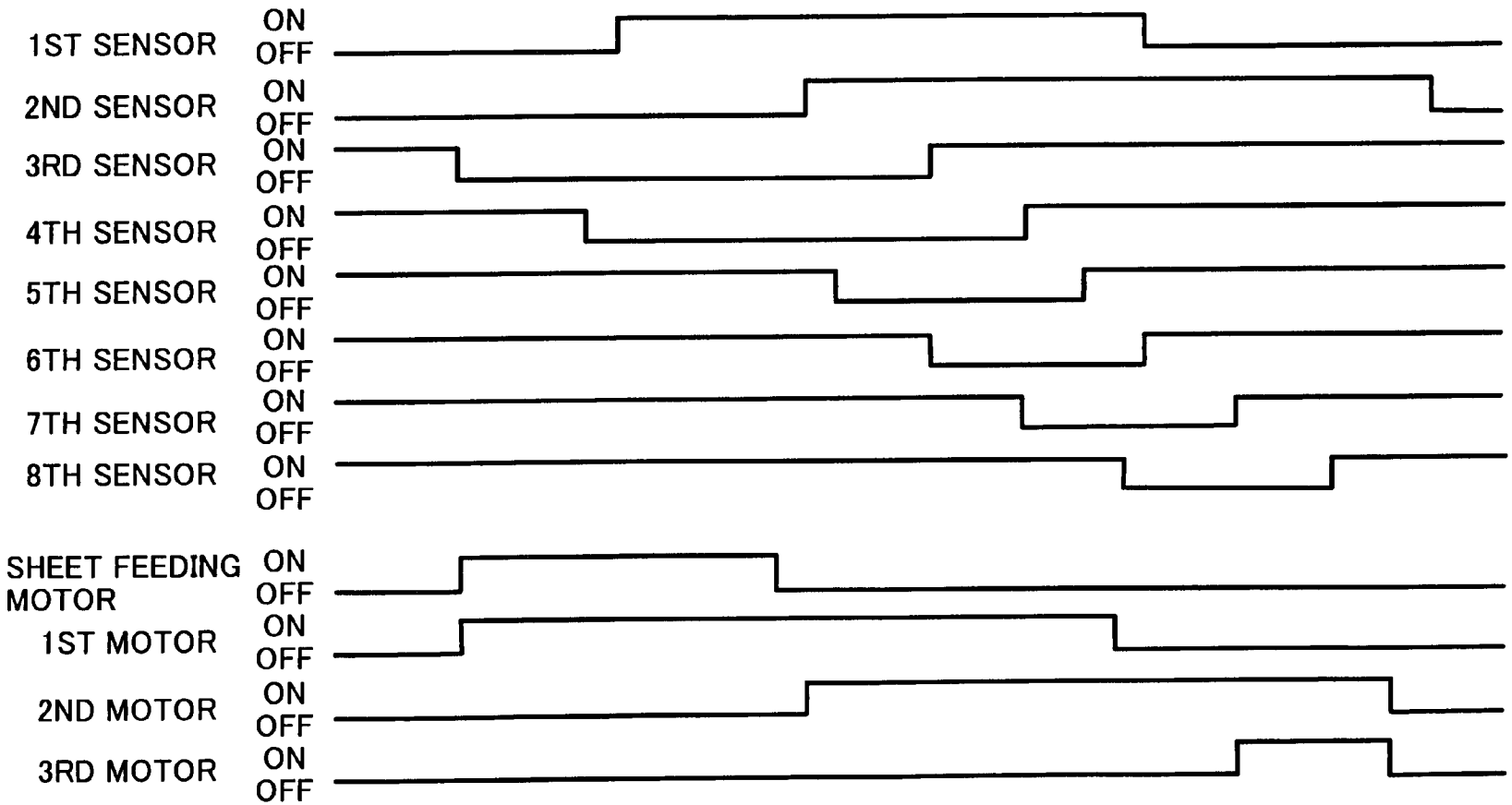
FIG. 24 is a basic timing chart of the sheet conveyance control operation relevant to the conveyance type 3 of the aforementioned embodiment of the present invention.

FIG. 24 illustrates an example of a timing chart relevant to the turning on/off of the first to the eight sensors, 50-1 to 50-8 and the turning on/off of the sheet feeding motor 22, and the first to the third motors, 33-1 to 33-3, in a case that the leading edge of the second sheet P2 has not reached the trailing edge of the first sheet P1 in the sheet conveying operation control illustrated in FIGS. 18 to 23.

Figure 20:
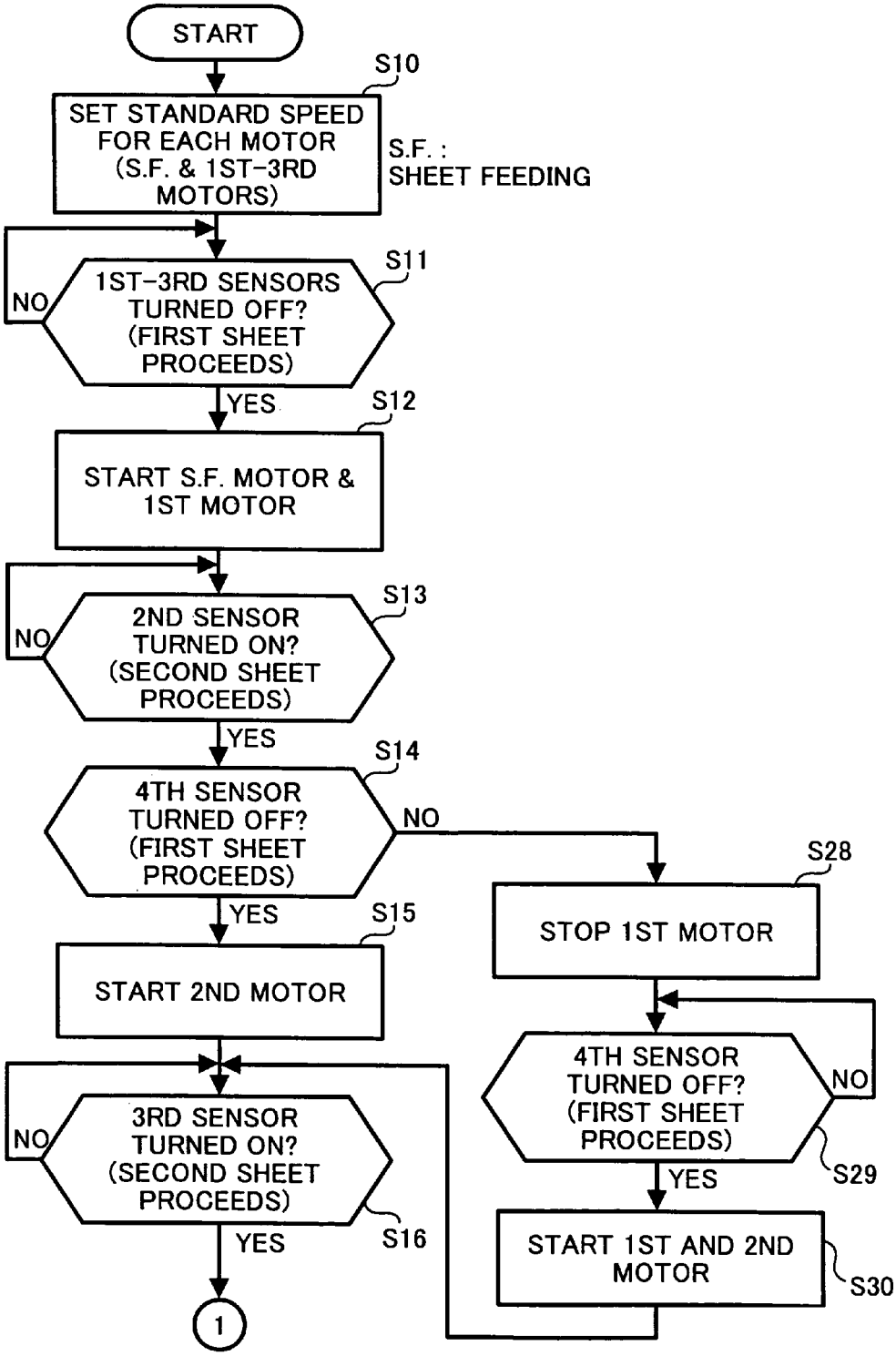
FIG. 20 is a flowchart explaining the sheet conveyance control operation relevant to a conveyance type 3 of the aforementioned embodiment of the present invention.

The flowchart in FIG. 20 starts from Step S10. First, in Step S10, each motor speed is previously set as a default configuration. The default configuration of each of the motor speeds in this case means that, regardless of the printing speed on a side of the mimeographic printing apparatus 100, the sheet feeding motor 22 is controlled by a command of the controller 85, such that the sheet feeding roller 11 and the separation roller 12 pick up the topmost sheet on the large capacity sheet feeding tray 10 and separate and convey the same in the sheet conveying speed corresponding to the top printing speed on a side of the mimeographic printing apparatus 100 (in the first embodiment of the present invention, 120 sheets/minute: 120 rpm).

Further, the default configuration of each of the motor speeds in this case also means that the each of the first to the third motors, 33-1 to 33-3 is controlled by a command of the controller 85, such that each of the first to the third conveying rollers, 32-1 to 32-3 conveys the sheet P that is fed from the sheet feeding mechanism 3.

The sheet conveying speed is set corresponding to the top printing speed 120 rpm (i.e., 1130 mm/sec converted to the sheet conveying speed) by the printing drum 115. (In the first embodiment of the present invention, the sheet conveying speed is set to 1370 mm/sec, a little faster than 1130 mm/sec.) The sheet feeding motor is controlled by a controller (not illustrated) on a side of the mimeographic printing apparatus 100 such that the sheet feeding speed of the main body sheet feeding roller 111 and the main body separation roller 112 on a side of the mimeographic printing apparatus 100 is also configured to, as mentioned above (1272 mm/sec in the first embodiment of the present invention).

As illustrated in FIG. 16, a position of a trailing edge of the initial sheet at the conveyance type 3 for the sheet of short length is placed between the third sensor 50-3 and the second sensor 50-2 and second sheet is loaded when the third sensor 50-3 is turned off.

Figure 18:
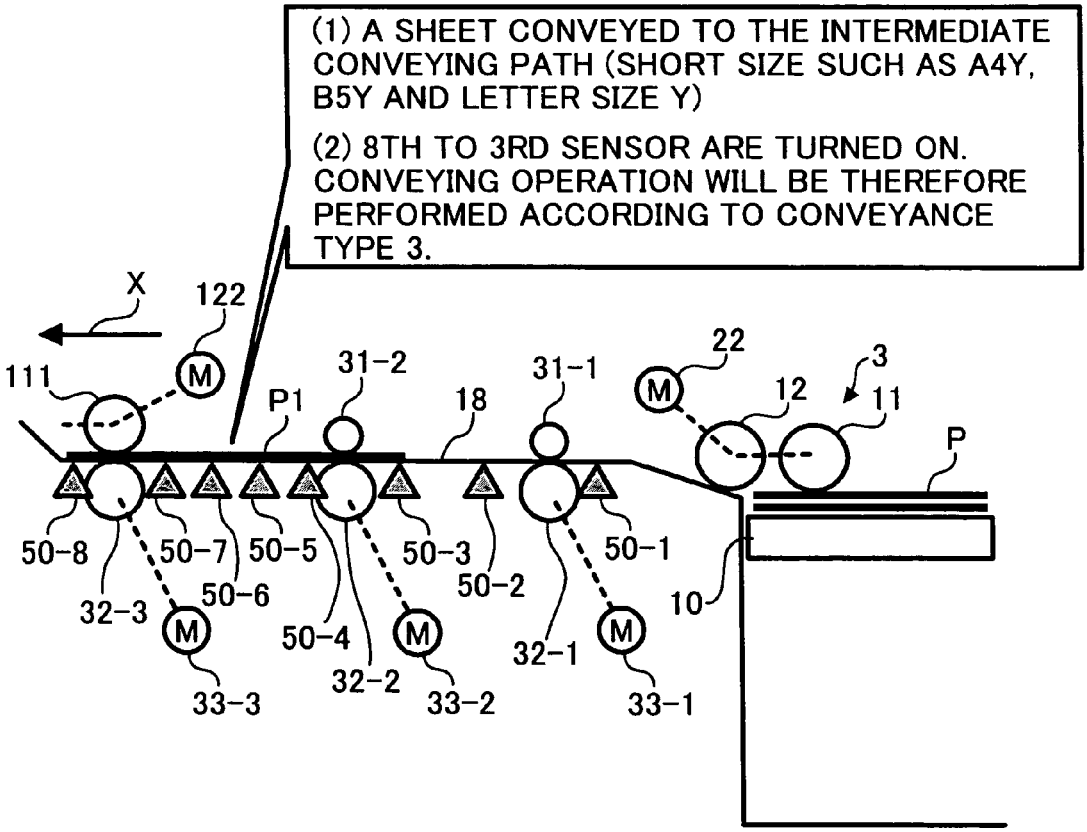
FIG. 18 is an elevation illustrating a state of a sheet on the intermediate conveying device of the aforementioned embodiment of the present invention after the reset operation is completed in a case when the sheet length is short.

FIG. 18 illustrates the one sheet of the first sheet P1 that is a topmost sheet on the large capacity sheet feeding tray 10 and is separated, picked up, fed and conveyed onto the intermediate sheet conveying path 18 in which the reset operation is completed. The reset and stopping state of the first sheet P1 shows the conveyance type 3 in which the eighth sensor 50-8 to the third sensor 50-3 are turned on and the conveying operation is controlled as the conveyance type 3.

Figure 19A:
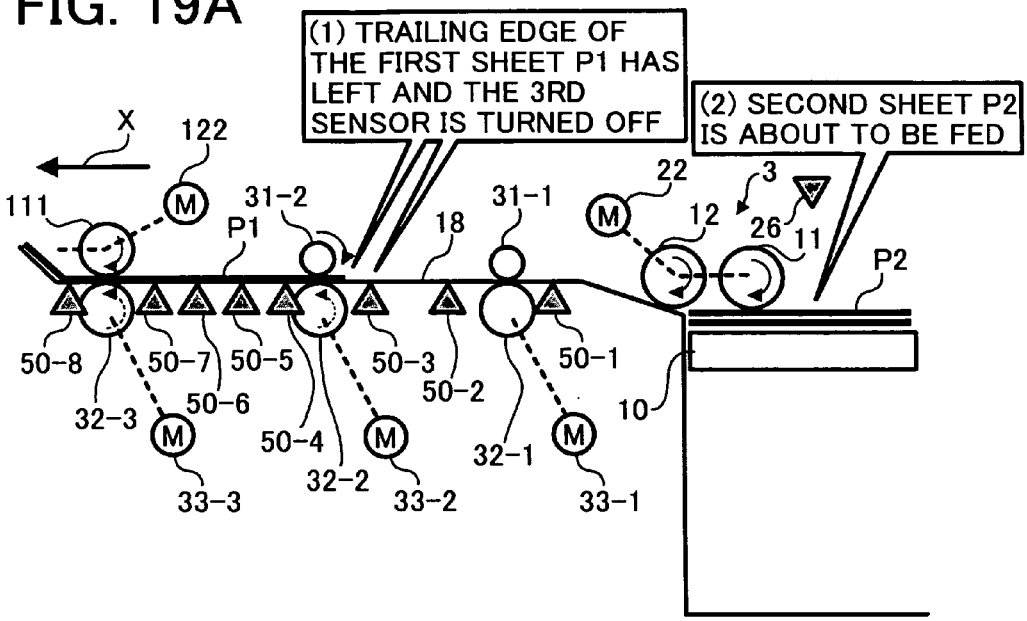
FIG. 19A is an elevation explaining a transition of a sheet conveyance for a first sheet and a second sheet after the state in FIG. 18, and a control operation therefor.

First, the first sheet P1 proceeds from the state illustrated in FIG. 18 in which the first sheet P1 is at a reset position, to the state illustrated in FIG. 19A. That is, by a starting operation of the sheet feeding motor 122 on a side of the mimeographic printing apparatus 100, the main body sheet feeding roller 111 starts to rotate at a constant speed in a clockwise direction (at a circumferential speed of the main body sheet feeding roller 111 corresponding to the top printing speed 120 rpm of the printing drum 115 as stated above, namely, the sheet conveying speed).

As a result, the first sheet P1 nipped between the main body sheet feeding roller 111 and the third conveying roller 32-3 is loaded and conveyed to the main body sheet feeding section 104. At this time, because the third conveying roller 32-3 receives proper sheet feeding pressure from the main body sheet feeding roller 111, the third conveying roller 32-3 is driven and start to rotate by friction force of the first sheet P1 to a high friction face (rubber face) of a circumferential face of the third conveying roller 32-3 in response to the movement of the first sheet P1 in a counterclockwise direction indicated by a broken line in FIG. 19A. The load of the third motor 33-3 is slight enough to be almost ignored by an effect of the one-way clutch 61 embedded into the shaft portion of the third conveying roller 32-3.

Hereinafter, with respect to the rotation of the main body sheet feeding roller 111, each of the fist to the third conveying rollers, 32-1 to 32-3, the main body separation roller 112, and the sheet feeding roller 11, the solid line indicates the own rotation and the broken line indicates driven rotation.

Thus, when the first sheet P1 proceeds to a side of the mimeographic printing apparatus 100, the controller judges whether the trailing edge of the first sheet P1 has passed through the third sensor 50-3 and whether all of the third sensor to the first sensor 50-3 to 50-1 are turned off in Step S11. That is, the second sheet loading sensor illustrated in FIG. 16 is checked. If the third sensor 50-3 that serves as the second sheet loading sensor is turned off (Yes in Step S11), then the sheet feeding motor 22 starts (in Step S12) and the sheet feeding roller 11 and the separation roller 12 thereby start rotation in a clockwise direction.

As a result, the second sheet P2 is separated from the sheets stacked in the sheet feeding mechanism 3 and starts to be conveyed toward the intermediate sheet conveying path 18. In this case, the leading edge of the second sheet P2 is detected by the first sensor 50-1.

At the same time, the first motor 33-1 starts and thereby, the first conveying roller 32-1 starts rotation in a counterclockwise direction. Consequently, the second sheet P2 is conveyed to a downstream side of the sheet conveying direction X being nipped between the first conveying roller 32-1 and the first pressure roller 31-1. The sheet feeding motor 22 automatically stops after delivering the leading edge of the second sheet P2 to the first conveying roller 32-1 via the sheet feeding roller 11 and the separation roller 12 (See Step S12).

On the other hand, if the third sensor 50-3 remains turned on (No, in Step S11), the aforementioned judging process is repeated until the third sensor 50-3 becomes turned off.

Next, the controller judges whether the second sensor 50-2 is turned on by detecting a leading edge of the second sheet P2, (in Step S13).

If the leading edge of the second sheet P2 does not reach the second sensor 50-2 and the second sensor 50-2 thereby remains turned off (No, in Step S13), the aforementioned judging process is repeated until the second sensor 50-2 becomes turned on (in Step S13). (Hereinafter, a repetition of the explanation for such a flowchart is omitted because of obviousness.) If the second sensor 50-2 is turned on (Yes, in Step S13), the program proceeds to Step S14.

In Step S14, the controller judges whether the first sheet P1 is conveyed and the trailing edge of the first sheet P1 has passed through the fourth sensor 50-4 and the fourth sensor 50-4 is turned off. If the fourth sensor 50-4 is turned off (Yes, in Step S14), then the program proceeds to Step S15 and the second motor 33-2 starts to rotate. At this moment, if the fourth sensor 50-4 remains turned on (No, in Step S14), the program proceeds to Step S28 and a rotation of the first motor 33-1 is stopped, because the trailing edge of the first sheet P1 is judged to remain on the fourth sensor 50-4. Then, the third sensor 50-3 is turned off and the trailing edge of the first sheet P1 has passed through the third sensor 50-3, however, the fourth sensor 50-4 remains turned on and the trailing edge of the first sheet P1 is remaining on the fourth sensor 50-4.

Therefore, the leading edge of the second sheet P2 cannot be conveyed to the third sensor 50-3. Namely, until both of the two sensors, i.e., the third sensor 50-3 and the fourth sensor 50-4, located between the trailing edge of the first sheet P1 and the leading edge of the second sheet P2 are turned off, the controller controls the sheet conveying operation, such that the second sheet P2 is stopped on the intermediate sheet conveying path 18 (Step S28).

In other words, if the trailing edge of the first sheet P1 remains on the fourth sensor 50-4 (No, in Step S14), the first motor 33-1 is stopped so that the leading edge of the second sheet P2 does not proceed to the third sensor 50-3 (See Step S28).

Then, the controller judges whether the fourth sensor 50-4 is turned off because the first sheet P1 start to proceed (in Step S29). If the fourth sensor 50-4 is turned off (Yes, in Step S29), program proceeds to Step S30 and starts both of the first motor 330-14 and the second motor 33-2 (See, Step S30).

The aforementioned Steps, S13 to S15 and S28 to S30 are a basic pattern for checking conveying position of both of the trailing edge of the first sheet P1 and the leading edge of the second sheet P2. The following operation is substantially the repetition of the same basic pattern as mentioned above.

Next, in Step S16, the controller judges whether the second sheet P2 is conveyed and the third sensor 50-3 is turned on. If the second sheet P2 is conveyed and third sensor 50-3 is turned on by reaching of the leading edge of the second sheet P2 (Yes, in Step S16), the program proceeds to Step S17 in FIG. 21. Then, the controller judges whether the first sheet P1 is conveyed and the fifth sensor 50-5 is turned off (in Step S17).

If the trailing edge of the first sheet P1 has passed through the fifth sensor 50-5, and the fifth sensor 50-5 is turned off (Yes, in Step S17), the program proceeds to Step S18 in FIG. 22. In Step S18, controller judges whether the fourth sensor 50-4 is turned on by reaching of the leading edge of the second sheet P2 (in Step S18). At this moment, if the answer is Yes and the fourth sensor 50-4 is turned on by reaching of the leading edge of the second sheet P2, the program proceeds to Step S19.

In Step S19, the controller judges whether the trailing edge of the first sheet P1 has passed through the sixth sensor 50-6 and the sixth sensor 50-6 is turned off. If the answer is Yes, and the trailing edge of the first sheet P1 has passed through the sixth sensor 50-6, the program proceeds to Step S20. The controller judges whether the second sheet P2 is conveyed and the leading edge of the second sheet P2 has reached the fifth sensor 50-5, and the fifth sensor 50-5 is thereby turned on (in Step S20).

On the other hand, if the first sheet P1 is not conveyed and the trailing edge of the first sheet P1 remains on the fifth sensor 50-5 (No, in Step S17), namely, the fifth sensor 50-5 remains turned on, both of the first motor 33-1 and the second motor 33-2 are stopped so that the second sheet P2 does not proceed (in Step S31).

Figure 21:
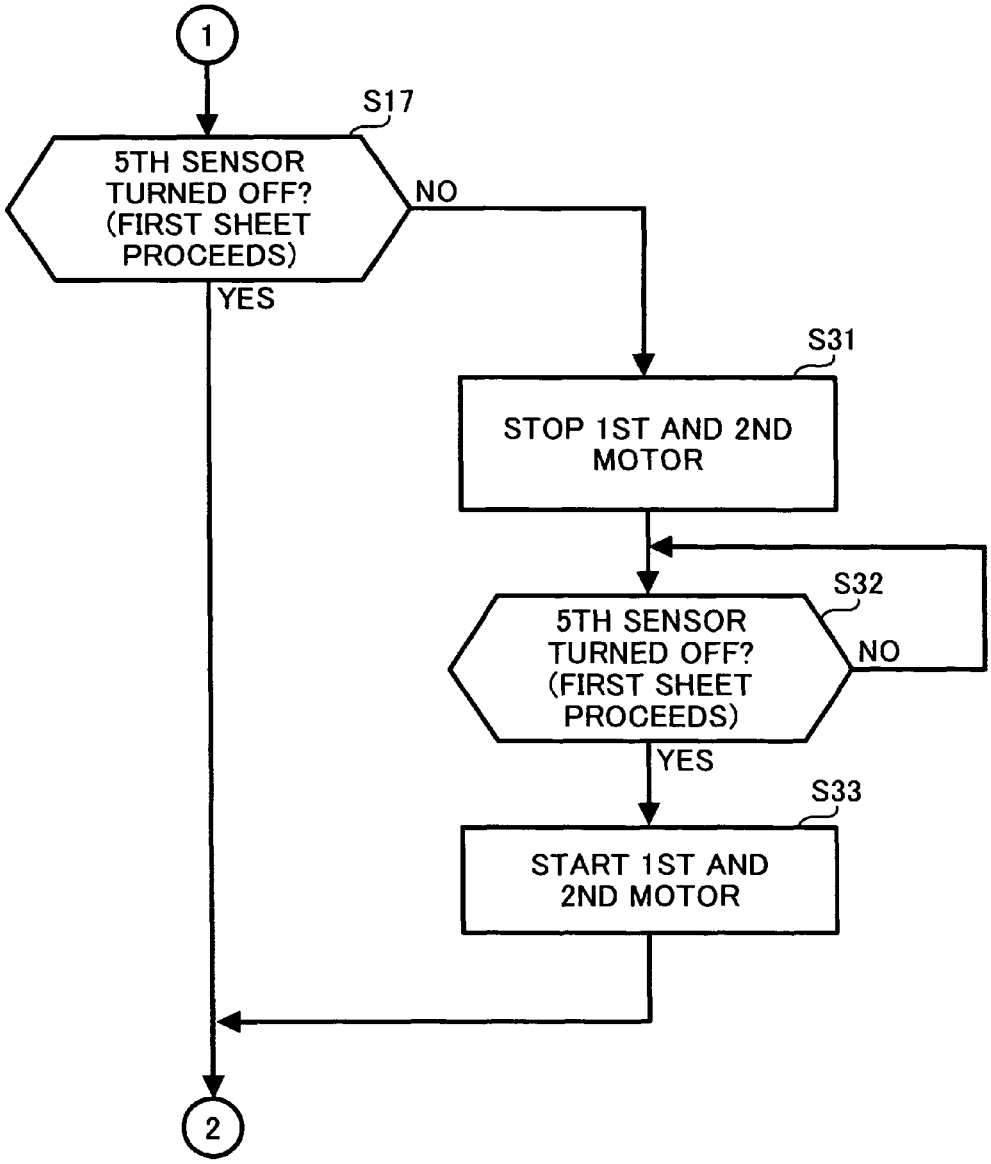
FIG. 21 is a flowchart to be connected to the flowchart in FIG. 20.

Next, the controller judges whether the first sheet P1 starts to proceed and the fifth sensor 50-5 is turned off (in Step S32 in FIG. 21). If the fifth sensor 50-5 is turned off (Yes, in Step S32), then the program proceeds to Step S33 and starts the first motor 33-1 and the second motor 33-2 again so that the first conveying roller 32-1 and the second conveying roller 32-2 rotate. As a result, the second sheet P2 is conveyed and the program proceeds to Step S18 in FIG. 22.

Figure 19B:
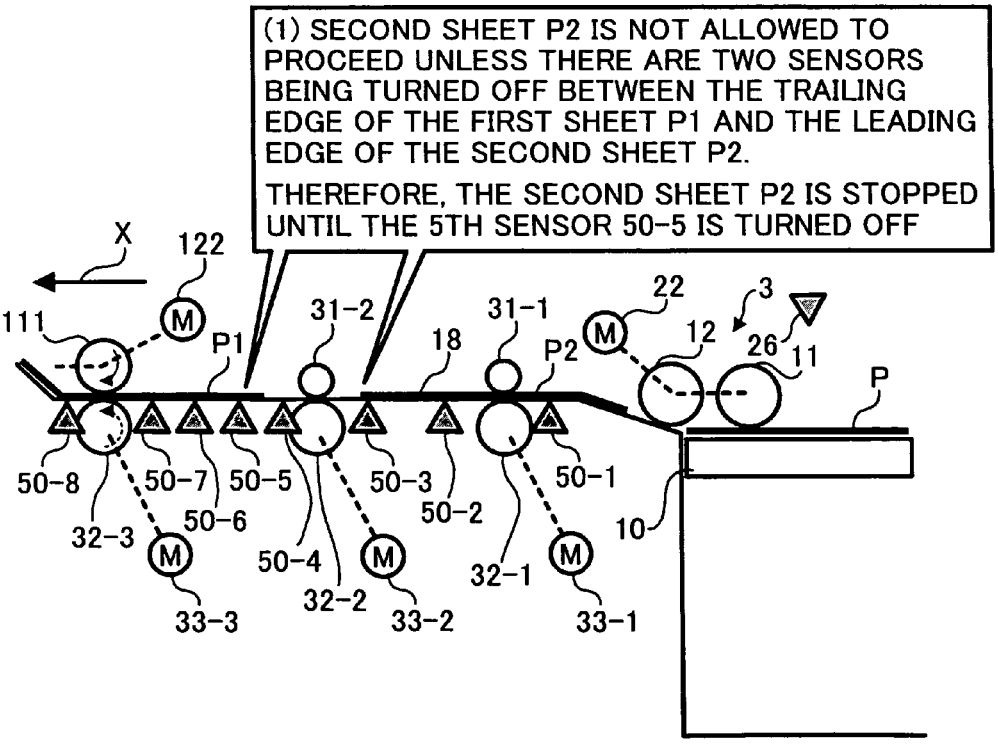
FIG. 19B is an elevation explaining the transition of the sheet conveyance for the first sheet and the second sheet after the state in FIG. 19A, and the control operation therefor.

The operations explained in Steps S14 through S17 and in Steps S28 through S30 are illustrated in FIG. 19B. The second sheet P2 is conveyed through the intermediate sheet conveying path 18 while the position of the trailing edge of the first sheet P1 is detected by two of the fourth sensor 50-4 and the fifth sensor 50-5. In the case mentioned above, the leading edge of the second sheet P2 has reached the third sensor 50-3 and thereby the third sensor 50-3 is turned on, and the trailing edge of the first sheet P1 remains on the fifth sensor 50-5 and thereby the fifth sensor 50-5 is turned on (not off).

As a result, the conveying operation is controlled so that the second sheet P2 is stopped at a position illustrated in FIG. 19B until both of the sensors, the fourth sensor 50-4 and the fifth sensor 50-5, which are located between the trailing edge of the running first sheet P1 and the leading edge of the second sheet P2, are turned off.

On the other hand, if the sixth sensor 50-6 remains being turned on (No, in Step S19) in FIG. 22, namely, the first sheet P1 is not conveyed and the trailing edge of the first sheet P1 remains on the sixth sensor 50-6, a rotation of both of the first motor 33-1 and the second motor 33-2 are once stopped so that the second sheet P2 does not proceed (See Step S34).

Next, the program proceeds to Step S35 and the controller judges whether the first sheet P1 is conveyed and the trailing edge of the first sheet P1 has passed through the sixth sensor 50-6 (in Step S35). If the trailing edge of the first sheet P1 has passed through the sixth sensor 50-6 (Yes, in Step S35), then the program proceeds to Step S36, and the first motor 33-1 and the second motor 33-2 rotate so that the first conveying roller 32-1 and the second conveying roller 32-2 rotate (in Step S36).

Next, program proceeds to Step S21 in FIG. 23. Then, the controller judges whether the seventh sensor 50-7 is turned off because the trailing edge of the first sheet P1 has passed through the seventh sensor 50-7. If the seventh sensor 50-7 is turned off (Yes, in Step S21), program proceeds to Step S22 and once stops the first motor 33-1. This is because, the leading edge of the second sheet P2 has already reached the second conveying roller 32-2 and is passing therethrough, and the first motor 33-1 is stopped so that the second conveying roller 32-2 is stopped.

On the other hand, in Step S21, if the seventh sensor 50-7 remains turned on, namely, the first sheet P1 is not conveyed and the trailing edge of the first sheet P1 remains on the seventh sensor 50-7, the program proceeds to Step S37 and both of the first motor 33-1 and the second motor 33-2 are stopped in Step S37, so that the second sheet does not proceed.

Then, the program proceeds to Step S38 and the controller judges whether the seventh sensor 50-7 is turned off. If the seventh sensor 50-7 is turned off, namely, the first sheet P1 is conveyed and the trailing edge of the first sheet P1 has passed through the seventh sensor 50-7 (Yes, in Step S38), the program proceeds to Step S38, and the second motor 33-2 starts to rotate so that only the second conveying roller 32-2 rotates.

Then, the program proceeds to Step S23 and the controller judges whether the sixth sensor 50-6 is turned on, namely the second sheet P2 is conveyed and the leading edge of the second sheet P2 has reached the sixth sensor 50-6. If the sixth sensor 50-6 is turned on (Yes, in Step S23), then, the program proceeds to Step S24 and the controller judges whether the eighth sensor 50-8 is turned off, namely, the first sheet P1 is conveyed and the trailing edge of the first sheet P1 has passed through the eighth sensor 50-8. If the eighth sensor 50-8 is turned off, the program proceeds to Step S25 and the third motor starts to rotate so that the third conveying roller 32-3 rotates.

On the other hand, if the eighth sensor 50-8 remains turned on in Step S24, namely, if the first sheet P1 is not conveyed and the trailing edge of the first sheet P1 remains on the eighth sensor 50-8, the program proceeds to Step S40 and the second motor 33-2 is once stopped. Then the program proceeds to Step S41 and the controller judges whether the eighth sensor 50-8 is turned off. If the first sheet P1 is conveyed and the trailing edge of the first sheet P1 has passed through the eighth sensor 50-8, namely, if the eighth sensor 50-8 is turned off (Yes, in Step S41), both of the second motor 33-2 and the third motor 33-3 start rotation so that the second conveying roller 32-2 and the third conveying roller 32-3 rotate (in Step S42).

Next, the program proceeds to Step S26 and the controller judges whether the eighth sensor 50-8 is turned on, namely, the second sheet P2 is conveyed. If the second sheet P2 is conveyed and the leading edge of the second sheet P2 reaches the eighth sensor 50-8, resulting in turning on of the eighth sensor 50-8, the program proceeds to Step S27. Then, both of the second motor 33-2 and the third motor 33-3 is stopped (in Step S27).

Thus, when the first sheet P1 is conveyed to the printing section 102 of the mimeographic printing apparatus 100 and the first sheet P1 has thereby completely left from the intermediate conveying unit 4, the second sheet P2 remains stopping at the reset position until the second sheet P2 is conveyed into the printing section 102 of the mimeographic printing apparatus 100 by the rotation drive of the main body sheet feeding roller 111, in the same manner as illustrated in FIG. 18.

The aforementioned sequential controlling operation explained in each of the steps from Step S11 through Step S27 in the flowcharts in FIGS. 20 through 23 describes a case of conveying the sheets in which the leading edge of the second sheet P2 does not reach the trailing edge of the first sheet P1. Further, each of the controlling operation explained in the steps from Step S28 to Step S30, from Step S31 through Step 33, from Step 34 to Step S36, from Step S37 to Step S39, and from Step S40 to Step S42 in the flowcharts in FIGS. 20 to 23 describes a case of conveying the sheets in which the leading edge of the second sheet P2 has reached the trailing edge of the first sheet P1.

As explained referring to FIG. 19B, the sheet conveying operation control is executed by repeating a following routine. After the second sheet P2 that is fed from the large capacity sheet feeding tray 10 starts to be conveyed, (1) The controller judges whether several sensors 50-*n* to 50-*p* (n and p varies depending on the sheet length) are turned off that represents whether a trailing edge of the first sheet P1 has passed through.

(2) The second sheet P2 can proceed when the trailing edge of the first sheet P1 has passed through a predetermined number of sensors 50-*n* (That is, the first sheet P1 has proceeded) Alternatively, when the first sheet P1 has not proceeded, the second sheet P2 remains stopped until the first sheet P1 proceeds.

(3) When the leading edge of the second sheet P2 reaches the next sensor 50-(*n*+1), then the operation returns to the above item (1). The routine is repeated until the sheet reaches a certain position in the sheet conveying path, namely, a position where the trailing edge of the first sheet P1 passes through the eighth sensor 50-8.

Next, referring now to the table in FIG. 16, a sheet conveying transition in FIGS. 25 and 26, and a timing chart in FIG. 27, an example of the sheet conveying operation control executed by the controller 85 will be explained. For example, a case of the sheet conveying operation control under a condition in which the conveyance type is "Conveyance Type 1", printing speed is any one of 16, or 30 to 120 rpm and the sheet size is a long size of DLY, or A3Y illustrated in FIG. 16 is briefly explained.

Figure 27:
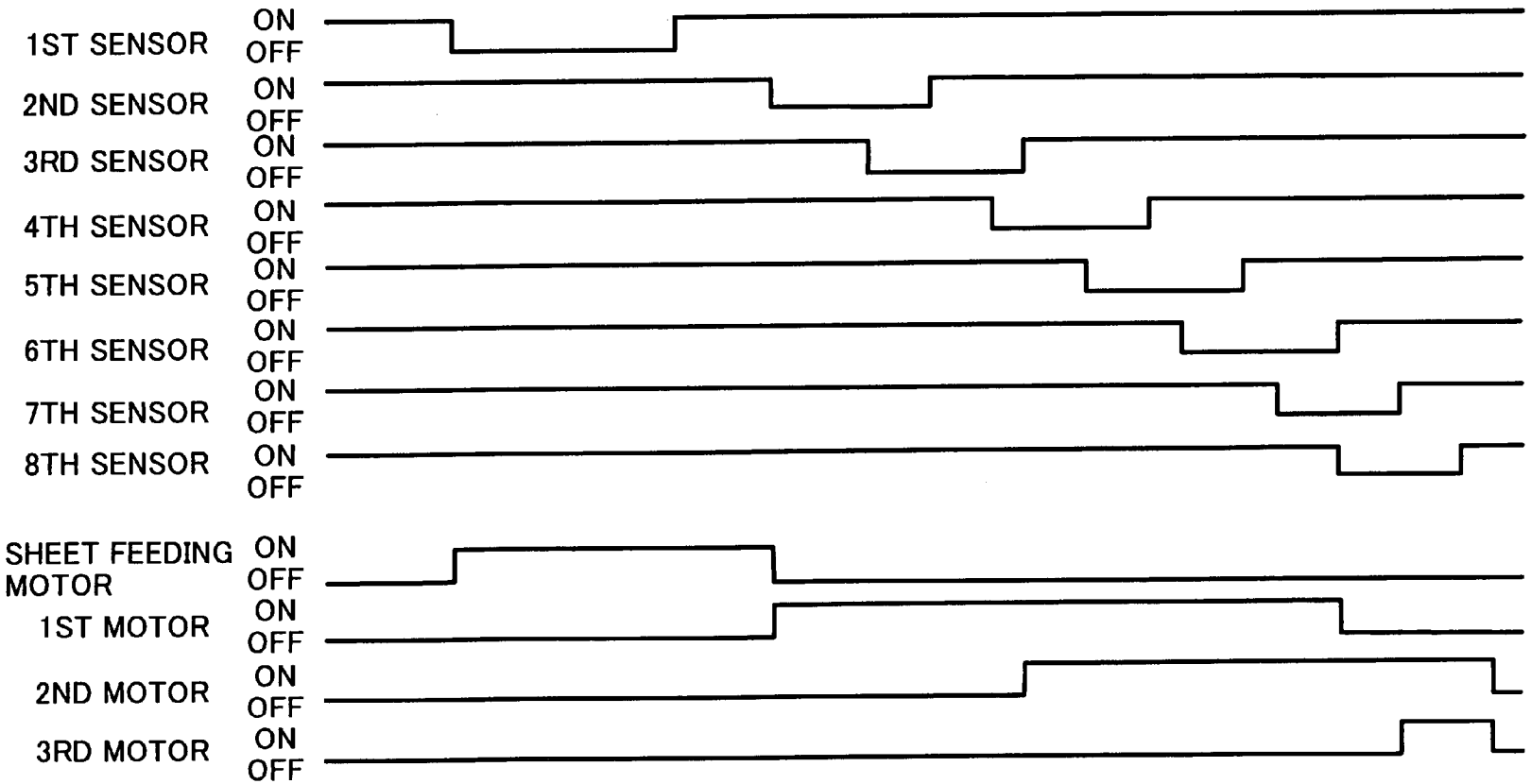
FIG. 27 is a basic timing chart of the sheet conveyance control operation relevant to a conveyance type 1 of the aforementioned embodiment of the present invention.

FIG. 27 illustrates an example of a timing chart relevant to each of turning on and turning off operations of the first sensor 50-1 to eighth sensor 50-8, sheet feeding motor 22, and the first motor 33-1 to the third motor 33-3, in a case when the leading edge of the second sheet P2 does not reach the trailing edge of the first sheet P1 in the sheet conveying operation control that will be explained below.

In an example of the sheet conveying operation control at the conveyance type 1, similar to the aforementioned conveyance type 3, each of the motor speeds is also previously set as a default setting. Regardless of the printing speed on a side of the mimeographic printing apparatus 100, the sheet feeding motor 22 is controlled by the controller 85 such that the sheet feeding roller 11 and the separation roller 12 pick up the topmost sheet of the stacked sheets on the large capacity sheet feeding tray 10 and separate and convey the same at a sheet conveying speed, corresponding to the top printing speed on the side of the mimeographic printing apparatus 100 (120 sheets/min: 120 rpm in the first embodiment of the present invention). In addition, the controller 85 controls each of the first to the third motors, 33-1 to 33-3 such that each of the first to the third conveying rollers, 32-1 to 32-3 conveys the sheet P that is fed from the sheet feeding mechanism 3 at the aforementioned sheet conveying speed.

As illustrated in FIG. 16, a position of the trailing edge of the initial sheet of a long size at the conveyance type 1 is placed between the separation roller 12 and the first sensor 50-1 and the second sheet loading sensor works when the first sensor 50-1 is turned off.

Figure 25:
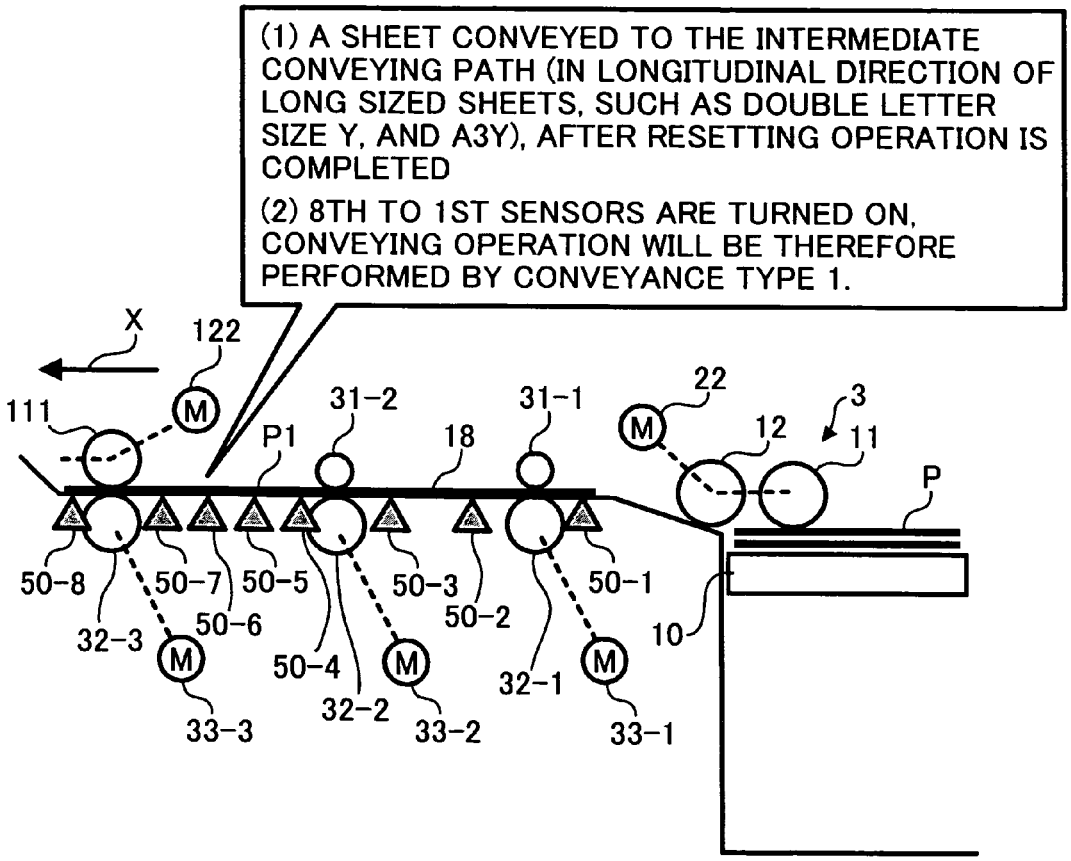
FIG. 25 is an elevation illustrating the sheet on an intermediate sheet conveying path of the aforementioned embodiment of the present invention after the reset operation is completed, in which a sheet size is the longest of the longitudinal direction.

FIG. 25 illustrates the one sheet of the first sheet P1 that is the topmost sheet being stacked on the large capacity sheet feeding tray 10, which is separated from the stacked sheets, conveyed to the intermediate sheet conveying path 18, after the reset operation. A reset and stopped state of the first sheet P1 indicates the conveyance type 1 in which all of the eighth sensor 50-8 to the first sensor 50-1 are turned on, and the sheet conveying operation control is executed on the basis of the conveyance type 1.

Figure 26A:
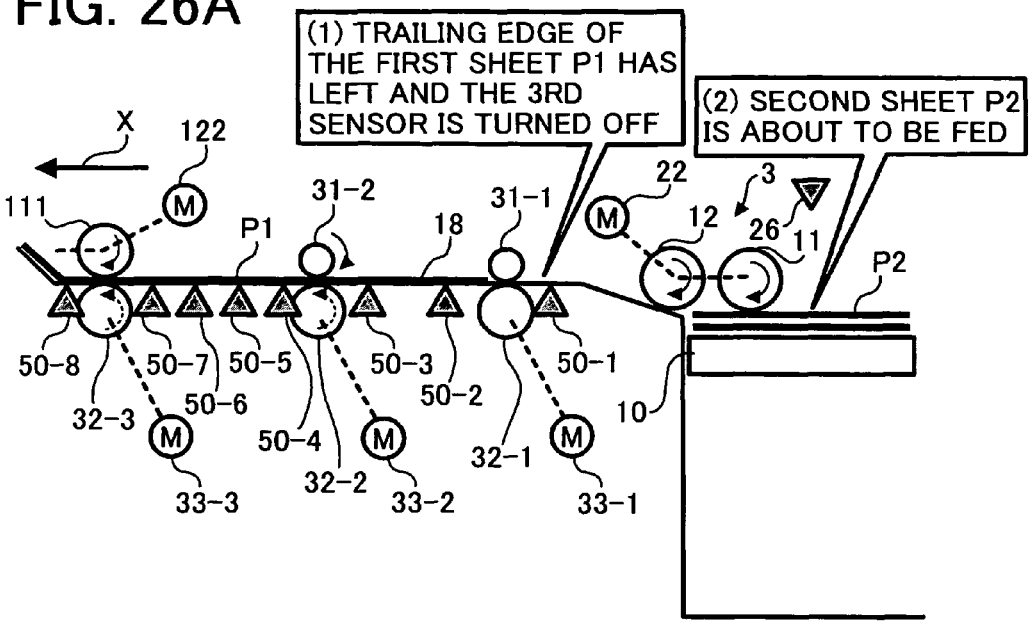
FIG. 26A is an elevation explaining the transition of the sheet conveyance for the first sheet and the second sheet after the state thereof in FIG. 25, and the control operation therefor.

First, the first sheet P1 proceeds from the reset position illustrated in FIG. 25 to the position illustrated in FIG. 26A. That is, the sheet feeding motor 122 on a side of the mimeographic printing apparatus 100 starts and the main body sheet feeding roller 111 thereby starts to be rotated in a clockwise direction at a constant rotation speed, namely, the circumferential speed of the main body sheet feeding roller 111 corresponding to the top printing speed (120 rpm) of the printing drum 115 mentioned earlier that is also the sheet conveying speed.

As a result, the first sheet P1, which is nipped between the main body sheet feeding roller 111 and the third conveying roller 32-3 is conveyed to the main body sheet feeding section 104.

Thus, when the first sheet P1 starts to proceed to a side of the mimeographic printing apparatus 100, the first sensor 50-1 is turned off upon passing of the trailing edge of the first sheet P1. Because the first sensor 50-1 that serves as the second sheet loading sensor is turned off, the sheet feeding motor 22 starts to rotate. The sheet feeding roller 11 and the separation roller 12 thereby start to rotate in a clockwise direction and the second sheet P2 is separated as a sheet and starts to be conveyed to the intermediate sheet conveying path 18. The second sheet P2 starts to be conveyed to the downstream side of the intermediate sheet conveying path 18 and the trailing edge thereof is detected by the first sensor 50-1.

At this moment, the first motor 33-1 starts to rotate at a timing that is illustrated in FIG. 27 and the trailing edge of the second sheet P2 is nipped between the first conveying roller 32-1 and the first pressure roller 31-1. Further, the trailing edge of the second sheet P2 is conveyed until the second sensor 50-2 is turned on. Furthermore, the sheet feeding motor 22 is automatically stopped after driving the sheet feeding roller 11 and the separation roller 12 such that the leading edge of the second sheet P2 is conveyed to the first conveying roller 32-1.

Figure 26B:
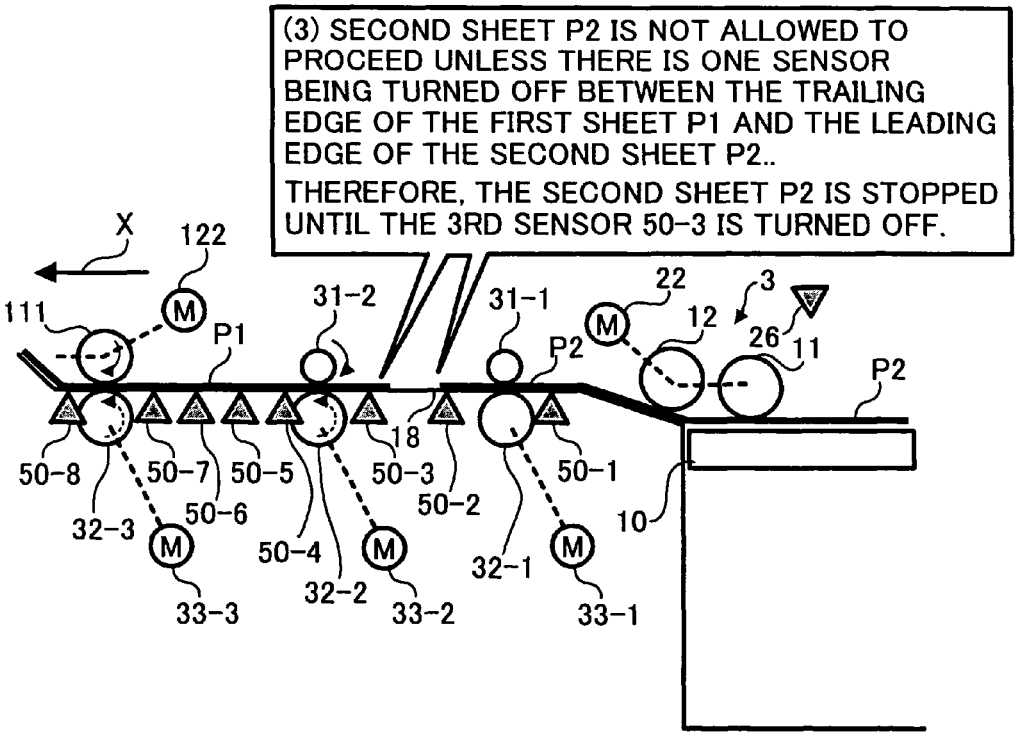
FIG. 26B is an elevation explaining the transition of the sheet conveyance for the first sheet and the second sheet after the state thereof in FIG. 26A, and the control operation therefor.

On the other hand, FIG. 26B illustrates a state of sheet conveying operation in the intermediate sheet conveying path 18. In FIG. 26B, the first sheet P1 is further conveyed to the downstream of the intermediate sheet conveying path 18 in a sheet conveying direction X, and the second sensor 50-2 is turned on by the leading edge of the second sheet P2. Further, even though the trailing edge of the first sheet P1 has passed thorough the second sensor 50-2, the third sensor 50-3 remains turned on upon remaining of the trailing edge of the first sheet P1 on the sensor 50-3. In other words, the leading edge of the second sheet P2 is about to reach the trailing edge of the first sheet P1.

In such a case, when the second sheet P2 is further conveyed toward the third sensor 50-3, the leading edge of the second sheet P2 may contact the trailing edge of the first sheet P1 and either one of the first sheet P1 and the second sheet P2 may be overlapped with another. Consequently, a line between the first sheet P1 and the second sheet P2 cannot be defined and both of the first sheet P1 and the second sheet P2 cannot be distinguished. Therefore, the conveying operation for the second sheet P2 is controlled such that a sensor between the first sheet P1 and the second sheet P2 both of which are being conveyed along the intermediate sheet conveying path 18 is turned off.

In other words, the second sheet P2 is conveyed while checking whether a sensor that is turned off exists between the trailing edge of the first sheet P1 and the leading edge of the second sheet P2, as illustrated in FIG. 26B. In this example, the leading edge of the second sheet P2 is at a position where the second sensor 50-2 is turned on, and the trailing edge of the first sheet P1 is at a position where the third sensor 50-3 is turned on and accordingly, no sensor being turned off exists between the two sheets being conveyed. Therefore, the first motor 33-1 is turned off and the second sheet P2 is stopped at a position indicated by a heavy line in FIG. 26B.

Thereafter, when the first sheet P1 is conveyed to the downstream side of the sheet conveying direction X and the trailing edge of the first sheet P1 passes through the third sensor 50-3, the third sensor 50-3, which is the sensor located between the two sheets being conveyed, is turned off. At this moment, the first motor 33-1 starts again and the second sheet P2 is conveyed until the leading edge of the second sheet P2 turns on the third sensor 50-3.

The controller then judges whether the fourth sensor 50-4 is turned off upon conveying of the first sheet P1, and if the fourth sensor 50-4 remains turned on while the trailing edge of the first sheet P1 remains on the fourth sensor 50-4, in other words, if the leading edge of the second sheet P2 is about to reach the trailing edge of the first sheet P1, the following control is executed in which, the second sheet P2 is conveyed securing one sensor being turned off between the two sheets that are being conveyed. This is because the leading edge of the second sheet P2 cannot be conveyed to the fourth sensor 50-4 in the same reason as mentioned before. That is, the second sheet P2 is conveyed while checking whether one sensor being turned off exists between the trailing edge of the first sheet P1 and the leading edge of the second sheet P2.

In the example, the leading edge of the second sheet P2 is at a position where the third sensor 50-3 is turned on, and the trailing edge of the first sheet P1 is at a position where the fourth sensor 50-4 is turned on and accordingly, no sensor being turned off exists between the two sheets being conveyed. Therefore, the first motor 33-1 is turned off and the second sheet P2 is stopped at a position where the third sensor 50-3 is turned on.

On the other hand, when the trailing edge of the first sheet P1 passes through the fourth sensor 50-4 and the fourth sensor is thereby turned off, the second motor 33-2 is started in a predetermined timing. As a result, one sensor being turned off is secured between the two sheets that are being conveyed. Therefore, the first motor 33-1 is again started and thereby, the second sheet P2 whose leading edge is stopped at a position on the third sensor 50-3 is conveyed while being nipped between the first conveying roller 32-1 and the first pressure roller 31-1. At the same time, the leading edge of the second sheet P2 is conveyed while being nipped between the second conveying roller 32-2 and the second pressure roller 31-2 until the fourth sensor 50-4 is turned on.

The first sheet P1 is further conveyed to the downstream side of the intermediate sheet conveying path 18 in the sheet conveying direction X while the thus explained operation is repeated. When the similar procedure is repeated until the trailing edge of the first sheet P1 passes through the eighth sensor 50-8 and the eighth sensor 50-8 is turned off, the second motor 33-2 is again started at a predetermined timing.

Thereafter, the second sheet P2, which is stopped in a state of turning on the sixth sensor 50-6, is conveyed and the controller judges whether the seventh sensor 50-7 is turned on by the leading edge of the second sheet P2. If the seventh sensor 50-7 is turned on, the third motor 33-3 is started and the sheet conveying operation control is continued until the eighth sensor 50-8 is turned on.

Thus, when the first sheet P1 is conveyed to the printing section 102 of the mimeographic printing apparatus 100 and completely left from the intermediate conveying unit 4, then the second sheet P2 is stopped at the reset position, instead of the first sheet P1, until the second sheet P2 is conveyed to the printing section 102 of the mimeographic printing apparatus 100 by a rotation drive of the main body sheet feeding roller 111, which is similar to a state as illustrated in FIG. 25.

Next, referring to the table in FIG. 16, the sheet conveying transition in FIGS. 28, 29A, and 29B, and a timing chart in FIG. 30, an example of the sheet conveying operation control executed upon control of the controller 85 under a below described condition is briefly explained. For example, The conveyance type: Conveyance Type 5

The printing speed: any one of 16, or 30 to 120 rpm.

The sheet size: the short size, namely, B5T illustrated in FIG. 16.

Figure 30:
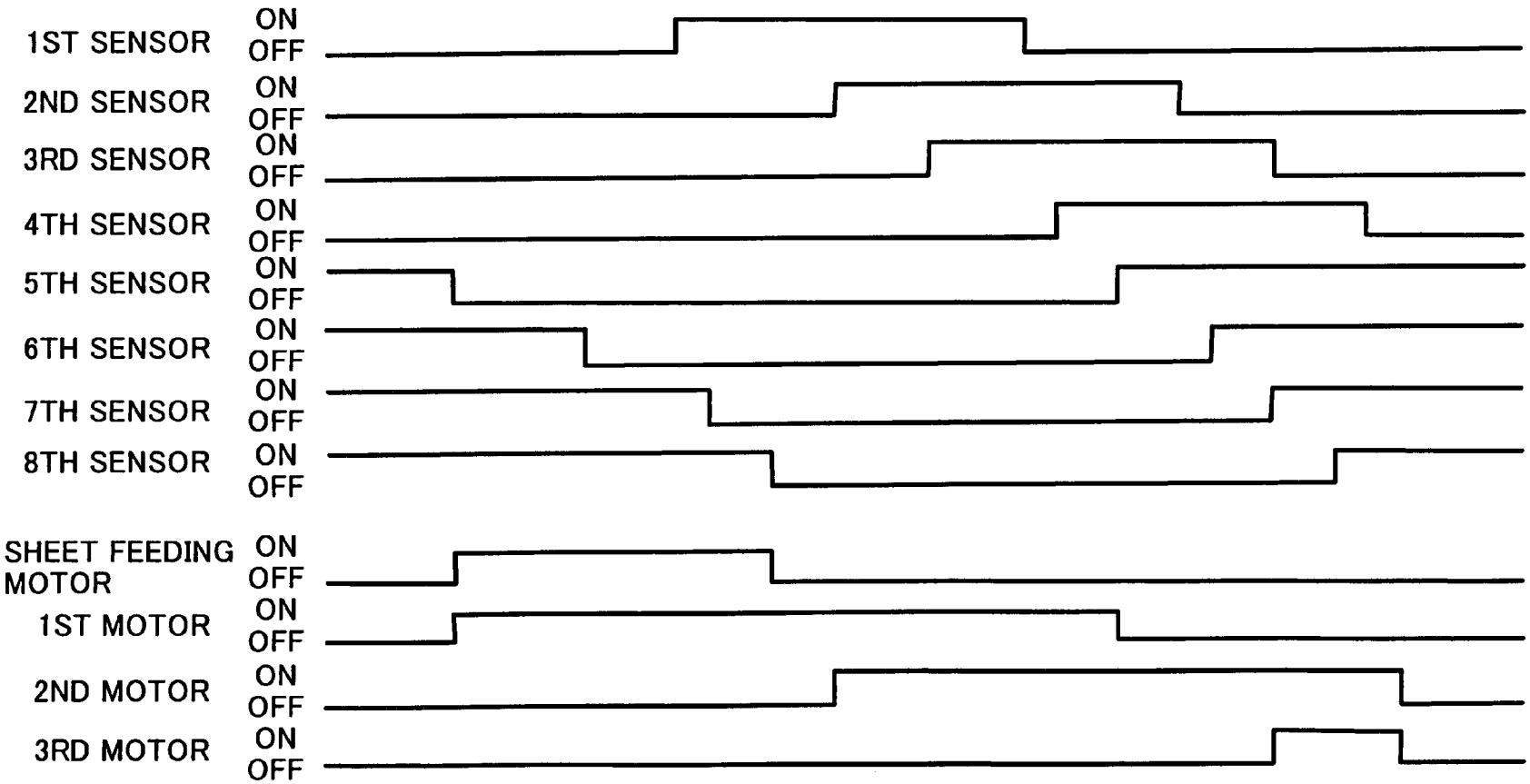
FIG. 30 is a basic timing chart of the sheet conveyance control operation relevant to a conveyance type 5 of the aforementioned embodiment of the present invention.

FIG. 30 is a timing chart illustrating an example relevant to turning on or turning off of each of the first sensor 50-1 to the eighth sensor 50-8, the sheet feeding motor 22, and the first motor 33-1 to the third motor 33-3, in the case of which the leading edge of the second sheet P2 does not reach the trailing edge of the first sheet P1 in the sheet conveying operation control described below.

In an example of the sheet conveying operation control for the conveyance type 5, similar to the aforementioned conveyance type 3 or the conveyance type 1, the speed of each of the motors are previously set as a default configuration. Further, regardless of the printing speed on a side of the mimeographic printing apparatus 100, the sheet feeding motor 22 is controlled by the controller 85 such that the sheet feeding roller 11 and the separation roller 12 pick up the topmost sheet of the stacked sheets on the large capacity sheet feeding tray 10 and separate and convey the same at a sheet conveying speed, corresponding to the top printing speed on the side of the mimeographic printing apparatus 100 (120 sheets/min: 120 rpm in the first embodiment of the present invention).

In addition, each of the first to the third motors, 33-1 to 33-3 is controlled by the controller 85 such that each of the first to the third conveying rollers, 32-1 to 32-3 convey the sheet P that is fed from the sheet feeding mechanism 3.

As illustrated in FIG. 16, a position of the trailing edge of the initial sheet at the conveyance type 5 for the sheet of a short size is in between the fourth sensor 50-4 and the fifth sensor 50-5 and the second sheet loading sensor is the fifth sensor 50-5 (turns OFF).

Figure 28:
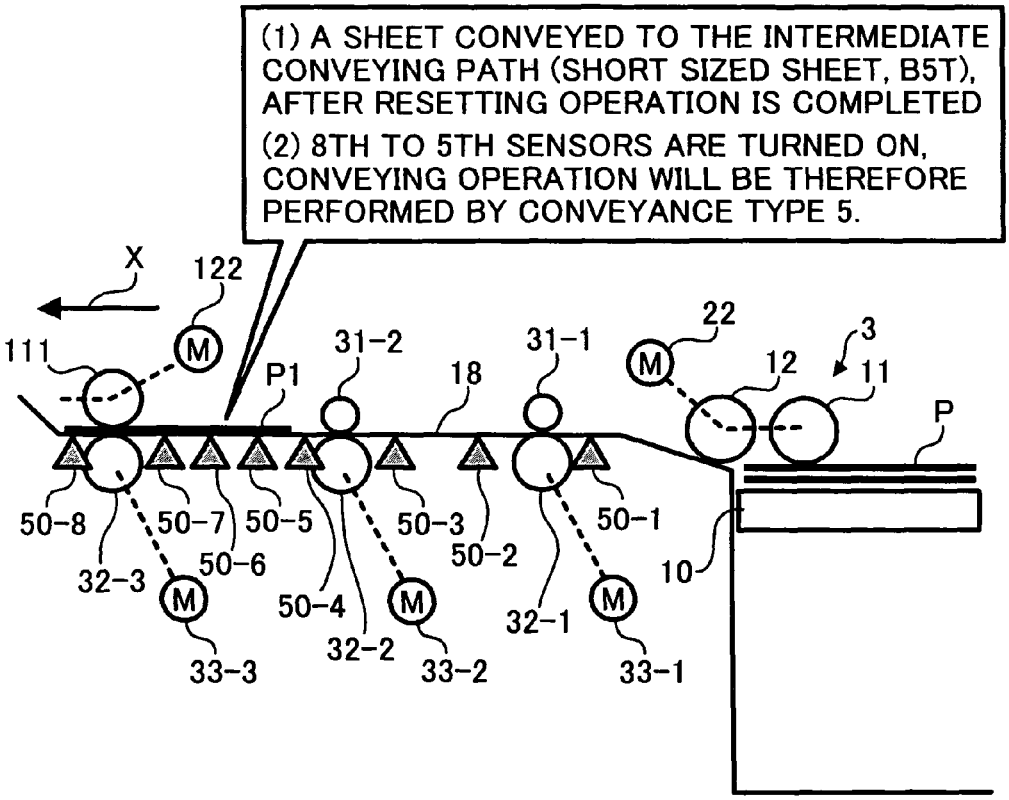
FIG. 28 is an elevation illustrating a sheet on the intermediate sheet conveying path of the aforementioned embodiment of the present invention after the reset operation is completed, in which the sheet size is the shortest.

The sheet illustrated in FIG. 28 is the one sheet of the first sheet P1 after the reset operation is complete in which the one sheet of the topmost sheet P on the large capacity sheet feeding tray 10 is separated and picked up from the tray and fed and conveyed to the intermediate sheet conveying path 18. The reset state of the first sheet P1 indicates the conveyance type 5 in which the eighth sensor 50-8 to the fifth sensor 50-5 are turned on and the conveying operation control of the conveyance type 5 is executed.

Figure 29A:
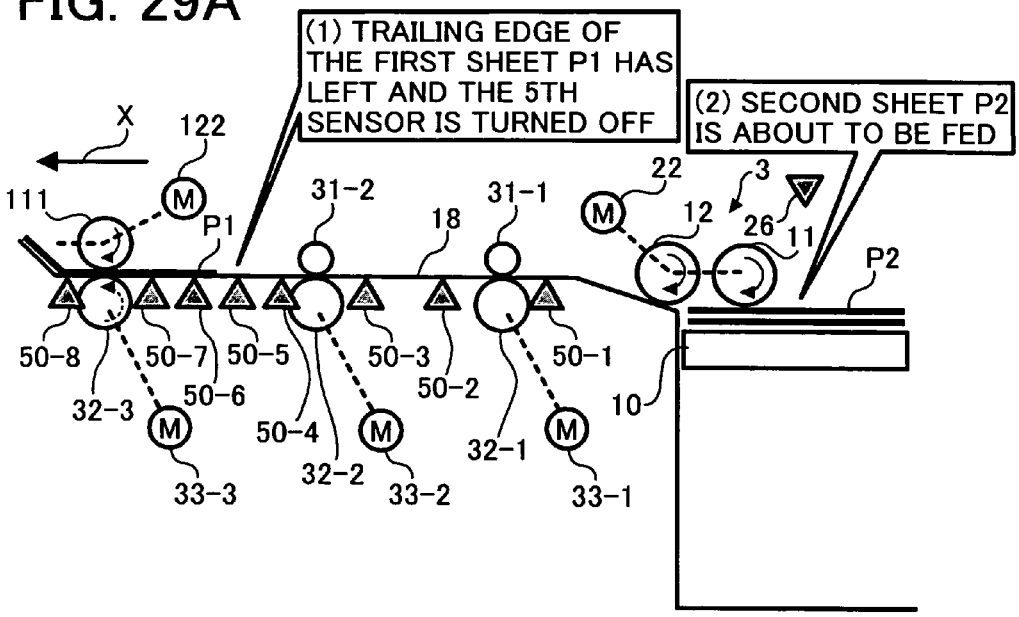
FIG. 29A is an elevation explaining the transition of the sheet conveyance for the first sheet and the second sheet after the state thereof in FIG. 28, and the control operation therefor.

First, the first sheet P1 proceeds from the reset position illustrated in FIG. 25 to a position illustrated in FIG. 29A. That is, the first sheet P1 that is nipped between the main body sheet feeding roller 111 and the third conveying roller 32-3 is loaded and conveyed to the main body sheet feeding section 104 by a start of rotation of the main body sheet feeding roller 111 in clockwise direction at a constant speed caused by the start of the sheet feeding motor on a side of the mimeographic printing apparatus 100.

Thus, when the first sheet P1 starts to proceed to a side of the mimeographic printing apparatus 100, the fifth sensor 50-5 is turned off by passing of the trailing edge of the first sheet P1 through the fifth sensor 50-5. In a similar manner as stated above, because the fifth sensor 50-5 that serves as the second sheet loading sensor is turned off, the sheet feeding motor 22 is started to rotate and the sheet feeding roller 11 and the separation roller 12 thereby start to rotate in a clockwise direction causing second sheet P2 to be separated to one sheet and to be conveyed to the intermediate sheet conveying path 18.

Then, the first motor 33-1 and the second motor 33-2 is started one after another and the leading edge of the second sheet P2 is conveyed by the first conveying roller 32-1 and the first pressure roller 31-1 and then by the second conveying roller 32-2 and the second pressure roller 31-2, being nipped between the conveying roller and the pressure roller pairs until the fifth sensor 50-5 is turned on. In addition, in the manner as stated earlier, the sheet feeding motor 22 is automatically stopped after the leading edge of the second sheet P2 is conveyed to the first conveying roller 32-1 through the sheet feeding roller 11 and the separation roller 12.

Figure 29B:
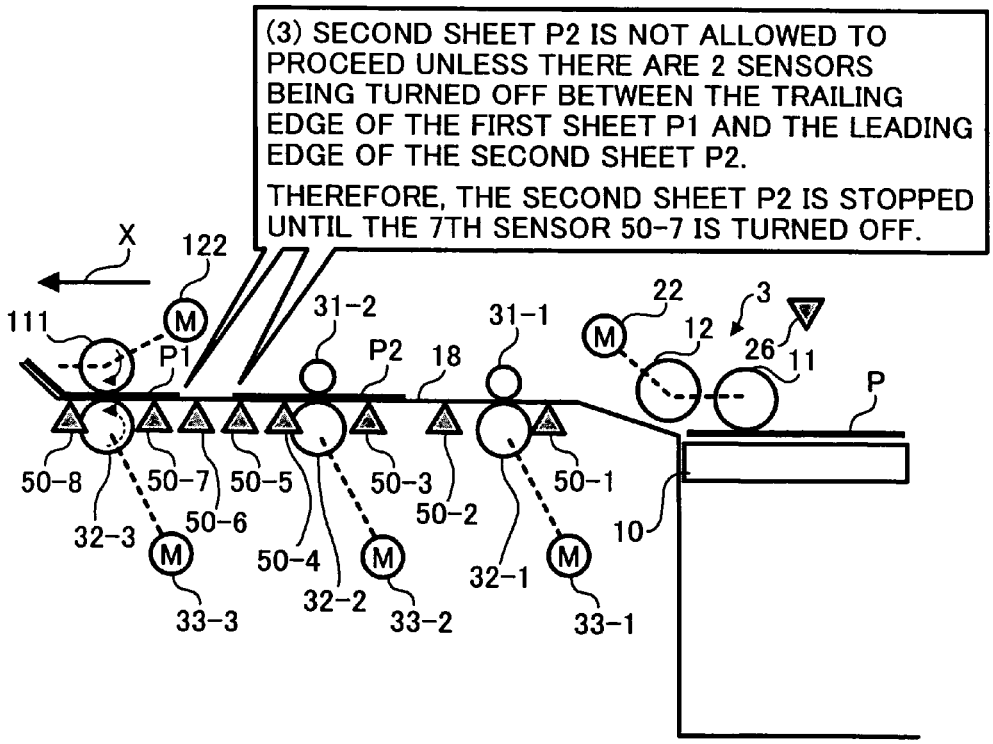
FIG. 29B is an elevation explaining the transition of the sheet conveyance for the first sheet and the second sheet after the state thereof in FIG. 29A, and the control operation therefor.

Next, as illustrated in FIG. 29B, even though the sixth sensor 50-6 is turned off upon passing of the trailing edge of the first sheet P1 through the sixth sensor 50-6, the seventh sensor 50-7 remains turned on because the trailing edge of the first sheet P1 remains on the seventh sensor 50-7. The leading edge of the second sheet P2 cannot be conveyed to the sixth sensor 50-6 for preventing from overlapping of the trailing edge of the first sheet P1 and the leading edge of the second sheet P2 as mentioned earlier.

In other words, the second sheet P2 is conveyed while checking whether there are two sensors being turned off between the trailing edge of the first sheet P1 and the leading edge of the second sheet P2. In this example, the leading edge of the second sheet P2 is positioned on the fifth sensor 50-5 whereby the fifth sensor 50-5 is turned on, while the trailing edge of the first sheet P1 is positioned on the seventh sensor 50-7 whereby the seventh sensor 50-7 is turned on. That is, there is only one sensor being turned off between the trailing edge of the first sheet P1 and the leading edge of the second sheet P2 and the nest sheet P2 is stopped at the position, illustrated in FIG. 29B by turning off of the second motor 33-2, until two of the sixth sensor 50-6 and the seventh sensor 50-7 are both turned off.

Thereafter, the first sheet P1 is further conveyed to the downstream side of the sheet conveying direction X whereby the trailing edge of the first sheet P1 passes through the seventh sensor 50-7 and the seventh sensor 50-7 is turned off. On the other hand, the leading edge of the second sheet P2 is stopped at the position illustrated in FIG. 29B. As a result, both of the sixth sensor 50-6 and the seventh sensor 50-7 are turned off and therefore, the second motor is again started to rotate and the second sheet P2 is conveyed being nipped between the second conveying roller 32-2 and the second pressure roller 31-2 until the leading edge thereof reaches the sixth sensor 50-6 and the sixth sensor 50-6 is thereby turned on.

At this moment, the controller judges whether the eighth sensor 50-8 is turned off by passing of the conveyed first sheet P1 through the eighth sensor 50-8. If the trailing edge of the first sheet P1 is remaining on the eighth sensor 50-8 and the eighth sensor 50-8 remains turned on, the leading edge of the second sheet P2 cannot be conveyed to the seventh sensor 50-7 in the same reason as mentioned before.

Accordingly, the controller controls the conveying operation for the second sheet P2 to be conveyed such that two sensors being turned off are secured between the sheets that are-being conveyed through the intermediate sheet conveying path 18. The leading edge of the second sheet P2 is positioned on the sixth sensor 50-6 whereby the sixth sensor is turned on and the trailing edge of the first sheet P1 is positioned on the eighth sensor 50-8 whereby the eighth sensor 50-8 is turned on.

In other words, there is only one sensor being turned off between the sheets that are being conveyed through the intermediate sheet conveying path 18. Therefore, the second motor 33-2 is turned off until two of the eighth sensor 50-8 and the seventh sensor 50-7 are both turned off so that the leading edge of second sheet P2 is stopped at a position where the sixth sensor is turned on.

On the other hand, if the trailing edge of the first sheet P1 passes through the eighth sensor 50-8 resulting in turning off of the eighth sensor 50-8, both of the eighth sensor 50-8 and the seventh sensor 50-7 are turned off and the second motor 33-2 is again started to rotate at a predetermined timing so that the second sheet P2 is conveyed. Then, the controller judges whether the seventh sensor 50-7 is turned on by reaching of the leading edge of the second sheet P2. If the seventh sensor 50-7 is turned on, the third motor 33-3 is started and the second sheet P2 is conveyed until the eighth sensor 50-8 is turned on.

Thus, when the first sheet P1 is conveyed to the printing section 102 of the mimeographic printing apparatus 100 and is completely left from the intermediate conveying unit 4, the second sheet P2 is stopped at the reset position until the time when the second sheet P2, an alternative to the former first sheet P1 is brought to the printing section 102 of the mimeographic printing apparatus 100 by rotating the main body sheet feeding roller 111, as illustrated in FIG. 28.

According to the first embodiment of the present invention, in a connection of the off-line mode of the mimeographic printing apparatus 100, even when sheet conveying speed control method for the conveying roller cannot be executed corresponding to the sheet feeding speed on a side of the mimeographic printing apparatus 100 or the printing speed, there is no need to be provided with the sheet conveying operation control for each of the printing supped by adopting the specific sheet conveying operation control of the controller 85 (CPU 86) as mentioned above.

This is because, the sheet conveying operation control of the present invention is configured such that each of the first to the third motors, 33-1 to 33-3 is controlled so that each of the conveying roller 32-1 to the conveying roller 32-3 convey the sheet P that is fed from the sheet feeding mechanism 3 at a sheet feeding speed, corresponding to the top printing speed on a side of the mimeographic printing apparatus 100, regardless of the printing speed on a side of the mimeographic printing apparatus 100. Accordingly, there are advantages that a stable sheet conveying operation can be realized because an unevenness of the sheet conveying operation speed for each of the printing speeds is avoided and that the sheet conveying operation control can be simplified.

In addition, the controller 85 is provided with a function as a sheet conveying operation control method switching device.

The aforementioned function is configured-to judge the sheet length on the basis of the signals from each of the first to the eighth sensors, 50-1 to 50-8 at the initialization time when a conveying operation for the one sheet P onto each of the first to the eighth sensors, 50-1 to 50-8 is completed, and to control each of the first to the third motors, 33-1 to 33-3 such that the conveyance type, namely, a sheet conveying pattern, that serves as a sheet conveying operation control method is switched.

Therefore, when the controller judges only the position where the trailing edge of the first sheet P1 exists in any one of the first sensor 50-1 to the eighth sensor 50-8 (a plurality of sheet detection devices), the second sheet P2 can be conveyed, regardless of fixed or unfixed length of the sheet. Therefore, the stable sheet conveying operation suitable for the sheet length can also be executed.

Further, at the reset state (an initial state), one sheet is positioned on the eighth sensor 50-8 arranged on a downmost side of the downstream of the intermediate sheet conveying path 18 and the leading edge of the sheet is set at a position where the sheet can be fed by the main body sheet feeding roller 111 (main body sheet feeding device). Therefore, the sheet can be securely loaded on a side of the main body of the mimeographic printing apparatus 100 (main body of an image forming apparatus).

Figure 33:
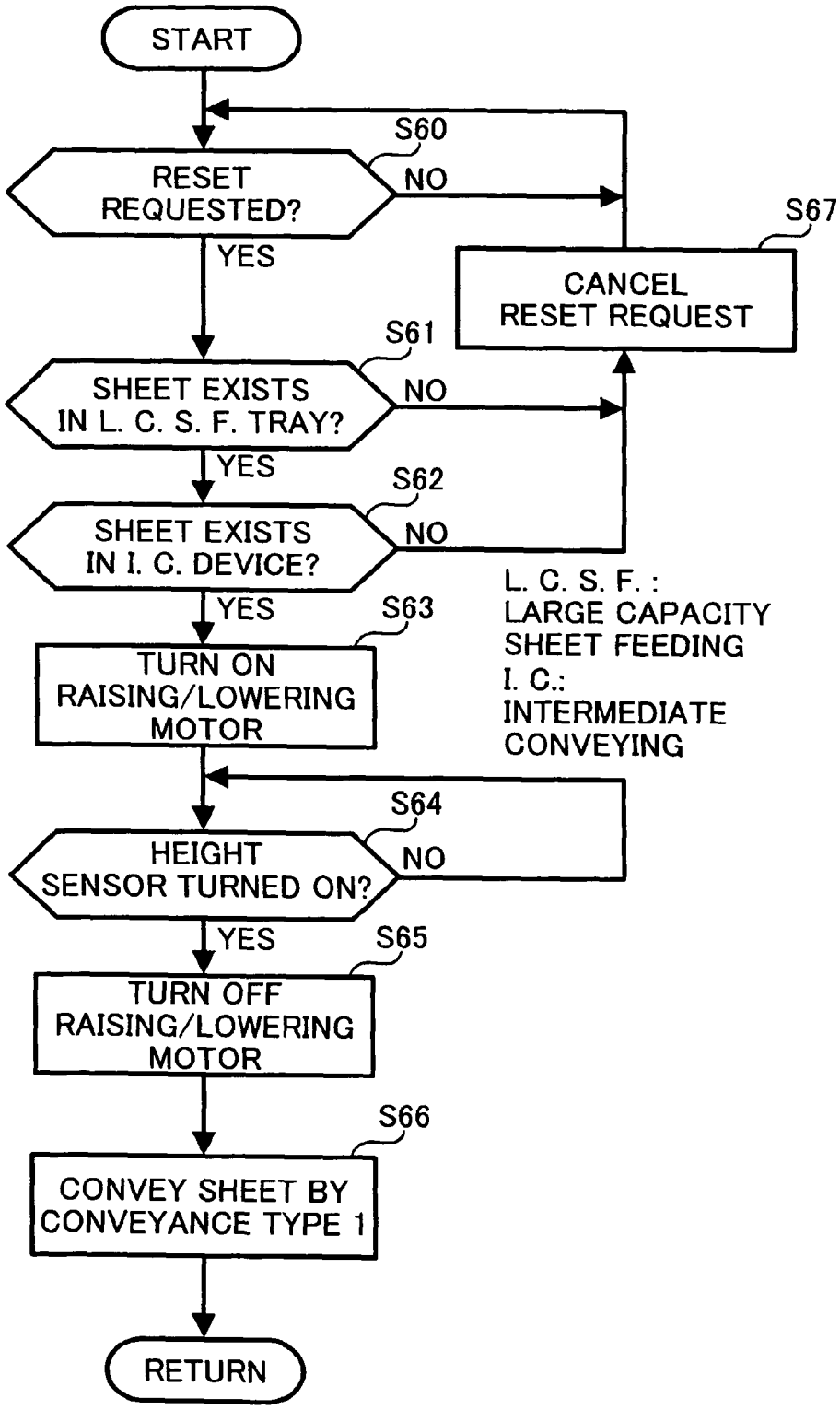
FIG. 33 is a flowchart relevant to the reset operation.

Next, an operation of the image forming system including the large capacity sheet feeding/conveying unit 1 and the mimeographic printing apparatus 100, in which the large capacity sheet feeding/conveying unit 1 is positioned at the connected position illustrated in FIG. 1 and is in the off-line mode, will be explained referring to FIGS. 31 through 33.

Figure 31:
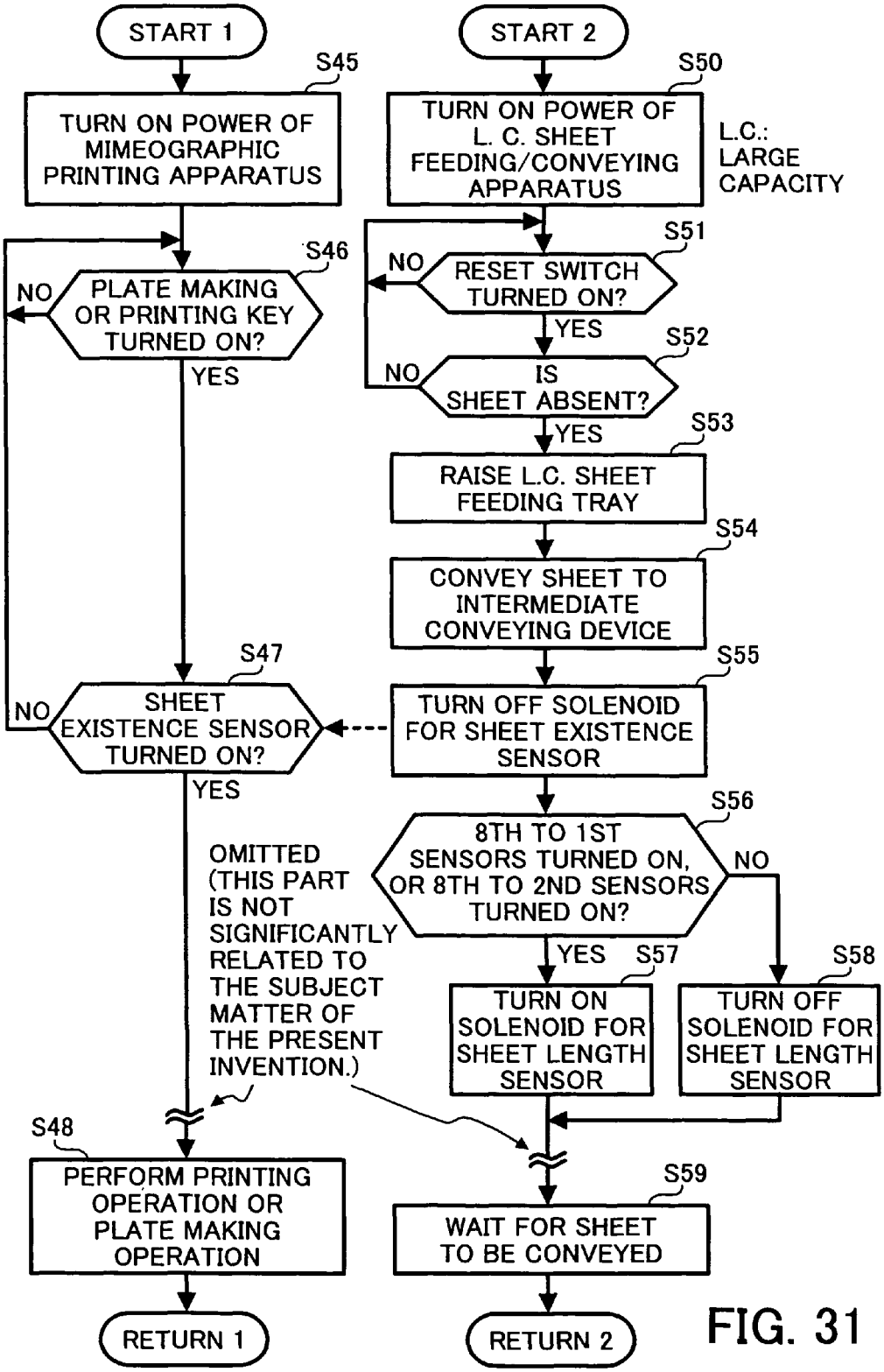
FIG. 31 is a flowchart illustrating a main procedure of operation of the mimeographic printing apparatus and the large capacity sheet feeding/conveying unit.

First, even though the order of the turning on operation for the power switch 80 on a side of the large capacity sheet feeding/conveying unit 1 (in Step S50) illustrated in FIG. 31, and the power switch (not illustrated) arranged in the mimeographic printing apparatus 100 (in Steps S45) in FIG. 31 is not particularly limited, the power is individually supplied to both of the large capacity sheet feeding/conveying unit 1 and the mimeographic printing apparatus 100.

Also, even though the order of the operations on a side of the large capacity sheet feeding/conveying unit 1 and the mimeographic printing apparatus 100 is not important, the controller judges whether a reset switch 81 is turned on (in Step S51). Though explanations are partially out of sequence, operations illustrated in FIGS. 32A to 32C and a reset operation relevant to a flowchart illustrated in FIG. 33 will be described in detail. The reset operation starts from Step S60 in the flowchart in FIG. 33. First, the CPU 86 judges whether a requirement for reset operation exists. If the requirement for reset operation exists, i.e., when the reset switch 81 is pressed down, a reset signal is generated and is input to the controller 85.

When the controller receives the reset signal, the program proceeds to Step S61. On the other hand, if the requirement for reset operation does not exist (No, in Step S60), the same judgment is repeated.

Next, in Step S61, the controller judges whether a sheet P is stacked on the large capacity: sheet feeding tray 10 on the basis of an output signal from the sheet existence sensor 66. If the sheet P is not stacked on the large capacity sheet feeding tray 10 (No, in Step S61), the requirement for reset operation is cancelled (in Step S67) and if the sheet P is stacked (Yes, in Step S61), then the program proceeds to Step S62. In Step S62, the controller judges whether the sheet P exists on the intermediate conveying unit 4 (in Step S62). If the sheet P exists on the intermediate conveying unit 4 (No, in Step S62), the requirement for reset operation is cancelled (in Step S67). If the sheet P does not exist on the intermediate conveying unit 4 (Yes, in Step S62), then the program proceeds to Step S63.

In Step S63, the raising/lowering motor 28 in the sheet feeding tray raising/lowering mechanism 25 is turned on and the large capacity sheet feeding tray 10 is raised through an operation of the sheet feeding tray raising/lowering mechanism 25, as illustrated in FIG. 32B. Then the program proceeds to Step S64 and the controller judges whether the height sensor 26 is turned on. If the height sensor is not turned on (No, in Step S64), the large capacity sheet feeding tray 10 continues to be raised. If a stop signal is input to the controller 85, the large capacity sheet feeding tray 10 stops to be raised (not illustrated).

If the height sensor 26 is turned on (Yes, in Step S65), then the topmost sheet P on the sheets stacked on the large capacity sheet feeding tray 10 is considered to reach a position where the sheet P can be fed, or the sheet feeding roller 11 is judged to be positioned at a proper location for sheet feeding operation, and the raising/lowering motor 28 is therefore turned off to stop the large capacity sheet feeding tray 10 to be raised (in Step S65).

Next, the sheet feeding roller 11 starts to be rotated in a clockwise direction by the sheet feeding motor 22, which is turned on, in the sheet feeding mechanism 3 as illustrated in FIG. 32C. The topmost sheet P stacked on the large capacity sheet feeding tray 10 is fed toward the sheet conveying direction X and is separated into one sheet by the separation roller 12 that also rotates in a clockwise direction and the separation pad 13 in response to each other. Then, the sheet P is conveyed out from the large capacity sheet feeding unit 5.

Next, the first to the third motors, 33-1 to 33-3 are turned on resulting in rotation of the first to the third conveying rollers, 32-1 to 32-3 in a counterclockwise direction. A first to a second pressure rollers, 31-1 to 31-2 are driven by the first to second conveying rollers 32-1 to 32-2, respectively, in the clockwise direction. The one sheet P1 as an initial setting sheet is conveyed toward the reset position on the downstream side of the sheet conveying direction X.

At this moment, the sheet size of the first sheet P1 for the initial setting sheet is not recognized and therefore, the sheet P1 is conveyed by the conveyance type 1 (A3, DL: the Largest sheet size) illustrated in FIG. 16, in the sheet conveying operation control methods. However, because no precedent sheet is going ahead in the intermediate conveying unit 4, the second sheet proceeds without stopping, and all of the conveyance type is operated in a similar manner.

Namely, because there is no first sheet being conveyed ahead in the intermediate conveying unit 4, second sheet does not reach the first sheet and is not stopped whichever the conveyance type is. As a result, the second sheet is conveyed to the reset position in a similar operation.

Thereafter, when the controller detects that the leading edge of the one sheet of the initial setting sheet P1 reaches the reset position by receiving a sheet existence signal from the eighth sensor 50-8, the first to the third motors, 33-1 to 33-3 are turned off. The leading edge of the one initial setting sheet P1 thereby stops nearly before the front face plate 124 of the main body sheet feeding section 104 and reaches the reset position resulting in completing the reset operation (See FIGS. 18, 25, and 28.).

A the time when the leading edge of the first sheet P1 passes through the eighth sensor 50-8, the solenoid 72-2 for sheet existence sensor turns off and represents that a sheet P exists. Alternatively, when the sheet P does not exist on the intermediate sheet conveying path 18, the solenoid 72-2 for sheet existence sensor turns on.

Next, when the solenoid 72-2 for sheet existence sensor (illustrated in FIGS. 9A and 9B) remains turned off and the solenoid 72-1 for sheet length sensor also remains turned off, the sheet existence sensor 127 and the sheet length sensor 128 of the main body sheet feeding tray 110 on a side of the mimeographic printing apparatus 100 remains interrupted by the shutters 71-2 and 71-1. (upon following condition: a sheet P exists on the intermediate sheet conveying path 18, and the sheet length is relatively long, namely, the sheet length is equal to or more than that of A4; the shutter 71-1 interrupts the sheet existence sensor 127, and the sheet length is less than that of A4; the shutter 71-1 transmits the sheet existence sensor 127.)

Consequently, the controller recognizes as if a sheet P exists on the sheet existence sensor 127 and the sheet length sensor 128 of the main body sheet feeding tray 110. Therefore, operation on the side of the mimeographic printing apparatus 100, such as printing, or plate making, can be executed only at the ON timing of the sheet existence sensor 127.

Further, even though a flowchart is omitted in FIGS. 31A and 31B, when the large capacity sheet conveying unit 1 moves to the downstream side of the sheet conveying direction X to be positioned to the connected position illustrated in FIG. 1, the main body sheet feeding roller 111 swings up to smoothly reach the sheet feeding position together with the sheet feeding arm (not illustrated), with the slanting member 51 illustrated in FIG. 9A. Thereby, the sheet feeding feeler (not illustrated) turns on the height sensor 126 illustrated in FIG. 2. The controller-also recognizes as if the main body sheet feeding device has become available by the thus mentioned operation.

On the other hand, on a side of the mimeographic printing apparatus 100, when a plate making start key arranged on the operation panel (not illustrated) is pressed down, a start signal is generated. Being triggered by the start signal, a so-called test sheet, namely a plate setting, or plate setting printing is performed for only one sheet together with a well known operation, that is to say, a plate discharging, an image reading for an original document, and a plate making/plate feeding.

At this moment, a one sheet P is conveyed from the intermediate conveying unit 4 of the large capacity sheet feeding/conveying unit 1 being controlled by the sheet conveying operation control as described in detail. A leading edge of the first sheet P1 is conveyed to the registration rollers pair 114 at the sheet conveying speed, corresponding to the top printing speed, 120 rpm of the main body sheet feeding roller 111 and the main body separation roller 112 of the main body sheet feeding section 104. The first sheet P1 is temporarily stopped at a nipping portion of the registration rollers pair 114 by impinging thereto so as to improve an accuracy of the registration of the first sheet P1 whereby a predetermined flexure is formed at an upper part of the leading edge of the first sheet P1.

On the other hand, the printing drum 115 starts to slowly rotate at a speed of, for example, 16 to 30 rpm (less than 60 rpm), namely, extremely slow rotation speed (printing speed) in a clockwise direction indicated by an arrow in FIG. 1.

In addition, the sheet P is conveyed to a position between the pressure roller 116 that is raised to a position indicated by a two-dot-and-a-dash line in FIG. 1 aligning a timing with the rotation of the registration rollers pair 114, and the printing drum 115 upon rotation of the registration rollers pair 114 caused by the registration motor (not illustrated) that is a stepping motor, at a predetermined timing in alignment with an image position of a heat-sensitive mimeographic master, for which a plate making is already completed, and which is entrained about a circumferential face of the printing drum 115. The first sheet P1 is pressed to the heat-sensitive mimeographic master of post plate making.

The heat-sensitive mimeographic master of post plate making contacts the circumferential face of the printing drum 115 by adhesive power of ink fed from inside of the printing drum 115 with pressure of the first sheet P1 that is pressed to the heat-sensitive mimeographic master that is already reproduced. Thereby, a plate setting printing is performed by transferring of the ink to the first sheet P1.

The first sheet P1 after completing the plate setting printing is discharged and stacked onto the large capacity sheet discharging tray 201 in an orderly fashion by a known discharging operation. Thereafter, when the print start key (not illustrated) arranged on the aforementioned operation panel is pressed down, each of a sheet feeding, a printing, and a sheet discharging is performed for a preset number of sheets to be printed in a similar manner of the aforementioned plate setting printing, and the mimeographic printing operation is completed. A point of difference between the plate setting printing and the ordinary printing operation is only that the printing speed of the plate setting printing is extremely slow as mentioned above and that the number of the sheet printed at the plate setting printing is not counted as the ordinary printed sheets.

When the large capacity sheet feeding/conveying unit 1 is not positioned at the connected position illustrated in FIG. 1, but the disconnected position, the aforementioned well known operation, that is to say, the plate discharging, the image reading for the original document, the plate making/plate feeding, the sheet feeding/printing, and the sheet discharging, on a side of the mimeographic printing apparatus 100, upon stacking the sheet on the main body sheet feeding tray 110.

Thus, the first embodiment of the present invention is described above in detail, and below described problems remaining in the U.S. Pat. No. 5,441,247 will further be explained.

(1) A variation of the sheet length is limited because the sheet feeding apparatus using the art of the aforementioned U.S. Pat. No. 5,441,247 cannot convey a sheet other than a predetermined length in a sheet conveying direction. For example, various users including a duplicator user to a mimeographic printing apparatus user, specially, the user of the mimeographic printing apparatus who uses the sheets of various kinds of size cannot use the aforementioned sheet feeding apparatus.

(2) In the aforementioned sheet feeding apparatus, there is no need to judge the sheet length because only the sheet of the predetermined sheet length can be used for printing as mentioned in item (1) above. However, in a large capacity sheet feeding apparatus having the intermediate conveying section that is applicable to the various kinds of sheet sizes, a control operation for securing a distance between a first sheet and a second sheet both of which are being successively conveyed becomes easy if the sheet size can be judged.

Alternatively, if the distance between the first sheet and the second sheet that is successively conveyed is secured without judging the sheet size, more sensors for detecting a trailing edge of the first sheet and the leading edge of the second sheet must be necessary. However, the control operation for detecting both of the trailing edge of the first sheet and the leading edge of the second sheet becomes complicated and the manufacturing cost may be increased. Therefore, the sheet feeding apparatus is required to be provided with the sensors as few as possible.

(3) To achieve the object of the above item (2), it is an idea to mount a sensor corresponding to a sheet length sensor to detect a sheet length for use in a sheet feeding tray of a printing apparatus and the like on a stacking section of the sheet feeding apparatus. However, this causes a structure to be complicated and wiring operation may be also complicated, and further, the manufacturing cost may increase. In addition, the sheet length sensor can be used for only two kinds of sizes, that is, less than A4Y and more than A4Y.

In the printers, specifically, in the mimeographic printing apparatus, various kinds of sheets are used. In general, the sheets are classified to a standard paper, a thin paper, and a heavy paper, however, even in the standard paper or standard paper used for large capacity sheet feeding apparatus, there are several kinds of sheets, such as a high quality sheet (a high quality sheet of 55 kg, or a high quality sheet for mimeograph), an average quality sheet, a recycled sheet and the like. Therefore, the sheet feeding apparatus is not applicable for such variety of the above-mentioned sheets.

Consequently, the present invention is made in light of the aforementioned problems and is made to provide the large capacity sheet feeding apparatus having the intermediate conveying section capable of conveying various kinds of sheets (more widely, sheet-shaped recording media), specifically, capable of solving these problems above and conveying the sheet of many kinds of sizes.

The present invention further provides the large capacity sheet feeding apparatus having the intermediate conveying section capable of feeding the sheet at a speed, corresponding to that from a relatively low image forming speed to a relatively high image forming speed without limiting the image forming speed including a printing speed on a side of a main body of the image forming apparatus.

In other words, a main object of the present invention is to provide a large capacity sheet feeding apparatus having an intermediate conveying section and sheet conveying method capable of conveying the sheets one after another toward a sheet feeding device on a side of a main body of an image forming apparatus or in the vicinity of a sheet feeding inlet preventing from contacting of a trailing edge of the first sheet with a leading edge of the second sheet, even when there is no electric connection with a sheet feeding device on a side of the main body of the image forming apparatus.

A provision of the above-described large capacity sheet feeding apparatus having the intermediate conveying section can be realized by recognizing a size of the sheet being conveyed through the intermediate conveying section, and a sheet conveying speed by detecting the same on a side of the large capacity sheet feeding apparatus having the intermediate conveying section.

According to the aforementioned first embodiment of the present invention, below described advantages are obtained in addition to the effect of the invention mentioned later.

(1) Regardless of the sheet size or the printing speed on a side of the mimeographic printing apparatus 100, the sheet conveying operation for the sheet from the intermediate conveying unit 4 of the large capacity sheet feeding/conveying unit 1 to the mimeographic printing apparatus 100 can be executed, even when communication between the intermediate conveying unit 4 and the mimeographic printing apparatus 100 cannot be executed and, for example, both of the intermediate conveying unit 4 and the mimeographic printing apparatus 100 are not electrically connected.

At this moment, the reason why the sheet conveying operation for the relatively long sized sheet is differently controlled from that for the relatively short sized sheet will be, explained below. That is, different from a case of a long sized sheet, a short sized sheet is conveyed by only one conveying roller at a part of the time when the sheet is conveyed through the intermediate sheet conveying path. As a result, when the conveying roller is stopped, the conveying roller tends to overrun and the sheet may excessively proceed because the breaking force does not work enough to stop the conveying roller.

In theory, when the number of the disposed sheet conveying devices or the number of the disposed sheet detecting devices is increased more than that in the first embodiment of the present invention, the sheet conveying operation for the long sized sheet can also be controlled as the sheet conveying operation for the short sized sheet is controlled. Likewise, when the maximum speed of the sheet conveying operation is increased to obtain a margin for operation time, the sheet conveying operation for the long sized sheet can also be controlled as the sheet conveying operation for the short sized sheet.

In consideration of the cost balance, the number of the sheet conveying devices and the number of the sheet detecting devices both of which are set corresponding to the length of the sheet to be conveyed from the large capacity sheet feeding/conveying unit 1 to the mimeographic printing apparatus 100 are minimized. The sheet conveying operation control of the first embodiment of the present invention is thus configured and as a result, the above mentioned each of the devices is simplified and the manufacturing cost is suppressed.

<When the Sheet Length is Long>

The conveying operation control for the second sheet is started when the trailing edge of the first sheet has left the second sheet loading sensor whereby the second sheet loading sensor is turned off. At the time when the leading edge of the second sheet reach the Nth sensor (The larger the number N is, the closer the sensor is located on a side of the mimeographic printing apparatus 100), the controller judges whether the (N+1)th sensor is turned off resulting from the proceedings of the trailing edge of the first sheet P1. If the (N+1)th sensor is turned off, the controller determines that the second-sheet P2 is allowed to proceed to the (N+1)th sensor.

On the contrary, if the (N+1)th sensor is turned on, then the second sheet P2 is stopped and waits until the (N+1)th sensor is turned off. This is a basic control of the sheet conveying operation in the embodiment of the present invention.

According to the aforementioned basic control, the sheet conveying operation can be executed at all the time securing a proper distance between the first sheet P1 to the second sheet P2 regardless of the printing speed on a side of the mimeographic printing apparatus 100.

As a result, when the second sheet P2 that is fed within a certain time after the first sheet P1 is fed reaches the third conveying roller 32-3 that is arranged approximately at a position facing the main body sheet feeding roller 111 of the main body sheet feeding tray 110, which is attached to a main body of the image forming apparatus, such as a copying machine, a printer and the like, the sheet conveying operation for the second sheet P2 can be executed under the same condition as that the sheet is fed from the main body sheet feeding tray 110.

<When the Sheet Length is Short>

The conveying operation control for the second sheet P2 is started when the trailing edge of the first sheet P1 has left the second sheet loading sensor whereby the second sheet loading sensor is turned off. At the time when the leading edge of the second sheet P2 reaches the Nth sensor, the controller judges whether the (N+2)th sensor is turned off resulting from proceedings of the trailing edge of the first sheet P1. If the (N+2)th sensor is turned off, the controller determines that the second sheet P2 is allowed to proceed to the (N+1)th sensor.

On the contrary, if the (N+2)th sensor is turned on, then the second sheet P2 is stopped and waits until the (N+2)th sensor is turned off. This is also a basic control of the sheet conveying operation in the embodiment of the present invention. According to the above-mentioned basic control, the sheet conveying operation can be executed all the time-securing a proper distance between the first sheet P1 and the second sheet P2 regardless of the printing speed of the mimeographic printing apparatus 100.

As a result, when the second sheet that is fed within a certain time after the first sheet is fed reaches the third conveying roller 32-3 that is arranged at a position approximately facing the main body sheet feeding roller 111 of the main body sheet feeding tray 110, which is attached to a main body of the image forming apparatus, such as a copying machine, a printer and the like, the sheet conveying operation for the second sheet can be executed under the same condition as that when the sheet is fed from the main body sheet feeding tray 110.

In a case when the sheet size is short, the sheet leaves the intermediate conveying unit 4 relatively faster than a case when the sheet size is long, and the sheet reaches the main body sheet feeding roller 111 relatively faster. As a result, more margins for operation time can be secured for the short sized sheet in comparison with the case of the long sized sheet, and therefore, the number of the sensors to be turned off for determining the distance between the first sheet P1 and the second sheet P2 is set to two.

On the contrary, when the sheet size is long and thereby the margin for operation time cannot be secured, the number of the sensors to be turned off for determining the distance between the first sheet P1 to the second sheet P2 is set to one.

(2) When the aforementioned sheet conveying operation control of the first embodiment of the present invention is adopted, there is no need for the user to purchase a new printing machine or the like. This is because the printing apparatus which is already used in the market can be transformed into the printing apparatus including the mimeographic printing apparatus that is capable of producing a large number of printings.

Namely, there is no need to read the printing speed of the mimeographic printing apparatus 100 upon the sheet conveying operation control mentioned above.

(3) By arranging the third conveying roller 32-3 under the main body sheet feeding roller 111, the main body sheet feeding roller 111 can be rotated by the third conveying roller 32-3. As a result, a tip end of the sheet can be prevented from being damaged by fitting into the projection of the main body sheet feeding roller 111. Further, the material of the main body sheet feeding roller 111 is not a fixed rubber pad (friction separation member) that is a usually called separation pad but a roller, and therefore, a sheet feeding error can be prevented. In addition, this configuration can secure the accurate sheet feeding amount so as to determine the stopping position of the tip end of the sheet.

(4) "A minimum sheet conveying length" equals to "a distance between the conveying rollers+alpha" and therefore, the first embodiment of the present invention is applicable to a sheet shorter than before, when a plurality of conveying rollers are provided.

(5) As for the sensors, 50-N to 50-P (the sheet detecting device), eight sensors, i.e., the requisite minimum number of sensors are provided such that the controller can judge the 10 kinds of sheet lengths that can be conveyed by the intermediate conveying unit 4, corresponding to the sheet length of the sheets that is used in the mimeographic printing apparatus 100. Therefore, the configuration for detecting the sheet length is simplified and the manufacturing cost can be suppressed.

If the aforementioned advantages are more than desired, the sheet conveying operation can be controlled in a state that the distance between the sensors is opened all the time by arranging the larger number of sensors (sheet detecting devices) and by detecting a position between the consecutive number of the sensors where the trailing edge of the first sheet P1 remains when the sheet has been stopped. There is no need to say that the more the number of the arranged sensors increases, the more the distance between the first sheet P1 and the second sheet P2 can be secured.

(6) In order to secure the sheet conveying amount, the stepping motors capable of accurately sending the sheet are used for the first to the third motors, 33-1 to 33-3, and therefore the conveying operation control becomes simpler. Further, because slipping amount of the sheet can be calculated by comparing a time in which the sheet passes through the sensors and the number of the pulses that is supplied to the stepping motor, the sheet becomes capable of being more accurately conveyed.

(7) By embedding the one-way clutch into each of the shaft portions of the first conveying roller 32-1 to the third conveying roller 32-3, the resistance of the first conveying roller 32-1 to the third conveying roller 32-3 against the drawing force of the main body sheet feeding roller 111 can be decreased.

(8) On the contrary, a stopping position accuracy of the sheet may possibly be deteriorated due to the inertia of the first conveying roller 32-1 to the third conveying roller 32-3. However, an overrun of the first conveying roller 32-1 to the third conveying roller 32-3 can be prevented by providing a uniform braking mechanism. This improves the stopping position accuracy of the sheet at the time when each of the motors is stopped, and a stable sheet stopping position accuracy can thereby be secured.

The one-way clutch 61 mentioned above is embedded into the shaft portion of the third conveying roller 32-3 so that the load on the sheet can be decreased as much as possible in a case when the sheet is supplied from a side of the mimeographic printing apparatus 100. As a result, the first conveying roller 32-1 to the third conveying roller 32-3 repeat continuous rotation and stopping operation according to the length of the sheet used on a side of an image forming apparatus, such as a copying machine, printer, or the like.

Further, the first conveying roller 32-1 to the third conveying roller 32-3 may be brought to a stopping state, even in a slow-up area or a slow-down area of the stepping motor. Accordingly, the stopping position of the first conveying roller 32-1 to the third conveying roller 32-3 tends to fluctuate due to unevenness of inertia of the first to the third conveying roller 32-13 to 2-3.

Furthermore, the sheet stopping position accuracy also fluctuates resulting from a sheet proceeding distance and resultant inertia corresponding to a difference between coefficients of friction depending on a state of surfaces of the sheets or weight of the sheet.

On the other hand, the condition of the sheet conveying operation of the intermediate conveying unit 4 is as follows: the sheet length is long, a distance between the first sheet P1 and the second sheet P2 to be conveyed is long, the sheet conveying speed is fast and is corresponding to the maximum printing speed as in the embodiment of the present invention.

Under the above-mentioned condition, when the trailing edge of the first sheet P1 has passed through the Nth sensor, the leading edge of the second sheet P2 is allowed to proceed to the Nth sensor, and when the trailing edge of the first sheet P1 has not passed through the (N+1)th sensor, the leading edge of the second sheet P2 is not allowed to (N+1)th sensor and is stopped at the Nth sensor.

However, even when the third conveying roller 32-3 is stopped by the slow-down control of the stepping motor, or is forcibly stopped, the third conveying roller 32-3 cannot accurately stop at a predetermined position due to inertia of the main body sheet feeding roller 111 (or the shaft thereof may be included), because the aforementioned one-way clutch is embedded into the shaft portion of the third conveying roller 32-3.

Therefore, in a worst case, the leading edge of the second sheet-has reached a position of the trailing edge of the first sheet P1 and has contacted the trailing edge of, the first sheet P1, resulting in damaging of the both sheets, or resulting in causing a sheet jamming during the conveying operation for the sheets due to a resultant deformation of the sheet.

However, a breaking force caused by the sheet spring is applied to the third conveying roller 32-3 in the first embodiment of the present invention and therefore, the influence of the inertia is suppressed resulting in obtaining a stable stopping position of the third conveying roller 32-3 and improvement of quality of the sheet conveying operation has thereby been realized.

Next, referring now to FIGS. 1 and 34 to 36, a difference between the control configuration of the on-line mode and that of the off-line mode, in which the large capacity sheet feeding/conveying unit 1 is mechanically connected to the mimeographic printing apparatus 100 will be mainly explained.

Figure 34:
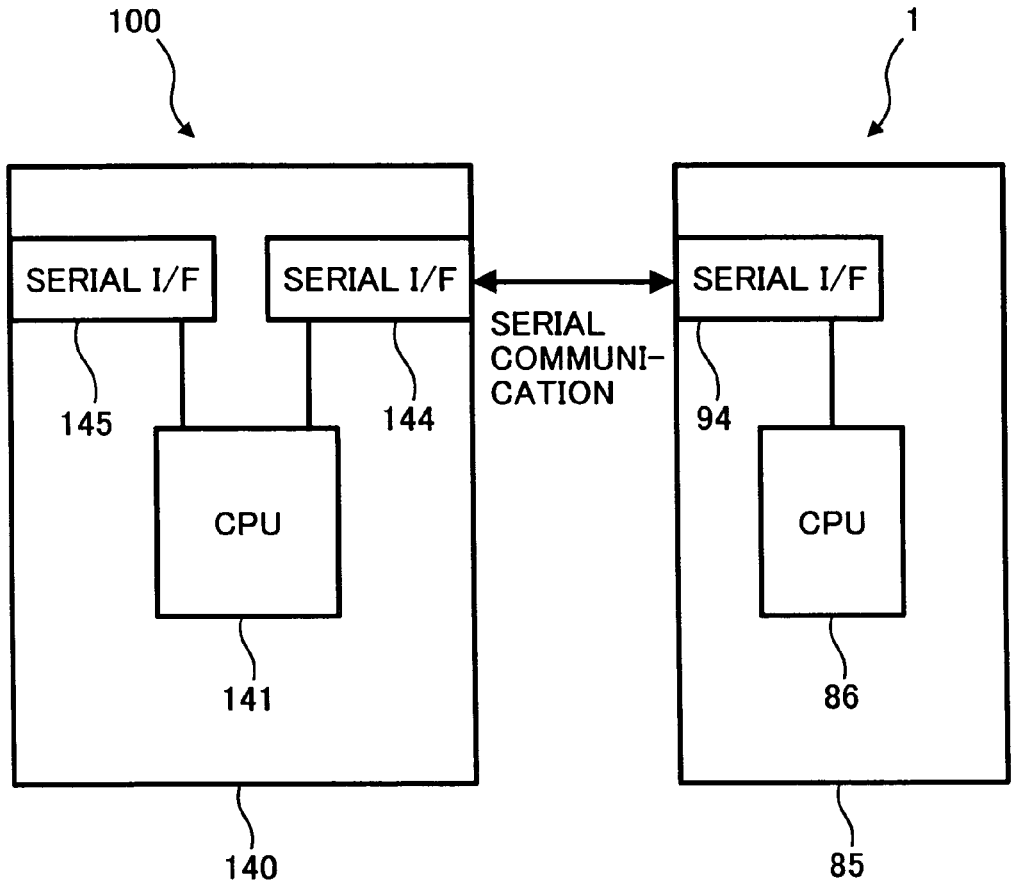
FIG. 34 is a block diagram illustrating an outline of a main electric control configuration when the mimeographic printing apparatus and the large capacity sheet feeding/conveying unit are in an on-line mode.

FIG. 34 is a block diagram illustrating an outline of the control configuration of the mimeographic printing apparatus 100 and the large capacity sheet feeding/conveying unit 1 that are used in the on-line mode in which the mimeographic printing apparatus 100 and the large capacity sheet feeding/conveying unit 1 are connected in a state that the large capacity sheet feeding/conveying unit 1 is able to communicate with the mimeographic printing apparatus 100 through, for example, a communication cable (not illustrated).

A main body controller 140 for controlling an operation of the mimeographic printing apparatus 100 is arranged in the main body housing 107 of the mimeographic printing apparatus 100. The main body controller 140 is provided with a microcomputer inclusive of a CPU (Central Processing Unit) 141, RAM (Random Access Memory), a timer that serves as a time calculating device (not illustrated), a ROM (Read Only Memory) that serves as a memory device (not illustrated).

Further, the main body controller 140 is provided with a serial I/F (Interface) device 144 for making a serial communication with the controller 85 in the large capacity sheet feeding/conveying unit 1 (hereinafter simply called serial I/F 144), and a Serial I/F device 145 for making a communication with a sheet discharge control device (not illustrated) in the large capacity sheet discharging/storing apparatus 200 (hereinafter simply called serial I/F 145) and the like.

Furthermore, the CPU 141 and the aforementioned ROM are connected with an address bus and a data bus (Both of which are not illustrated). Likewise, the CPU 141, the aforementioned. RAM, the aforementioned timer, the serial I/F 144, and the serial I/F 145 are connected with each other via a signal bus (not illustrated) in the microcomputer mentioned above. The main body controller 140 is mounted on the control board (not illustrated) that is arranged in the main body housing 107.

In the main body controller 140, even though an illustration is omitted in FIG. 34, elements for control devices that are illustrated in FIG. 14 relevant to an input and an output operation, such as the height sensor 126, the sheet existence sensor 127, the sheet length sensor 128, the sheet feeding motor 122, the registration motor and the main motor are connected via the input port 92 and the output port 93. (Both of which are not illustrated in FIG. 34).

In the controller 85 on a side of the large capacity sheet feeding/conveying unit 1, the serial I/F device 94 for making a serial communication with the main body controller 140 (hereinafter called serial I/F 94) is also provided. Even though the illustration is omitted in FIG. 34, each of the elements for the control devices relevant to an input and output operation, such as, each of the first to the eighth sensors, each of the first to the third motors, each of the solenoids or the like that are similar to that illustrated in FIG. 14 are connected to the controller 85 through the input port 92 and the output port 93 (not illustrated in FIG. 34).

The main body controller 140 controls each of the devices included in the mimeographic printing apparatus 100 to execute the operations relevant to the on-line mode when the main body controller 140 recognizes that the large capacity sheet feeding/conveying unit 1 is connected to the mimeographic printing apparatus 100 in a state capable of making a serial communication. Likewise, the controller 85 controls each of the devices included in the large capacity sheet feeding/conveying unit 1 to execute the operations relevant to the on-line mode, when the main body controller 140 recognizes that the mimeographic printing apparatus 100 is connected to the large capacity sheet feeding/conveying unit 1 in a state capable of making a serial communication.

Accordingly, a main difference between a configuration of control in which both of the large capacity sheet feeding/conveying unit 1 and the mimeographic printing apparatus 100 are used in the on-line mode, and another configuration of control in which both of the large capacity sheet feeding/conveying unit 1 and the mimeographic printing apparatus 100 are sometimes used in the off-line mode is that in the on-line mode, the first to the fourth sheet width sensors, 95-1 to 95-4 are provided and the controller 85 has below-mentioned function in addition to the aforementioned function in the off-line mode.

That is, the main body controller 140 (CPU 141) in the on-line mode has a function that serves as a control device to control the sheet feeding motor 122 such that the main body sheet feeding roller 111 stops the conveying operation for the second sheet P2 that is conveyed after the reset time, i.e., when the first sheet P1 is completed to be conveyed onto the first sensor 50-1 to the eighth sensor 50-8 and onto the first sheet width sensor 95-1 to the fourth sheet width sensor 95-4, if the controller 85 transmits a command to the main body controller 140 that at least one (in the first embodiment, both) of the sheet length and the sheet width judged from the second sheet P2 conveyed after the reset time is different from the sheet length and the sheet width of the first sheet P1, which are judged on the basis of the signals from each of the first sensor 50-1 to the eighth sensor 50-8 and each of the first sheet width sensors 95-1 to the fourth sheet width sensor 95-4, respectively.

The aforementioned function of the main body controller 140 (CPU 141) may be allotted to the controller 85 because both of the large capacity sheet feeding/conveying unit 1 and the mimeographic printing apparatus 100 are in the on-line mode.

That is, when the controller 85 (CPU 86) is in the "on-line mode", the controller 85 has a function that serves as a control device of the present invention because the controller 85 transmits a command (instruction signal) to the main body controller 140 to control the sheet feeding motor 122 to stop such that the main body sheet feeding roller 111 stops the conveying operation for the second sheet P2 that is conveyed after the reset time, i.e., the time when the first sheet P1 is completed to be conveyed onto the first to the eighth sensors, 50-1 to 50-8 and the first to the fourth sheet width sensors, 95-1 to 95-4, if at least one (in the first embodiment, both) of the sheet length and the sheet width judged from the second sheet P2 conveyed after the reset time is different from the sheet length and the sheet width of the first sheet P1 which is judged on the basis of the signals from each of the first to the eighth sensors, 50-1 to 50-8 and the first to the fourth sheet width sensors, 95-1 to 95-4, respectively.

In the on-line mode, as for a sheet size detection signal for controlling an on-line operation of the mimeographic printing apparatus 100, a sheet length detection signal transmitted from the sheet length sensor 128 that is arranged on a side of the main body sheet feeding tray 110 is not used but a command (instruction signal) relevant to a sheet size detection data transmitted from the controller 85 of the large capacity sheet feeding/conveying unit 1 is used.

Further, in the on-line mode, as for a sheet existence detection signal, the sheet existence detection signal transmitted from the sheet existence sensor 127 that is arranged on a side of the main body sheet feeding tray 110 is not used but a command (instruction signal) relevant to a sheet existence detection that is transmitted from the controller 85 of the large capacity sheet feeding/conveying unit 1 is used.

As for the command relevant to the sheet existence detection generated by the controller 85 when the sheet exists, the command that represents existence of the sheet is transmitted to the CPU 141 of the main body controller 140 via each of the serial I/F 94 and the serial I/F 144 and when the sheet does not exists, the command that represents absence of the sheet is transmitted to the CPU 141 of the main body controller 140 via each of the serial I/F 94 and the serial I/F 144 at a constant interval.

The judgment for existence or absence of the sheet mentioned above is based on the sheet existence detection signal transmitted from the sheet existence sensor 66 arranged in the large capacity sheet feeding tray 10 or the signals relevant to the sheet length and the sheet existence from each of the first to the eighth sensors, 50-1 to 50-8.

Figure 36:
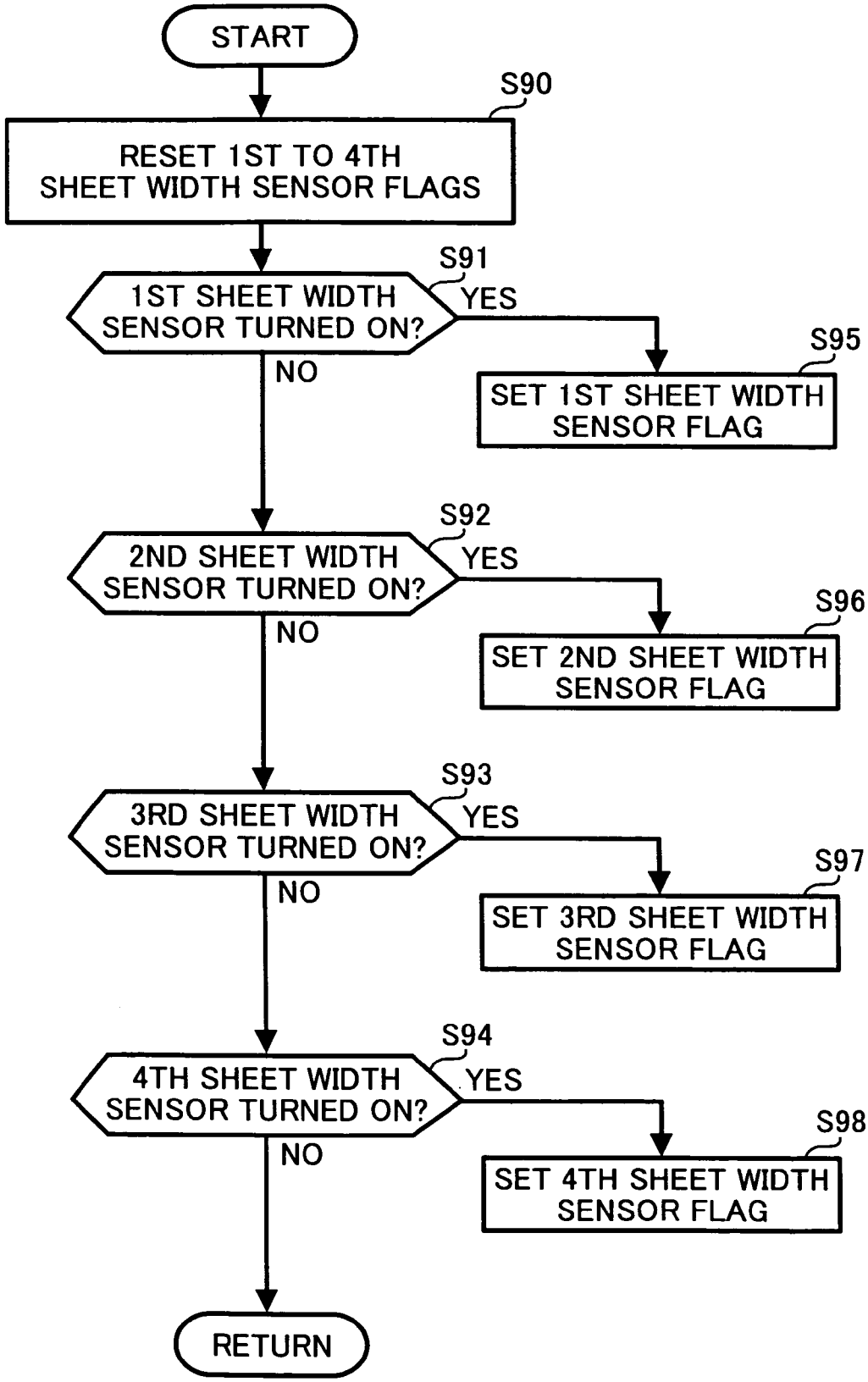
FIG. 36 is a flowchart relevant to sheet width detection.

As for the sheet size detection, the sheet length detection and the sheet width detection are executed as mentioned above. FIG. 35 illustrates a flowchart relevant to the sheet length detection and FIG. 36 illustrates a flowchart relevant to the sheet width detection, respectively, and the example of each of the detections is mentioned before. A detailed explanation for the flowchart in FIGS. 35 and 36 is omitted because of obviousness.

Further, arrangement of the first to the fourth sheet width sensors, 95-1 to 95-4 is not limited to the position where the sheet width of the first sheet P1 for initialization that is located at a reset position and the sheet width of the second sheet P2 that is conveyed after the initialization time that is also located at the reset position can be detected as illustrated in FIGS. 12 and 13, but a position, for example, where the sheet width of the sheet P can be detected during the time when the sheet P is being conveyed through the intermediate sheet conveying path 18 may be possible.

Furthermore, as for the kind of the sheet width sensor, other than the aforementioned plurality of sensors, a contact image sensor may be employed. The contact image sensor may also be employed for detecting the sheet length.

In the first embodiment of the present invention, both of the sheet length detection by the first to the eighth sensors, 50-1 to 50-8 and the sheet width detection by the first to the fourth sheet width sensors, 95-1 to 95-4 are simultaneously executed, and the controller 85 is capable of accurately judging and recognizing a final sheet size on the basis of a combination of the detected signals.

Next, the main difference between the operations in the on-line mode and the off-line mode of the entire apparatus including the large capacity sheet feeding/conveying unit 1 and the mimeographic printing apparatus 100, when the large capacity sheet feeding/conveying unit 1 is positioned at the connected position illustrated in FIG. 1, will be explained referring to FIGS. 34 to 36, and sometimes referring to FIG. 31.

First, the power switch 80 on a side of the large capacity sheet feeding/conveying unit 1 and the power switch arranged in the mimeographic printing apparatus 100 (not illustrated) are individually turned on as illustrated in FIGS. 31A and 31B, and the order of the power supplying operations is not particularly limited.

Next, the main body controller 140 judges whether the start key for plate making is pressed and is turned on at a side of the mimeographic printing apparatus 100, and the controller 85 judges whether the reset switch 81 is turned on at the side of the large capacity sheet feeding/conveying unit 1. In the on-line mode, the aforementioned reset operation is not automatically executed only by turning on of the reset switch 81.

In addition to the above, to automatically execute the reset operation illustrated in FIGS. 32A to 32C, and FIG. 33, a command relevant to the start signal as a trigger that is generated by turning on of the aforementioned start key for plate making must be input into the controller 85. Alternatively, the reset operation similar to that in the off-line mode may be executed by providing a reset key (as a manual operation).

When the leading edge of the first sheet P1 for initialization has reached is detected by receiving the sheet existence signal from the eighth sensor 50-8, the first to the third motors, 33-1 to 33-3 are turned off. Thereafter, when the leading edge of the one sheet P1 for initialization reaches and is stopped at a position nearly before the front face plate 124 of the main body sheet feeding section 104, the reset operation is completed. (See, for example, FIGS. 18, 25, and 28.)

At this moment, the controller 85 judges and recognizes the size of the first sheet P1 (both of the sheet length and the sheet width) based on a signal from the first to the eighth sensors, 50-1 to 50-8 relevant to the sheet length detection and a signal from the first to the fourth sheet width sensors, 95-1 to 95-4 relevant to the sheet width detection, and the data relevant to the sheet size is temporarily stored in the RAM 87.

Further, when the leading edge of the first sheet P1 has passed through the eighth sensor 50-8, the solenoid 72-2 for sheet existence sensor is turned off representing that the sheet exists. Accordingly, when the first sheet P1 does not exist in the intermediate sheet conveying path 18, the solenoid 72-2 for sheet existence sensor is turned on.

When the solenoid 72-2 for sheet existence sensor remains turned off and the solenoid 72-1 for sheet length sensor also remains turned off, the sheet existence sensor 127 and the sheet length sensor 128 of the main body sheet feeding tray 110 on a side of the mimeographic printing apparatus 100 are both defiladed by each of the shutters 71-2 and 71-1, respectively. Thereby, the controller recognizes as if the sheet exists on the sheet existence sensor 127 and the sheet length sensor 128 of the main body sheet feeding tray 110.

In the off-line mode, the shutter for defilading the sensor is not always necessary and above-mentioned operation may be executed on the basis of the information transmitted from the large capacity sheet feeding/conveying unit 1 (In the case of off-line mode, the information on a side of the large capacity sheet feeding/conveying unit 1 cannot be transmitted to a side of the mimeographic printing apparatus 100, and therefore, the information that represents the existence or absence of the sheet or the sheet size is transmitted by the aforementioned action of the shutters).

On the other hand, on a side of the mimeographic printing apparatus 100, the aforementioned plate discharging operation, the image reading operation for original document, the plate making/plate feeding operation, and the plate setting or the plate setting and the printing operation (so-called test printing) are once executed (in an ordinary case) by the aforementioned start signal that serves as a trigger.

At this moment, the one sheet of the first sheet P1 is conveyed from the intermediate conveying unit 4 of the large capacity sheet conveying unit 1 by the aforementioned detailed sheet conveying control, and the plate setting and the printing operation is executed by the aforementioned operation on a side of the mimeographic printing apparatus 100.

Thereafter, when a continuous sheet conveying operation caused by pressing the aforementioned print start key, corresponding to the set number of the printing sheets, is executed via the intermediate conveying unit 4, and when the second sheet P2 is stopped at the reset position, the controller 85 judges and recognizes the sheet size of the second sheet P2 based on the signal relevant to the sheet length detection received from the first to the eighth sensors, 50-1 to 50-8, and the signal relevant to the sheet width detection received from the first to the fourth sheet width sensors, 95-1 to 95-4.

Then, the controller 85 calls out data relevant to the sheet size of the first sheet P1 stored in the RAM 87 and compares both of the data. Resulting from the comparison mentioned above, if sheet size of the both of the first sheet P1 and the second sheet P2 is the same, the controller turns on the sheet feeding motor 122 and continues sheet conveying operation for the second sheet P2 by driving the main body sheet feeding roller 111 to rotate. If the sheet sizes of the both sheets are not the same, then the controller turns off the sheet feeding motor 122 and thereby interrupts and stops the rotation of the main body sheet feeding roller 111, and transmits a command of sheet jamming to the main body controller 140.

At this moment, in a display portion such as an LCD (Liquid Crystal Display) display or the like that serves as a reporting device or a display device arranged in the aforementioned operation panel of the mimeographic printing apparatus 100, a message such as "sheet jamming" or an "error" is indicated, or a warning of "sheet conveyance jamming" or "error" is reported by lighting or twinkling of an LED (Light Emitting Diode) by the command of the main body controller 140. The operation mentioned above is executed so that the reason why the conveying operation for the sheet is interrupted is reported the operator is reported to the operator.

Alternatively, the operator may by reported the reason why the conveying operation for the sheet is interrupted, by arranging the similar reporting device or the display device in the aforementioned operation panel on a side of the large capacity sheet feeding/conveying unit 1 and indicating the warning of the "sheet conveyance jamming" or "error". Hereinbelow, the explanation of the aforementioned reporting device is similarly configured to each of the first embodiments described later.

According to the first embodiment of the present invention, as described above, for example, when a sheet having a size smaller than the sheet size (plate making size and printing size) corresponding to the desired printings is mixed to the sheet P stacked on the large capacity sheet feeding tray 10, the controller can accurately detect and judge the sheet one by one. When the sheet size is different from the sheet size data of the initial setting that is detected at the reset time, the sheet conveying operation by the main body sheet conveying device is stopped.

In particular, a problem that occurs when the size of the sheet conveyed after the reset time is smaller than the sheet size data detected when reset, that is to say, transferring or printing of ink to a circumferential face of a pressure roller or a pressure drum causing a sheet jamming due to adhering of the ink on the circumferential face of the pressure roller or the pressure drum can be prevented.

Alternatively, contamination of a rear side of the sheet by ink, which is sequentially conveyed even when the sheet has not jammed, or contamination of inside space of the printing apparatus by dropping or scattering of the ink that is adhered and accumulated onto the circumferential face of the pressure roller or the pressure drum can also be prevented. Further, a problem such as sheet jamming caused by failing of printed sheet discharging can also prevented.

Thus, when the sheet is printed, contamination of the sheet that occurs when the sheet having a size different from the size of the first sheet P1 is conveyed and printed can be prevented and a stopping of the printing apparatus can be prevented.

When the size of only one sheet P (first sheet P1) for initial setting or the sheet P and a few sheets that successively follow the sheet P are different from the size of the sheet (the size of plate making and printing) corresponding to the desired printing s, it is not considered to be a problem because of the reasons mentioned below.

In a typical case, the sheet P may be put or replenished on top of the stacked sheets in the large capacity sheet feeding tray 10 by the user, and accordingly, the sheet P is visible to the user. In such a case, the aforementioned problem is considered to be quite rare to occur.

Further, in such a case, when the mimeographic printing apparatus 100 is a relatively high grade printing apparatus, usually, the main body controller 140 is monitoring and controlling whether the sheet size is usable for the mimeographic printing apparatus 100, corresponding to the size (size of plate making and printing) of the heat-sensitive mimeographic master, so that the aforementioned problem can be prevented (The size of the bundle of sheets that are stacked on the main body sheet feeding tray 110 is detected, even though the sheet length and sheet width of each of the conveyed sheet P is not detected, as is detected in the first embodiment of the present invention).

That is, when the size of the sheet for initial setting, which is detected when reset, is different from that of plate making and printing, (Specifically, the problem is that the latter is smaller than the former at a sheet conveying direction and a sheet width direction.) the rotation of the main body sheet feeding roller 111 is interrupted and stopped by turning off the sheet feeding motor 122 on the basis of a sheet size data signal corresponding to the size of plate making and printing that is transmitted from the main body controller 140 to the controller 85.

Thereby, the sheet P (first sheet P1) for initial setting is prevented from being conveyed to the printing section 102 by the rotation of the main body sheet feeding roller 111. Hereinafter, the sheet conveying operation control method is called as a plate making printing size control method.

In the mimeographic printing apparatus 100 adopting the plate making printing size control method, the sheet conveying operation is not limited to the above mentioned example. The controller 85 may judge and recognize the size of the second sheet P2 on the basis of the signal from the first to the eighth sensors, 50-1 to 50-8 relevant to the sheet length detection and the signal from the first to the fourth sheet width sensors, 95-1 to 95-4 relevant to the sheet width.

Also, the controller 85 may compare the sheet size data of the second sheet P2 with the sheet size data corresponding to the plate making and printing size that is transmitted from the main body controller 140 to the controller 85 by once storing to the RAM 87 and calling out the same, instead of the operation to compare the sheet size data of the second sheet P2 with the data relevant to the size of the first sheet P1 that is stored in the RAM 87 by calling out the same from the RAM 87.

Second Embodiment

The main difference between the first embodiment and the second embodiment of the present invention is that the first to the fourth sheet width sensors, 95-1 to 95-4 is removed and a function of the main body controller 140 (CPU 141) or the controller 85 (CPU 86) is changed from that of the first embodiment of the present invention, as mentioned below.

The main body controller 140 (CPU 141) has a function that serves as a control device, in which the main body controller 140, in the on-line mode, compares the judged sheet length of the second sheet P2 that is conveyed after the reset time with the sheet length of the first sheet P1 that is judged on the basis of the signal transmitted from each of the first to the eighth sensors, 50-1 to 50-8 at the reset time when the conveying operation for the first sheet P1 onto each of the first to the eighth sensors, 50-1 to 50-8 is completed, and if the command reporting that the sheet length of the second sheet P2 is different from the first sheet P1 is transmitted from the controller 85, the sheet feeding motor 122 is stopped so that the conveying operation of the main body sheet feeding roller 111 for the sheet (second) P2 conveyed after the reset time is stopped.

Alternatively, the controller 85 (CPU 86) has a function that serves as a control device of the second embodiment of the present invention, in which the controller 85, in the on-line mode, compares the sheet length of the second sheet P2 that is conveyed after the reset time with the sheet length of the first sheet P1 that is judged on the basis of the signal transmitted from each of the first to the eighth sensors, 50-1 to 50-8 at the reset time when the conveying operation for the first sheet P1 onto each of the first to the eighth sensors, 50-1 to 50-8 is completed, and if the judged sheet length of the (second) sheet P2 is different from that of the judged sheet length of the first sheet P1, the controller 85 transmits a control command (instruction) to the main body controller 140, in which the sheet feeding motor 122 is stopped so that the conveying operation of the main body sheet feeding roller 111 for the sheet (second) P2 that is conveyed after the reset time is stopped.

The above described operation in the second embodiment of the present invention is easily understood and carried out by a person having ordinary skill in the art, referring to the aforementioned control configuration and the explanation of the first embodiment, therefore, the explanation for the second embodiment of the present invention is omitted.

The second embodiment can provide the similar advantage as that of the first embodiment, and in the second embodiment, only the sheet length is detected and is used for the specific control of the present invention. Therefore, if such accurate sheet size detection as that in the first embodiment is not necessary, it is advantageous that the configuration for control operation may be simplified and the cost of manufacture is thereby decreased.

Third Embodiment

Figure 37:
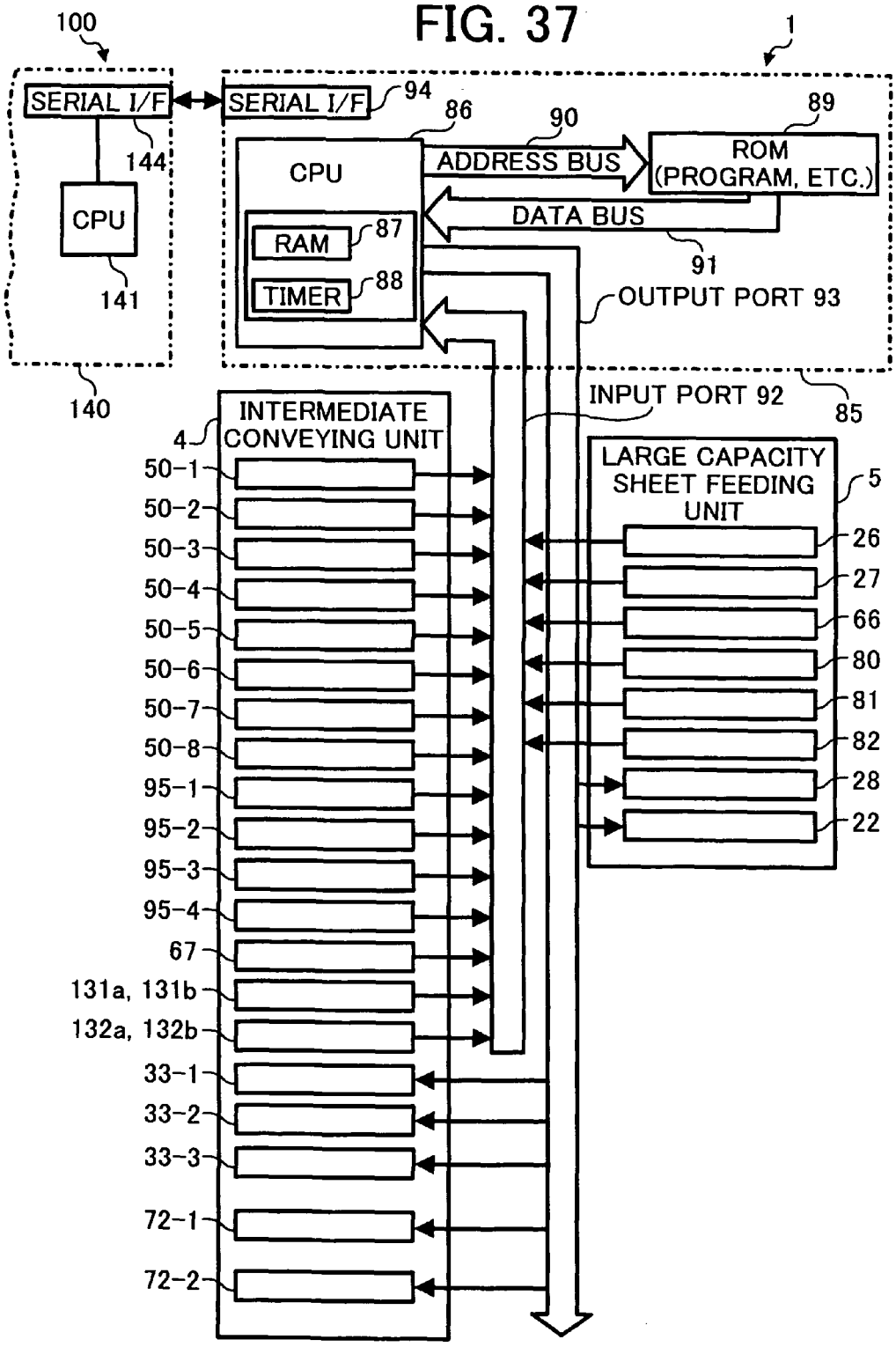
FIG. 37 is a block diagram illustrating a main electric control system component relevant to the third embodiment of the present invention, in which the mimeographic printing apparatus and the large capacity sheet feeding/conveying unit are in the on-line mode.

The third embodiment of the present invention will be explained referring now to FIGS. 37 and 38.

The main difference between the third embodiment and the first embodiment is that two of sheet length sensors 131*a* and 131*b* (hereinafter referred to as sheet length sensors group 131*a* and 131*b*) and two of sheet width sensors 132*a* and 132*b* (hereinafter referred to as sheet width sensors group 132*a* and 132*b*) are arranged in the large capacity sheet feeding tray 10, and the function of the main body controller 140 (CPU 141) or the controller 85 (CPU 86) is changed as described below.

Figure 38:
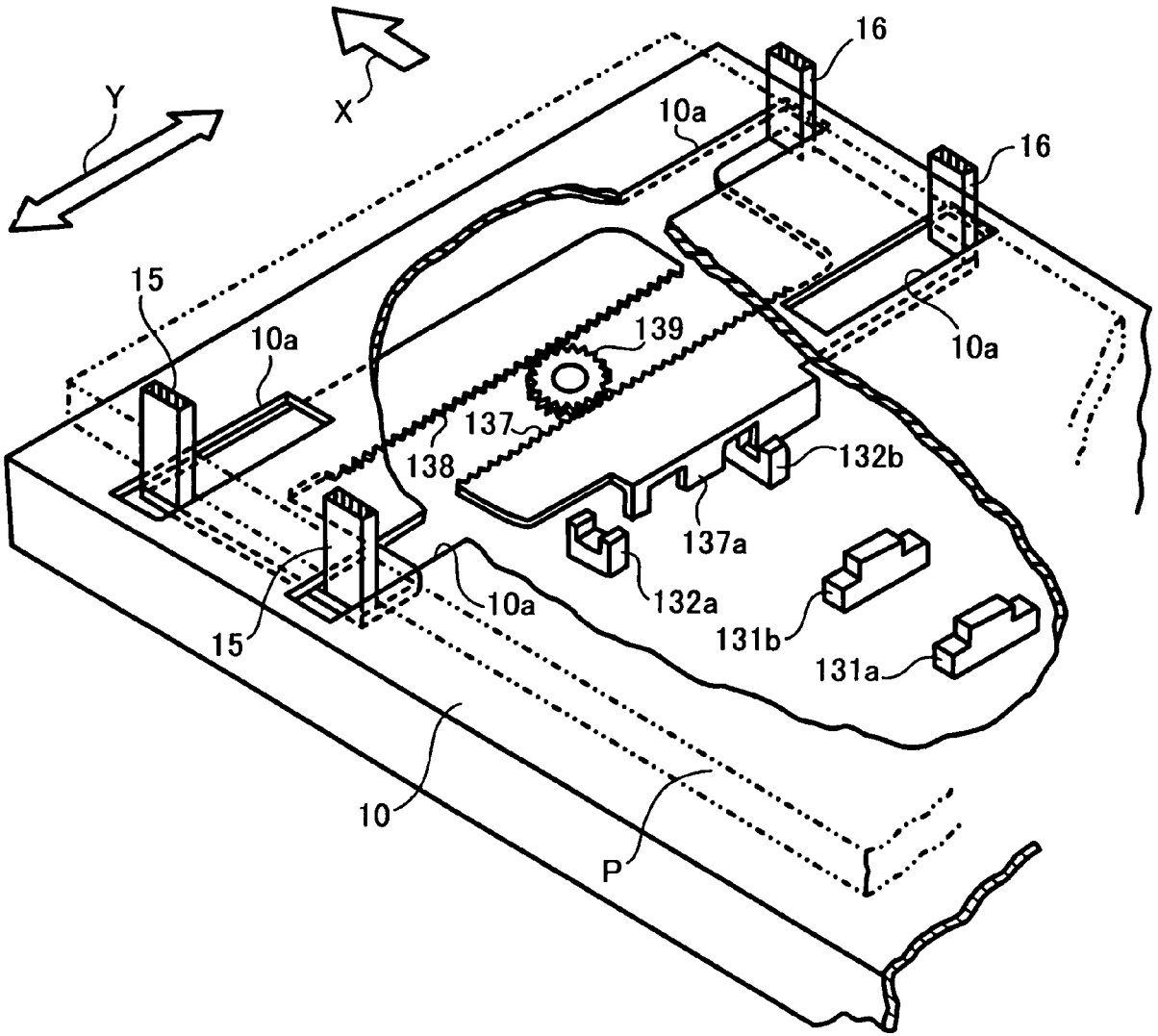
FIG. 38 is a perspective view illustrating a partially exposed sheet size detection mechanism arranged in the large capacity sheet feeding tray relevant to the third embodiment of the present invention.

As illustrated in FIG. 38, a sheet size detection mechanism provided with a sheet size detection device is arranged in the bottom of the large capacity sheet feeding tray 10. The sheet size detection mechanism is configured such that the sheet size is detected and determined in response to a movement of a side fence 15 and a side fence 16 in the sheet width direction indicated by a broad arrow Y. The sheet size detection mechanism is provided with both of the side fences, 15 and 16, a pinion 139 that is rotatably supported on an immovable member arranged on the bottom of the large capacity sheet feeding tray 10, a rack portion 138 meshing on the pinion 139, which is formed on a lower end portion of the side fence 15 at a front left side of FIG. 38, another rack portion 137 meshing on the pinion 139 facing against the rack portion 138, which is formed on a lower end portion of the side fence 16 at a rear right side of FIG. 38.

Further, the sheet size detection mechanism is provided with a defilade 137*a* provided with a plurality of crenae projected downward on the bottom end portion of the rack portion 137 and cut at proper intervals, the sheet length sensors group 131*a* and 131*b* a plurality of which are arranged at predetermined intervals from an upstream to a downstream of the large capacity sheet feeding tray 10, as a sheet length detection device that detects the sheet length by detecting a rear end portion of the sheet P stacked on the large capacity sheet feeding tray 10, and the sheet width sensors group 132*a* and 132*b* a plurality of which are arranged at predetermined intervals in the sheet width direction of the large capacity sheet feeding tray 10, which detects the sheet width by selectively engaging with each of the defilades 137*a*, as a sheet width detection device of the large capacity sheet feeding tray.

The sheet length sensors group 131*a* and 131*b* and the sheet width sensors group 132*a* and 132*b* are fixed on the above-mentioned immovable member of the large capacity sheet feeding tray 10. The sheet length sensors group 131*a* and 131*b* are the reflection type sensor and the sheet width sensors group 132*a* and 132*b* are the transmission type sensor.

The sheet length sensors group 131*a* and 131*b*, and the sheet width sensors group 132*a* and 132*b* compose the sheet detecting device. The final sheet size is determined by the CPU 86 of the controller 85 that judges and recognizes the sheet size by combining the data signal relevant to the sheet length detected with the sheet length sensors group 131*a* and 131*b*, and another data signal relevant to the sheet width detected with the sheet width sensors group 132*a* and 132*b*.

In the above-mentioned sheet size detection mechanism, the number of each of the sensors illustrated in FIG. 38 is limited to two sensors to simplify the explanation thereof, however, each of the aforementioned sensors is increased so that ten kinds of sheet sizes (illustrated in FIGS. 11 and 16) can automatically be detected. In the description above, the sensors are named as, the sheet length sensors group 131*a* and 131*b*, and the sheet width sensors group 132*a* and 132*b* for convenience of simplification.

As for the details of such a sheet size detection method, for example, the art disclosed in Japanese Laid-Open Patent Publication No. Hei9-30714, which is proposed by the applicant of the present invention before can be given. As for the sheet size detection method, without being limited to the method mentioned above, other method, for example, a sheet size detection method using the reflection type sensor that is arranged in the intermediate conveying unit 4 may be available, and alternatively, when the topmost sheet P stacked on the large capacity sheet feeding tray 10 is at a stand by position for feeding a sheet, the reflection type sensor or the like may be arranged such that the sheet size of the topmost sheet P is detected. Of course, each of the sensors may be added so that a post card, an envelope, or a legal size can be detected.

The main body controller 140 (CPU 141) has a function as a control device, in which, in the on-line mode, when the controller 85 transmits a command to the main body controller 140 reporting that at a reset time when the conveying operation for first sheet P1 onto the first to the eighth sensors, 50-1 to 50-8 and the first to the fourth sheet width sensors, 95-1 to 95-4 is completed, compared to at least either one (both, in the present invention) of sheet length judged on the basis of the signal from the sheet length sensors group 131*a* and 131*b*, and sheet width judged on the basis of the signal from the sheet width sensors group 132*a* and 132*b*, at least either one (both, in the present invention) of sheet length judged on the basis of the signal from each of the first to the eighth sensors, 50-1 to 50-8, and sheet width judged on the basis of the signal from the first to the fourth sheet width sensors, 95-1 to 95-4 of the first sheet P1 conveyed at the reset time and after the reset time is different, the sheet feeding motor 122 is controlled such that the main body sheet feeding roller 111 stops a conveying operation for the sheet P conveyed at the reset time and after the reset time.

The above mentioned function of the main body controller 140 (CPU 141) may be allotted for the controller 85 because the main body controller 140 and the controller 85 are in the on-line mode. That is, the controller 85 (CPU 86) has a function that serves as a control device in which, in the on-line mode, at a reset time when the conveying operation for first sheet P1 onto the first to the eighth sensors, 50-1 to 50-8 and the first to the fourth sheet width sensors, 95-1 to 95-4 is completed, compared to at least either one (both, in the present invention) of sheet length judged on the basis of the signal from the sheet length sensors group 131*a* and 131*b*, and sheet width judged on the basis of the signal from the sheet width sensors group 132*a* and 132*b*, when at least either one (both, in the present invention) of sheet length judged on the basis of the signal from each of the first to the eighth sensors, 50-1 to 50-8, and sheet width judged on the basis of the signal from the first to the fourth sheet width sensors, 95-1 to 95-4 of the sheet P conveyed at the reset time and after the reset time is different, the controller 85 transmits a command (instruction signal) to the main body controller 140 such that the sheet feeding motor 122 is controlled so that the main body sheet feeding roller 111 stops a conveying operation for the sheet P conveyed at the reset time and after the reset time. Thereby, the controller 85 (CPU 86) has a function that serves as a control device of the present invention.

Next, referring now to FIGS. 37, 38, and sometimes 31, the main difference between the operation of the entire apparatus including the large capacity sheet feeding/conveying unit 1 and the mimeographic printing apparatus 100 in the on-line mode and that in the off-line mode in which the large capacity sheet feeding/conveying unit 1 is positioned at the connected position in FIG. 1 will be explained.

Similar to the operation of the first embodiment of the present invention, first, the power switch 80 (illustrated in Step S50 in FIG. 31) on a side of the large capacity sheet feeding/conveying unit 1 and the power switch (illustrated in Step S45 in FIG. 31) arranged in the mimeographic printing apparatus 100 are individually turned on.

Thereafter, the main body controller 140 judges whether the aforementioned start key for plate making is pressed down and turned on, at a side of the mimeographic printing apparatus 100, and the controller 85 judges whether the reset switch 81 is turned on, at a side of the large capacity sheet feeding/conveying unit 1. In the on-line mode, the reset operation described in the off-line mode is not automatically executed only by executing the turning on operation of the reset switch 81.

That is, in addition to the above mentioned turning on operation of the reset switch 81, it is required to automatically execute the reset operation illustrated in FIGS. 32A to 32C and FIG. 33 that the start signal generated by the aforementioned turning on operation of the plate making start key, as a trigger, causes the sheet size detecting operation for the sheet P stacked on the large capacity sheet feeding tray 1, and a command relevant to the start signal is input the controller 85.

The reset operation mentioned above is different from that in the first embodiment of the present invention at the point in which the detecting operation for the sheet P (bundle of sheets) stacked on the large capacity sheet feeding tray 10 is executed in a manner as described below. The sheet length is detected with the sheet length sensors group 131*a* and 131*b*, and the sheet width is detected with the sheet width sensors group 132*a* and 132*b*. Further, the controller 85 judges and recognizes the sheet size of the sheet P on the basis of the signal relevant to the sheet length detection from the sheet length sensors group 131*a* and 131*b*, and the signal relevant to the sheet width detection from the sheet width sensors group 132*a* and 132*b*, and the data relevant to the sheet size is temporarily stored in the RAM 87.

When a signal including the information in which the leading edge of the first sheet P1 for initial setting (hereinafter simply called first sheet P1) has reached the reset position is detected by a sheet existence signal from the eighth sensor 50-8, the first to the third motors, 33-1 to 33-3 are turned off. Further, when the leading edge of one sheet of the first sheet P1 has stopped at a position nearly before the front face plate 124 of the main body sheet feeding section 104, namely, the leading edge of one sheet of the first sheet P1 has reached the reset position, the reset operation is completed (See FIGS. 18, 25, and 28, for example).

At this moment, the controller judges and recognizes the sheet size of the first sheet P1 on the basis of the signal relevant to the sheet length from the first to the eighth sensors, 50-1 to 50-8, and the signal relevant to the sheet width from the first to the fourth sheet width sensors, 95-1 to 95-4. Then the controller calls out the data stored in the RAM 87 relevant to the sheet size of the second sheet P2 (the bundle of sheets stacked on the large capacity sheet feeding tray 10) and the controller 85 compares the sheet size of the second sheet P2 and that of the first sheet P1.

As a result of the comparison, if the sheet size of both sheets P1 and P2 is the same, the controller 85 turns on the sheet feeding motor 122 resulting in rotation of the main body sheet feeding roller 111 whereby the first sheet P1 continues to by conveyed. Otherwise, if the sheet size of both of the first sheet P1 and the second sheet P2 is different, the controller 85 stops the rotation of the sheet feeding motor 122 resulting in stopping of the main body sheet feeding roller 111, and transmits a command to the main body controller 140, informing of a sheet jamming.

Therefore, in the third embodiment of the present invention, the one sheet of the first sheet P1 for initializing is not conveyed to the main body separation roller 112 and therefore, the first sheet P1 is prevented from being used for the plate setting printing on a side of the mimeographic printing apparatus 100. The operation after the second sheet P2 is conveyed is substantially the same to that in the first embodiment of the present invention and when referring to the explanation for the aforementioned control configuration and the operation described in the first and second embodiment of the present invention, the operation after the second sheet P2 is conveyed is easily understood and carried out by a person having ordinary skill in the art, and therefore the explanation is omitted.

In addition to the advantage of the first embodiment of the present invention, the third embodiment has a further advantage in which even in the mimeographic printing apparatus 100 that does not adopt the aforementioned plate making and printing size control method the conveying operation for the first sheet P1 for initializing at the reset time and the second sheet P2 that is conveyed after the reset time can be interrupted and stopped.

The sheet length sensors group 131*a* and 131*b*, and the sheet width sensors group 132*a* and 132*b* in the third embodiment detect the sheet size of the sheet P stacked at a lowermost position of the large capacity sheet feeding tray 10 and therefore, the sheet size is detected as a bundle of sheets even when the sheet P of the lowermost position of the large capacity sheet feeding tray 10 has a size different from other sheets, therefore, no problem is considered to occur as the sheet size for comparison.

In the mimeographic printing apparatus 100 adopting the plate making and printing size control method, without being limited to the aforementioned example of the sheet size detecting operation, the controller 85 judges and recognizes the sheet size of the first sheet P1 on the basis of the signal from the first to the eighth sensors, 50-1 to 50-8 relevant to the sheet length detection and the signal from the first to the fourth sheet width sensors, 95-1 to 95-4 relevant to the sheet width detection.

Further, the controller 85 may once store the sheet size data corresponding to the plate making and printing size, which is transmitted from the main body controller 140 to the controller 85, in the RAM 87 call out and compare the same without using the data relevant to the sheet size of the second sheet P2 (bundle of sheets) that is stored in the RAM 87, instead of the operation to compare the above-judged and recognized resultant data with the data relevant to the sheet size of the second sheet P2 (bundle of sheets) that is stored in the RAM 87.

Fourth Embodiment

The main differences between a fourth embodiment and the third embodiment of the present invention are that in addition to removing the first to the fourth sheet width sensors, 95-1 to 95-4 from the intermediate conveying unit 4, and the sheet width sensors group 132*a* and 132*b* from the large capacity sheet feeding tray 10, the function of the main body controller 140 (CPU 141) or the controller 85 (CPU 86) is changed as mentioned below.

In the on-line mode, the main body controller 140 (CPU 141) has a function that serves as a control device, such that at the reset time when the conveying operation for the first sheet P1 onto the first to the eighth sensors, 50-1 to 50-8 is completed, and when a command informing that the length of the sheet P conveyed at the reset time and after the reset time, which is judged on the basis of the signal from each of the first to the eighth sensors, 50-1 to 50-8 is different from the sheet length judged on the basis of a signal from the sheet length sensors group 131*a* and 131*b* is transmitted from the controller 85, the sheet feeding motor 122 is controlled to stop the main body sheet feeding roller 111 to convey the sheet P at the reset time and after the reset time.

The aforementioned function of the main body controller 140 (CPU 141) may be allotted to the controller 85 because both of the large capacity sheet feeding/conveying unit 1 and the mimeographic printing apparatus 100 are in the on-line mode. That is to say, in the on-line mode, the controller 85 transmits a command (instruction signal) to the main body controller 140 to control the sheet feeding motor 122 to be stopped so that the main body sheet feeding roller 111 stops the conveying operation for the sheet P2 that is conveyed at the reset time and after the reset time if the length of the sheet P2, which is conveyed at the reset time and after the reset time, judged on the basis of the signal from each of the first to the eighth sensors, 50-1 to 50-8 is different from the length of the sheet P1 judged on the basis of the signal from each of the sheet length sensors group 131*a* and 131*b* at the reset time when the sheet P1 is finished to be conveyed onto the first to the eighth sensors, 50-1 to 50-8. Thereby, the controller 85 (CPU 86) has a function that serves as a control device of the present invention.

The above described operation in the fourth embodiment of the present invention is easily understood and carried out by a person having ordinary skill in the art referring to the aforementioned control configuration and the explanation of the third embodiment, therefore, the explanation for the second embodiment of the present invention is omitted.

According to the fourth embodiment of the present invention, even in a case of the mimeographic printing apparatus 100 in which the aforementioned plate making and printing size control method is not adopted, the conveying operation for the second sheet P2 that is conveyed after the reset time, including the one sheet P (the first sheet P1) for initialization at the reset time can be interrupted and stopped in addition to the advantages similar to that of the second embodiment.

In the embodiments mentioned above, using the sheets of ten kinds of the sheet lengths (minimum length to be conveyed is B5T) illustrated in FIGS. 11 and 16, which are ordinarily used in the mimeographic printing apparatus 100, the aforementioned specific sheet conveying operation control can be executed and further, in consideration of decreasing cost by avoiding the control to be complicated, the intermediate conveying unit 4 is configured to use three of the first to the third conveying rollers, 32-1 to 32-3 as a minimum sheet conveying device. However, the intermediate conveying unit 4 is not limited to the above-mentioned configuration and the intermediate conveying unit 4 may be configured as follows.

For example, when four conveying rollers as a total are used as a sheet conveying device in addition to the aforementioned embodiment of the present invention, the minimum conveying sheet size can be extended to the postcard size (In this case, the distance between the conveying rollers is about 130 mm to 140 mm.). Alternatively, when only two conveying rollers are used, the shorter side of A4 cannot be conveyed and is considered to be impractical. Therefore, three conveying rollers are adopted as a preferred example in the embodiment of the present invention.

Next, there is no need to say that the image forming apparatus to which the large capacity sheet feeding/conveying unit 1 is connected is not limited to the mimeographic printing apparatus 100 that executes the printing operation supplying ink to the reproduced heat-sensitive mimeographic master from inside of the printing drum 115 about which the heat-sensitive mimeographic master is entrained by contacting of the ink supplying member thereto, arranged inside the printing drum 115 including the aforementioned circumferential face or the printing drum.

As the image forming apparatus, a copying machine, a printing press, a facsimile machine, printers including an ink-jet printer, a plotter or the like may be connected to compose the entire apparatus with the large capacity sheet feeding/conveying unit 1, and used.

The large capacity sheet feeding apparatus having an intermediate conveying unit to which the present invention is applied can be applied to the apparatus using the sheet of limited size, such as the sheet feeding apparatus disclosed in U.S. Pat. No. 5,441,247.

Further, a person having ordinary skill in the art may envision a below mentioned idea at once by the teachings of the present invention. However, the idea is within the disclosure of the present invention. The idea can be summed up as mentioned below.

That is, for example, in an image forming apparatus including a mimeographic printing apparatus or the like provided with a sheet feeding section, or in the image forming apparatus capable of being connected to a large capacity sheet feeding apparatus or the like, in which a relatively long sheet feeding path or a sheet conveying path is provided and in addition, when at least one of sheet length and sheet width of each of conveyed sheets is detected one sheet by one sheet by arranging at least one of sheet length detecting device and sheet width detecting device at a proper position before the sheet is conveyed to an image forming section, and when the sheet length and/or the sheet width of either one of the first sheet P1 and the second sheet P2 is different from the other sheet, the sheet is stopped and interrupted by a controller (especially, when at least one of the sheet length and the sheet width of the sheet is smaller than the other, the operation is effective.)

Numerous additional modifications and variations of the present invention are possible in light of the above teachings. It is therefore to be understood that within the scope of the appended claims, the present invention can be practiced otherwise than as specifically described herein.

What is claimed as new and desired to be secured by Letters Patent of the United States is:

1. A sheet feeding apparatus comprising:

a sheet stacking section configured to stack a number of sheets;

a sheet feeding mechanism configured to feed each sheet from the sheet stacking section;

an intermediate conveying device configured to convey each sheet fed from the sheet feeding mechanism to an image forming apparatus, and including a plurality of sheet conveying devices arranged in an intermediate sheet conveying path at certain intervals to convey the sheet fed from the sheet feeding mechanism;

at least one driving device configured to drive each of the plurality of sheet conveying devices; and a plurality of sheet detecting devices arranged in the intermediate sheet conveying path at certain intervals to detect a sheet length by detecting at least one of a leading edge or a trailing edge of each conveyed sheet; and a control device configured to judge a length of a first sheet according to signals sent from the plurality of sheet detecting devices at an initialization time at which the conveyance of the first sheet is completed, wherein when the sheet feeding apparatus and the image forming apparatus are mechanically connected and are allowed to communicate with each other, the control device stops the conveyance of a second sheet to the image forming apparatus if a length of the second sheet is judged to be different from the length of the first sheet after the initialization time.

2. The sheet feeding apparatus according to claim 1, wherein: the intermediate conveying device includes a plurality of sheet width detecting devices arranged at certain intervals in a sheet width direction perpendicular to the intermediate sheet conveying path to detect a sheet width of the sheet being conveyed; the control device judges the width of the first sheet according to at least one of the signals sent from the plurality of sheet detecting devices and the signals sent from the plurality of sheet width detecting devices at the initialization time at which the conveyance of the sheet is completed; and when the sheet feeding apparatus and the image forming apparatus are mechanically connected and are allowed to communicate with each other, the control device stops the conveyance of the second sheet to the image forming apparatus if a length or width of the second sheet is judged to be different from the length or width of the first sheet after the initialization time.

3. The sheet feeding apparatus according to claim 1, wherein at the initialization time, the first sheet is located on the sheet conveying device placed most downstream in the intermediate sheet conveying path and the leading edge of the first sheet is set to a position at which the first sheet can be fed to the image forming apparatus.

4. The sheet feeding apparatus according to claim 2, wherein at the initialization time, the first sheet is located on the sheet conveying device placed most downstream in the intermediate sheet conveying path and the leading edge of the first sheet is set to a position at which the first sheet can be fed by the image forming apparatus.

5. The sheet feeding apparatus according to claim 2, wherein the image forming apparatus is a mimeographic printing apparatus comprising a printing drum about which a reproduced heat-sensitive mimeographic master is entrained, wherein the image is formed on each sheet fed from the sheet conveying device by supplying an ink from inside of the printing drum while pressing the printing drum to each sheet.

6. The sheet feeding apparatus according to claim 5, wherein at the initialization time, the first sheet is located on the sheet conveying device placed most downstream in the intermediate sheet conveying path and the leading edge of the first sheet is set to a position at which the sheet can be fed to the image forming apparatus.

* * * * *